US006638705B1

(12) United States Patent
Suzuki et al.

(10) Patent No.: US 6,638,705 B1
(45) Date of Patent: Oct. 28, 2003

(54) SILVER HALIDE EMULSION AND CHEMICAL SENSITIZATION METHOD THEREOF

(75) Inventors: Hiroyuki Suzuki, Kanagawa (JP); Masafumi Mizuno, Kanagawa (JP); Kohzaburoh Yamada, Kanagawa (JP); Hirotomo Sasaki, Kanagawa (JP); Tadashi Inaba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/208,826

(22) Filed: Aug. 1, 2002

(30) Foreign Application Priority Data

Aug. 3, 2001 (JP) ..... P.2001-236553
Sep. 25, 2001 (JP) ..... P.2001-291390
Sep. 25, 2001 (JP) ..... P.2001-291391

(51) Int. Cl.[7] ..... G03C 1/09
(52) U.S. Cl. ..... 430/603; 430/605
(58) Field of Search ..... 430/603, 605

(56) References Cited

U.S. PATENT DOCUMENTS 5,049,485 A 9/1991 Deaton
5,620,841 A * 4/1997 Lok et al. ..... 430/600
5,912,111 A * 6/1999 Lok et al. ..... 430/603
5,912,112 A * 6/1999 Lok et al. ..... 430/603
5,939,245 A * 8/1999 Lok et al. ..... 430/567
6,322,961 B1 * 11/2001 Lam et al. ..... 430/603

FOREIGN PATENT DOCUMENTS

GB 1184138 3/1970
JP 8-69075 3/1996

* cited by examiner

*Primary Examiner*—Hoa Van Le
(74) *Attorney, Agent, or Firm*—Sughrue Mion, PLLC

(57) ABSTRACT

A silver halide emulsion chemically sensitized by at least one compound having a bond of anionic chalcogenide to gold(I) cation and capable of releasing a gold-chalcogen anion species and a method for chemically sensitizing a silver halide emulsion, comprising adding at least one compound having a bond of anionic chalcogenide to gold(I) cation and capable of releasing a gold-chalcogen anion species are disclosed.

26 Claims, No Drawings

SILVER HALIDE EMULSION AND CHEMICAL SENSITIZATION METHOD THEREOF

FIELD OF THE INVENTION

The present invention relates to a silver halide photographic light-sensitive material having high sensitivity and low fog and after storage, reduced in the fluctuation of photographic performance and the generation of fogging.

Also, the present invention relates to a silver halide emulsion having low fog, high sensitivity, high contrast, excellent reciprocity law property at high illuminance (i.e., at high intensity), small fluctuation of sensitivity due to difference in the exposure condition at exposure, and excellent wet abrasion resistance. More specifically, the present invention relates to a silver halide emulsion for use in a silver halide photographic light-sensitive material, which achieves these properties by a specific gold-chalcogen compound. The present invention also relates to a chemical sensitization method of the silver halide emulsion.

BACKGROUND OF THE INVENTION

In recent years, the color printing paper is demanded to have high performances such as high sensitivity, high image quality and toughness at the processing. To satisfy these requirements, demands for an emulsion having low fog, high sensitivity and high contrast, an emulsion reduced in the fluctuation of sensitivity during storage, an emulsion reduced in the fluctuation of photographic property due to difference in the temperature and humidity conditions at exposure, or an emulsion having excellent wet abrasion resistance are increasing. On the other hand, due to popularization of laser scanning exposure apparatuses, suitability for short-time and high-intensity exposure becomes one of important performances. A great characteristic feature of laser scanning exposure is to enable high-speed exposure and elevation of resolution. If this exposure system is applied to color printing paper, the color printing paper is required to have suitability for unusually very short-time (specifically $10^{-6}$ second) and high-intensity exposure.

A gold sensitization method is effective means for achieving high sensitivity. It is long known to use an Au(III) compound such as chloroauric acid. The chloroauric acid is satisfactorily stable in an aqueous solution but has a problem in the photographic properties such as sensitivity, gradation, suitability for high-intensity exposure, fluctuation of sensitivity during storage, wet abrasion resistance and toughness against the temperature and humidity environment at exposure. Thus, improvements in these points are being demanded.

A gold(I) compound containing a mesoionic ligand (hereinafter referred to as a "mesoionic gold(I) compound") is known as the gold compound for use in the gold sensitization and JP-A-4-267249 (the term "JP-A" as used herein means an "unexamined published Japanese patent application") discloses that this compound is useful for the production of a high-sensitivity and high-contrast emulsion. However, as disclosed in JP-A-11-218870, the mesoionic gold(I) compound has a problem in the stability in a solution. The stability in a solution is an indispensable condition for the stable production of emulsions having a constant quality and therefore, an improvement is demanded.

For solving this problem, JP-A-11-218870 proposes a method of using a gold(I) complex of a mercapto compound. This gold sensitizer is improved in the solution stability but still undergoes decomposition to fail in satisfactorily solve the problem. Furthermore, this compound gives insufficient photographic properties, for example, in wet abrasion resistance and toughness against temperature and humidity environment at exposure. Thus, an improvement is demanded.

As understood from the use of $Au_2S$ in U.S. Pat. No. 2,642,361, the chemical sensitization using gold sulfide colloid is one long known useful sensitization method. The production process of gold sulfide colloid is described, for example, in *Research Disclosure*, 37154 (1995) in addition to the above-described U.S. patent. As described in JP-A-11-218870, the sensitization by this gold sulfide colloid has a problem of giving many distributions and undesired sensitometry properties. Also, the preparation of gold sulfide colloid has a problem of requiring very long time and large expense.

Furthermore, in recent years, the silver halide photographic material is demanded to have high sensitivity and the importance of a high aspect ratio emulsion is increasing. For elevating the sensitivity of a silver halide photographic emulsion, chemical sensitization using various chemical substances so as to obtain desired sensitivity, gradation or the like is usually employed. Various chemical sensitization methods are known and representative examples thereof include sulfur sensitization, selenium sensitization, tellurium sensitization, noble metal sensitization using, for example, gold, reduction sensitization and a combination thereof. As described, for example, in JP-A-6-332093, it is known to elevate the sensitivity by combining selenium sensitization with a high aspect ratio tabular grain emulsion. Recently, the demand for high sensitivity, excellent graininess and high sharpness in a silver halide photographic light-sensitive material and for rapid processing by expediting the progress of development is strong and various improvements have been made on the above-described sensitization methods.

Among those sensitization methods, the tellurium sensitization method and tellurium sensitizer in general are disclosed in U.S. Pat. Nos, 1,623,499, 3,320,069, 3,772,031, 3,531,289 and 3,655,394, British Patents 235,211, 1,121, 496, 1,295,462 and 1,396,696, Canadian Patent 800,958, JP-A-61-67845, JP-A-61-20940, and U.S. Pat. Nos. 1,574, 944 and 4,704,349, but the detail and specific description of tellurium sensitizer is known only in British Patents 1,295, 462 and 1,396,696 and Canadian Patent 800,958.

Specifically, colloidal tellurium and potassium telluride described, for example, in Canadian Patent 800,958, which are conventionally known tellurium sensitizers, have an excellent aspect such that higher sensitivity can be achieved as compared with sulfur sensitization usually performed widely in the art. However, the colloidal tellurium is prepared by using a strong reducing agent such as stannous chloride and therefore, cannot have good reproducibility due to remaining of the reducing agent or subtle changes in the preparation conditions. Also, the potassium telluride has a problem in that the compound itself is low in stability, difficult to deal with and poor in the reproducibility.

The tellurium compounds are described also in JP-A-53-57817, JP-A-2-118566, JP-A-2-140736, U.S. Pat. Nos 4,607,000 and 4,607,001, JP-A-62-234153, JP-A-2-158730 and JP-A-3-91735, however, these are very inferior in the chemical sensitization (tellurium sensitization) intended in the present invention.

As the emulsion has higher sensitivity, the fog generated during storage is liable to more increase and when the higher sensitivity is achieved by higher aspect ratio or by selenium sensitization or tellurium sensitization, there arises a problem that the photographic property greatly changes in aging, such as generation of fog during storage. Accordingly, in the art of proceeding toward higher sensitivity, a technique for improving storability is strongly demanded at the same time with higher sensitivity by higher aspect ratio or by selenium sensitization or tellurium sensitization. Of course, such a technique should not involve any problem such as reduction in sensitivity.

On the other hand, gold sensitization is a long known important technique for obtaining a high-sensitivity emulsion and, for example, East German Patent 249,106 discloses a gold sensitization method using a gold complex of a thioether compound or a gold complex of a mercaptoamino acid, JP-A-4-67032 discloses a gold sensitization method using a gold complex having a heterocyclic ligand, and European Patent 915,371 discloses a gold sensitization method using a gold complex of a mercapto compound having a water-soluble group.

JP-A-4-204724 describes a method for applying gold selenium sensitization to a silver halide emulsion, where a labile selenium compound capable of reacting with silver ion to produce silver selenide and a gold compound are separately added. However, this method has a problem in that fog seriously increases and when the light-sensitive material is stored for a long period of time, fogging is conspicuously generated.

Furthermore, JP-A-9-269554, JP-A-2001-75214, JP-A-2001-75215, JP-A-2001-75216, JP-A-2001-75217 and JP-A-2001-75218 describe a method for applying gold-chalcogen sensitization, where a complex obtained by coordinating a labile chalcogen compound to gold is used. In this case, the sensitivity is higher than the case of separately adding a gold compound and a labile chalcogen compound and the fog is reduced, however, the bonding between gold and chalcogen atom in the gold-chalcogen compound used for the chemical sensitization is weak as compared with ion bonding and therefore, the effect is not sufficiently high.

Specific means capable of satisfying various photographic properties described above and free of those problems is being demanded.

SUMMARY OF THE INVENTION

An object of the present invention is to provide means for elevating sensitivity, reducing fog and improving storability of a silver halide photographic light-sensitive material, particularly means for preventing the increase of fog during storage.

Another object of the present invention is to provide a silver halide emulsion ensuring low fog, high sensitivity, high contrast, small fluctuation of sensitivity due to difference in the exposure condition, excellent wet abrasion resistance and excellent reciprocity law property at high illuminance (i.e., at high intensity).

These objects can be attained by the following means.

1. A silver halide emulsion chemically sensitized by at least one compound having a bond of anionic chalcogenide to gold(I) cation and capable of releasing a gold-chalcogen anion species.

2. A method for chemically sensitizing a silver halide emulsion, comprising adding at least one compound having a bond of anionic chalcogenide to gold(I) cation and capable of releasing a gold-chalcogen anion species.

3. The silver halide emulsion as described in 1 above, wherein the compound capable of releasing a gold-chalcogen anion species is a compound represented by the following formula (1):

(1)

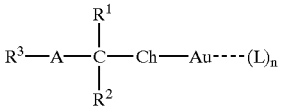

wherein Ch represents S, Se or Te, A represents O, S or $NR^4$, $R^1$ to $R^4$ each represents a hydrogen atom or a substituent, $R^3$ may form a 5-, 6- or 7-membered ring structure together with $R^1$ or $R^2$, L represents a compound capable of coordinating to gold through a nitrogen atom, a sulfur atom, a selenium atom, a tellurium atom or a phosphorus atom, and n represents 0 or 1.

4. The silver halide emulsion as described in 3 above, wherein in formula (1), $R^3$ does not form a ring structure with either $R^1$ or $R^2$.

5. The silver halide emulsion as described in 3 above, wherein in formula (1), $R^3$ forms a 5-, 6- or 7-membered ring structure together with $R^1$ or $R^2$.

6. The silver halide emulsion as described in 5 above, wherein in formula (1), the ring structure formed by $R^3$ together with $R^1$ or $R^2$ is a ring structure except for a monosaccharide structure.

7. The silver halide emulsion as described in 3 above, wherein in formula (1), $R^1$ and $R^2$ each is a group selected from a hydrogen atom, an alkyl group, an aryl group, a heterocyclic group, an alkoxy group, an aryloxy group, a heterocyclic oxy group, an alkylthio group, an arylthio group and a heterocyclic thio group.

8. The silver halide emulsion as described in 5 above, wherein in formula (1), the ring structure formed by $R^3$ together with $R^1$ or $R^2$ is a ring structure except for a monosaccharide structure.

9. The silver halide emulsion as described in 5 above, wherein in formula (1), Ch represents Se or Te and the ring structure formed by $R^3$ together with $R^1$ or $R^2$ is a monosaccharide structure.

10. The silver halide emulsion as described in 5 above, wherein in formula (1), Ch represents S and the ring structure formed by $R^3$ together with $R^1$ or $R^2$ is a monosaccharide structure.

11. The silver halide emulsion as described in 10 above, wherein in formula (1), n is 0 and the ring structure formed by $R^3$ together with $R^1$ or $R^2$ is a ring selected from the group consisting of mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine, glucuronic acid, and derivatives thereof.

12. The silver halide emulsion as described in 1 above, wherein the compound capable of releasing a gold-chalcogen anion species is a compound represented by the following formula (2):

(2)

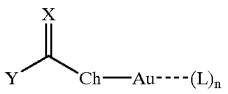

wherein Ch represents S, Se or Te, X represents O, S, Se or $NR^5$, Y represents H, an alkyl group, an alkenyl group, an alkynyl group, an aryl group, a heterocyclic group, $OR^6$, $SR^7$ or $N(R^8)R^9$, $R^5$ to $R^9$ each independently represents a hydrogen atom, an alkyl group, an alkenyl group, an alkynyl group, an aryl group or a heterocyclic group, X and Y may combine with each other to form a ring structure, L represents a compound capable of coordinating to gold through a nitrogen atom, a sulfur atom, a selenium atom, a tellurium atom or a phosphorus atom, and n represents 0 or 1.

13. The silver halide emulsion as described in 12 above, wherein in formula (2), Ch is Se or Te.

14. The silver halide emulsion as described in 12 above, wherein in formula (2), Ch is S and n is 1.

15. The silver halide emulsion as described in 12 above, wherein in formula (2), Ch is S, n is 0 and X is O or $NR^5$.

16. The silver halide emulsion as described in 1 above, wherein the compound capable of releasing a gold-chalcogen anion species is a compound represented by the following formula (3):

(3)

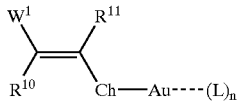

wherein Ch represents S, Se or Te, $W^1$ represents an electron-withdrawing group, $R^{10}$ and $R^{11}$ each independently represents a hydrogen atom or a substituent, $W^1$ and $R^{10}$, $W^1$ and $R^{11}$, or $R^{10}$ and $R^{11}$ may combine with each other to form a ring structure, L represents a compound capable of coordinating to gold through a nitrogen atom, a sulfur atom, a selenium atom, a tellurium atom or a phosphorus atom, and n represents 0 or 1.

17. The silver halide emulsion as described in 16 above, wherein in formula (3), $R^{10}$ represents an electron-withdrawing group.

18. The silver halide emulsion as described in 1 above, wherein the compound capable of releasing a gold-chalcogen anion species is a compound represented by the following formula (4):

(4)

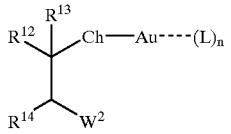

wherein Ch represents S, Se or Te, $W^2$ represents an electron-withdrawing group, $R^{12}$ to $R^{14}$ each independently represents a hydrogen atom or a substituent, L represents a compound capable of coordinating to gold through a nitrogen atom, a sulfur atom, a selenium atom, a tellurium atom or a phosphorus atom, n represents 0 or 1, and $W^2$ and $R^{12}$ may combine with each other to form a ring structure.

19. The silver halide emulsion as described in 18 above, wherein in formula (4), Ch is Se or Te.

20. The silver halide emulsion as described in 18 above, wherein in formula (4), Ch is S and n is 1.

21. The silver halide emulsion as described in 18 above, wherein in formula (4) , Ch is S, n is 0, and $R^{12}$ and $R^{13}$ each is a group selected from the group consisting of a hydrogen atom, an alkyl group, an alkenyl group, an alkynyl group, an aryl group, a heterocyclic group, an alkoxy group, an aryloxy group, a heterocyclic oxy group, an acyloxy group, an acylamino group, an alkylthio group, an arylthio group, a heterocyclic thio group, an alkylsulfonyl group, an arylsulfonyl group, an acyl group, an aryloxycarbonyl group, an alkoxycarbonyl group and a carbamoyl group.

22. The silver halide emulsion as described in 3 above, wherein in formula (1), L is an anionic chalcogenide.

23. The silver halide emulsion as described in 12 above, wherein in formula (2), L is an anionic chalcogenide.

24. The silver halide emulsion as described in 16 above, wherein in formula (3), L is an anionic chalcogenide.

25. The silver halide emulsion as described in 18 above, wherein in formula (4), L is an anionic chalcogenide.

26. A silver halide photographic light-sensitive material comprising a support having thereon at least one silver halide emulsion layer, wherein at least one silver halide emulsion layer contains a silver halide emulsion subjected to chemical sensitization by at least one compound having a bond of anionic chalcogenide to gold(I) cation and capable of releasing a gold-chalcogen anion species.

DETAILED DESCRIPTION OF THE INVENTION

The silver halide photographic emulsion of the present invention, production method thereof, silver halide photographic light-sensitive material (particularly silver halide color photographic light-sensitive material) and chemical sensitization method thereof are described in detail below.

The compound for use in the present invention is described below. The compound having a bond of anionic chalcogenide to gold(I) cation and capable of releasing a gold-chalcogen anion species is a compound having a bond of "carbon atom-chalcogen atom-gold atom (C—Ch—Au)", which releases a chemical species (Au—Ch anion) comprising "gold atom-chalcogen atom anion" by undertaking hydrolysis or other decomposition reaction when added at the preparation of emulsion and thereby exerts a chemical sensitization effect.

As described in the Background of the Invention, the gold sensitizer and chalcogen sensitizer are known techniques in the photographic art but in the present invention, it is found that when a compound containing a gold atom and a chalcogen atom in the state of these atoms being firmly bonded can simultaneously release these gold atom and chalcogen atom in the state of these atom being firmly bonded at the preparation of emulsion, a remarkably excellent sensitization action as compared with conventional chemical sensitizers can be first brought out.

To speak more specifically, in the compound having a bond of "carbon atom-chalcogen atom-gold atom (C—Ch—Au)" of the present invention, the bond between "carbon atom-chalcogen atom" is a single bond and the bond between "chalcogen atom-gold atom" is regarded as a covalent bond or an ionic bond between chalcogen atom anion-gold atom (I valent) cation but is not a coordinate bond.

The present inventors have newly found that when the compound of the present invention is added at the preparation of emulsion, hydrolysis or other decomposition reaction takes place by the assist (or even not by the assist) of silver ion present in the system to release a chemical species (Au—Ch anion) comprising "gold atom-chalcogen atom anion and this chemical species brings about excellent chemical sensitization action.

That is, as compared with the compound released in the emulsion without forming a pair of Ch with Au, the compound of the present invention exhibits excellent photographic performance. This is considered to result because when Ch does not form a pair with Au, a large amount of silver chalcogenide is produced, whereas when Ch forms a pair with Au, the production of undesired silver chalcogenide is suppressed.

In view of the form, the chemical species comprising "gold atom-chalcogen atom anion" may be considered as "Au atom-Ch (I valent) anion" or "Au(I valent) cation-Ch (II valent) anion) but in either case, it is important that a strong bond (ionic bond or covalent bond) is present between the chalcogen atom and the gold atom. In the chemical species comprising "gold atom-chalcogen atom anion", the gold atom may be coordinated by other compound.

The method for judging whether a certain compound is a compound capable of releasing a gold-chalcogen anion species is described below.

A compound sample is dissolved or dispersed in an appropriate solvent, a silver nitrate solution is added in an excess amount (10 to $10^{10}$ molar times) based on the compound sample, and the solution is heated at 70° C. The appropriate solvent used here is a solvent capable of dissolving both the sample compound and silver nitrate and specific examples thereof include water, methanol, ethanol, acetonitrile, 1,4-dioxane and a mixed solvent thereof. Many compounds capable of releasing a gold-chalcogen anion species precipitate in 3 hours after the heating. The precipitate produced is taken out and confirmed to contain gold silver chalcogenide using analysis means such as powder X-ray diffraction measurement, fluorescent X-ray measurement, IR Spectroscopy, ICP measurement or elementary analysis. The gold silver chalcogenide as used herein means a compound having a composition represented by $Ag_lAu_mCh_n$ (wherein Ch represents S, Se or Te and may be a single element or a mixture of two or more elements, and l, m and n each represents an arbitrary positive number) . Specific examples thereof include AgAuS, AgAuSe, AgAuTe, $Ag_3AuS_2$, $Ag_3AuSe_2$ and $Ag_3AuSSe$. (Here, for example, $Ag_2S$ may precipitate together with AgAuS in some cases, because the substrate has a reactive sulfur group not bonded to Au. This is not preferred in view of the purport of the present invention.)

Subsequently, the yield by volume and the yield in percentage of the obtained gold silver chalcogenide are determined and the compound of giving gold silver chalcogenide in an yield of exceeding 50% based on Ch having a reactivity in the substrate is judged as a compound capable of releasing a gold-chalcogen anion species. The compound capable of releasing gold-chalcogen anion species is preferably selected from the compounds represented by formulae (1) to (4).

In some cases, the gold silver chalcogenide does not precipitate in an yield of exceeding 50% and a silver complex of the compound sample precipitates. In this case, the compound is not a compound capable of releasing a gold-chalcogen anion species for use in the present invention.

In this reaction system, a gelatin generally used in an emulsion may be added. The pH of this reaction system is 12 or less, preferably 10 or less, more preferably 8 or less, most preferably from 3 to 7.

In the present invention, preferred is a compound of giving the precipitation of gold silver chalcogenide in an yield of exceeding 50% when in the judgement whether the compound is a compound capable of releasing a gold-chalcogen anion species, silver nitrate is used in an amount of 100 molar times the sample evaluated and the heating is performed at 50° C. for 30 minutes.

More preferred is a compound of giving the precipitation of gold silver chalcogenide in an yield of exceeding 50% when silver nitrate is used in an amount of $10^4$ molar times the sample evaluated and the heating is performed at 50° C. for 30 minutes.

Still more preferred is a compound of giving the precipitation of gold silver chalcogenide in an yield of exceeding 50% when silver nitrate is used in an amount of $10^6$ molar times the sample evaluated and the heating is performed at 50° C. for 30 minutes. Most preferred is a compound of giving the precipitation of gold silver chalcogenide in an yield of exceeding 50% when silver nitrate is used in an amount of $10^8$ molar times the sample evaluated and the heating is performed at 50° C. for 30 minutes.

The compound represented by formula (1) for use in the present invention is described in detail below. In the present invention, the "alkyl group", "alkenyl group", "alkynyl group", "aryl group" and "heterocyclic group" used in claims and the like each is not limited to an unsubstituted group but includes a substituted group.

In formula (1), Ch represents S, Se or Te. In the present invention, Ch is preferably S or Se, more preferably S. A represents O, S or $NR^4$ and $R^1$ to $R^4$ each represents a hydrogen atom or a substituent. In the present invention, A is preferably O or S, more preferably O. $R_3$ may form a 5-, 6- or 7-membered ring structure together with $R^1$ or $R^2$. L represents a compound capable of coordinating to gold through a nitrogen atom, a sulfur atom, a selenium atom or a tellurium atom. n represents 0 or 1.

Examples of the substituent represented by $R^1$ to $R^4$ include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or arylsulfonylamino group, a mercapto group (including salts thereof), an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group and a silyl group.

More specifically, examples of the substituent include a halogen atom (e.g., chlorine, bromine, iodine), an alkyl group [a linear, branched or cyclic, substituted or unsubstituted alkyl group; the alkyl group includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecyl-cyclohexyl), a bicycloalkyl group (preferably a substituted or unsubstituted bicycloalkyl group having from 5 to 30 carbon atoms, namely, a monovalent group resulting from removing one hydrogen atom of bicycloalkane having from 5 to 30 carbon atoms, e.g., bicyclo[1,2,2]heptan-2-yl, bicyclo[2,2,2]octan-3-yl), and a tricycloalkyl group having many ring structures; the alkyl group in the substituents described below (for example, the alkyl group in an alkylthio group) means an alkyl group having such a concept], an alkenyl group [a linear, branched or cyclic, substituted or unsubstituted alkenyl group, such as an alkenyl group (preferably a substituted or unsubstituted alkenyl group having from 2 to 30 carbon atoms, e.g., vinyl, allyl, prenyl, geranyl, oleyl), a cycloalkenyl group (preferably a substituted or unsubstituted cycloalkenyl group having from 3 to 30 carbon atoms, namely, a monovalent group resulting from removing one hydrogen atom of cycloalkane having from 3 to 30 carbon atoms, e.g., 2-cyclopenten-1-yl, 2-cyclohexen-1-yl) and a bicycloalkenyl group (a substituted or unsubstituted bicycloalkenyl group, preferably a substituted or unsubstituted bicycloalkenyl group having from 5 to 30 carbon atoms, namely, a monovalent group resulting from removing one hydrogen atom of bicycloalkane having one double bond, e.g., bicyclo[2,2,1]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resulting from removing one hydrogen atom of a substituted or unsubstituted, aromatic or non-aromatic 5- or 6-membered heterocyclic compound, more preferably an aromatic 5- or 6-membered heterocyclic group having from 3 to 30 carbon atoms, e.g., 2-furyl, 2-thienyl, 2-pyrimidinyl, 2-benzothiazolyl), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms and a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octyl-carbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms and a substituted or unsubstituted anilino group having from 6 to 30 carbon atoms, e.g., amino, methylamino, dimethylamino, anilino, N-methylanilino, diphenylamino), an acylamino group (preferably a formylamino group, a substituted or unsubstituted alkylcarbonylamino group having from 1 to 30 carbon atoms and a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonyl-amino, tert-butoxycarbonylamino, n-octadecyloxycarbonyl-amino, N-methylmethoxycarbonylamino), an aryloxycarbonyl-amino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoyl-amino, N,N-dimethylaminosulfonylamino, N-n-octylaminosulfonylamino), an alkyl- or aryl-sulfonylamino group (preferably a substituted or unsubstituted alkylsulfonylamino group having from 1 to 30 carbon atoms and a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group (including salts thereof; examples of the salt include alkali metal salts such as Li, Na, K, Rb and Cs, alkaline earth metal salts such as Mg and Ca, and gold salt), an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)-sulfamoyl, N,N-dimethylsulfamoyl, N-acetylsulfamoyl, N-benzoylsulfamoyl, N-(N'-phenylcarbamoyl) sulfamoyl), a sulfo group, an alkyl- or aryl-sulfinyl group (preferably a substituted or unsubstituted alkylsulfinyl group having from 1 to 30 carbon atoms and a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or aryl-sulfonyl group (preferably a substituted or unsubstituted alkylsulfonyl group having from 1 to 30 carbon atoms and a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, and a substituted or unsubstituted arylcarbonyl group having from 7 to 30 carbon atoms, e.g., acetyl, pivaloyl, 2-chloroacetyl, stearoyl, benzoyl, p-n-octyloxyphenylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an aryl- or heterocyclic-azo group (preferably a substituted or unsubstituted arylazo group having from 6 to 30 carbon atoms and a substituted or unsubstituted heterocyclic azo group having from 3 to 30 carbon atoms, e.g., phenylazo, p-chlorophenylazo, 5-ethylthio-1,3,4-thiadiazol-2-ylazo), an imide group (preferably N-succinimide and N-phthalimide), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), and a silyl group (preferably a substituted or unsubstituted silyl group having from 3 to 30 carbon atoms, e.g., trimethylsilyl, tert-butyldimethylsilyl, phenyldimethylsilyl).

Among the above-described functional groups, those having a hydrogen atom may be further substituted by a substituent described above after removing the hydrogen atom.

$R^1$ to $R^4$ each may have a substituent and examples thereof include those described above as examples of the substituent. Among the substituents which $R^1$ and $R^2$ each may have, preferred are a halogen atom, an alkyl group, an alkenyl group, an alkynyl group, an aryl group, a heterocyclic group, a cyano group, a hydroxyl group, a carboxyl group, an alkoxy group, an aryloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, an alkyl- or aryl-sulfonylamino group, an alkylthio group, an arylthio group, a heterocyclic thio group, a sulfamoyl group, a sulfo group, an alkyl- or arylsulfonyl group, an acyl group, an aryloxycarbonyl group, an alkoxycarbonyl group, a carbamoyl group, an imido group, a phosphino group, a phosphinyl group, a phosphinyloxy group, a phosphinylamino group and a silyl group, more preferred are a halogen atom, an alkyl group, an alkenyl group, an aryl group, a heterocyclic group, a cyano group, a hydroxyl group, a carboxyl group, an alkoxy group, an aryloxy group, a heterocyclic oxy group, an acyloxy group, an amino group, an acylamino group, an alkylthio group, an arylthio group, a heterocyclic thio group, a sulfamoyl group, a sulfo group, an alkyl- or aryl-sulfonyl group, an acyl group and a carbamoyl group.

In formula (1), $R^1$ and $R^2$ each is preferably a hydrogen atom, an alkyl group, an aryl group, a heterocyclic group, a hydroxyl group, an alkoxy group, an aryloxy group, a heterocyclic oxy group, an amino group, a mercapto group (or a salt thereof), an alkylthio group, an arylthio group or a heterocyclic thio group, more preferably a hydrogen atom, an alkyl group, an aryl group or a heterocyclic group, and most preferably a hydrogen atom or an alkyl group.

In formula (1), $R^3$ is preferably an alkyl group, an aryl group or a heterocyclic group, and most preferably an alkyl group or an aryl group. In formula (1), $R^4$ is preferably a hydrogen atom, an alkyl group, an alkenyl group, an alkynyl group, an aryl group, a heterocyclic group, an amino group, an acylamino group, an alkyl- or aryl-sulfonylamino group, an alkyl- or arylsulfonyl group, an acyl group, an aryloxycarbonyl group, an alkoxycarbonyl group or a carbamoyl group, more preferably a hydrogen atom, an alkyl group, an aryl group or a heterocyclic group.

In formula (1), $R^3$ may form a 5-, 6- or 7-membered ring structure together with $R^1$ or $R^2$. The ring structure formed here is a non-aromatic oxygen-, sulfur- or nitrogen-containing heterocyclic ring. This ring structure may form a condensed ring structure together with an aromatic or non-aromatic carbon ring or an aromatic or non-aromatic heterocyclic ring. In the present invention, $R^3$ preferably forms a 5-, 6- or 7-membered ring structure together with $R^1$ or $R^2$.

In formula (1) , L represents a compound capable of coordinating to gold through a nitrogen atom, a sulfur atom, a selenium atom or a tellurium atom. Specifically, L represents a substituted or unsubstituted amine, a 5- or 6-membered nitrogen-containing heterocyclic ring, a thiol, a thioether, a disulfide, a thioamide, a selenol, a selenoether, a diselenide, a selenoamide, a tellurol, a telluroether, a ditelluride or a telluroamide.

In formula (1), when L is an amine, preferred examples thereof include primary, secondary or tertiary alkylamines having from 1 to 30 carbon atoms, and substituted or unsubstituted primary, secondary or tertiary anilines having from 6 to 30 carbon atoms.

In formula (1), when L is a 5- or 6-membered nitrogen-containing heterocyclic ring, examples of the heterocyclic ring include 5- or 6-membered nitrogen-containing heterocyclic rings comprising a combination of nitrogen, oxygen, sulfur and carbon. This nitrogen-containing heterocyclic ring may have a substituent and representative examples of the substituent include those described above as the substituent of $R^1$ to $R^4$. The nitrogen-containing heterocyclic ring may be coordinated to gold through the nitrogen atom in the heterocyclic ring and when the heterocyclic ring has a substituent, may be coordinated to gold through the substituent. L is preferably benzotriazole, triazole, tetrazole, indazole, benzimidazole, imidazole, benzothiazole, thiazole, thiazoline, benzoxazole, benzoxazoline, oxazole, thiadiazole, oxadiazole, triazine, pyrrole, pyrrolidine, imidazolidine or morpholine, more preferably benzotriazole, triazole, tetrazole or indazole, and most preferably benzotriazole.

Specific examples of the thiol compound represented by L in formula (1) include alkylthiols, arylthiols and heterocyclic thiols. The thiol compound may be substituted and representative examples of the substituent include those described above as the substituent of $R^1$ to $R^4$.

The alkyl group of the alkylthiol compound represented by L in formula (1) is a substituted or unsubstituted linear, branched or cyclic alkyl group having from 1 to 30 carbon atoms, preferably an alkyl group having from 1 to 20 carbon atoms.

The aryl group of the arylthiol compound represented by L in formula (1) is a substituted or unsubstituted monocyclic or condensed cyclic aryl group having from 6 to 30 carbon atoms, such as phenyl group or naphthyl group, preferably a substituted or unsubstituted phenyl group.

The heterocyclic group of the heterocyclic thiol compound represented by L in formula (1) is a substituted or unsubstituted saturated or unsaturated 5-, 6- or 7-membered heterocyclic ring containing at least one of a nitrogen atom, an oxygen atom and a sulfur atom. This heterocyclic ring may be monocyclic or may form a condensed ring with another aryl or heterocyclic ring. The heterocyclic group is preferably a 5- or 6-membered heterocyclic group and examples thereof include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, a quinolyl group, an isoquinolyl group, an indolyl group, an indazolyl group, a benzimidazolyl group, a pyranyl group, a chromenyl group, a thienyl group, an oxazolyl group, an oxadiazolyl group, a thiazolyl group, a thiadiazolyl group, a benzoxazolyl group, a benzothiazolyl group, a morpholino group and a morpholinyl group.

The thioether represented by L in formula (1) is a thioether compound where an alkyl group, an aryl group or a heterocyclic group is bonded to a sulfur atom. The substitution may be symmetric or asymmetric with respect to the sulfur atom. Specific examples thereof include dialkylthioethers, diarylthioethers, di-heterocyclic thioethers, alkyl-aryl thioethers, alkyl-heterocyclic thioethers and aryl-heterocyclic thioethers. The alkyl group, the aryl group or the heterocyclic group of the thioether compound represented by L may be substituted and representative examples of the substituent include those described above as the substituent of $R^1$ to $R^4$.

The alkyl group of the thioether compound represented by L in formula (1) is a substituted or unsubstituted linear, branched or cyclic alkyl group having from 1 to 30 carbon atoms, preferably an alkyl group having from 1 to 20 carbon atoms.

The aryl group of the thioether compound represented by L in formula (1) is a substituted or unsubstituted monocyclic or condensed cyclic aryl group having from 6 to 30 carbon atoms, such as phenyl group or naphthyl group, preferably a substituted or unsubstituted phenyl group.

The heterocyclic group of the thioether compound represented by L in formula (1) is a substituted or unsubstituted saturated or unsaturated 5-, 6- or 7-membered heterocyclic ring containing at least one of a nitrogen atom, an oxygen atom and a sulfur atom. This heterocyclic ring may be monocyclic or may form a condensed ring with another aryl or heterocyclic ring. The heterocyclic group is preferably a 5- or 6-membered heterocyclic group and examples thereof include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a quinolyl group, an isoquinolyl group, an indolyl group, an indazolyl group, a benzimidazolyl group, a pyranyl group, a chromenyl group, a thienyl group, an oxazolyl group, a thiazolyl group, a benzoxazolyl group, a benzothiazolyl group, a morpholino group and a morpholinyl group.

In the present invention, the thioether compound is preferably a symmetric or asymmetric dialkylthioether, diarylthioether or alkyl-aryl thioether.

The disulfide represented by L in formula (1) is a disulfide compound where an alkyl group, an aryl group or a heterocyclic group is bonded to a sulfur atom. The substitution may be symmetric or asymmetric with respect to the disulfide group. Specific examples of the compound include dialkyl disulfides, diaryl disulfides, di-heterocyclic disulfides, alkyl-aryl disulfides, alkyl-heterocyclic disulfides and aryl-heterocyclic disulfides. In the present invention, the disulfide is preferably a symmetric or asymmetric dialkyl disulfide, diaryl disulfide or alkyl-aryl disulfide. The alkyl group, the aryl group or the heterocyclic group of the disulfide compound represented by L may be substituted and representative examples of the substituent include those described above as the substituent of $R^1$ to $R^4$.

The alkyl group, the aryl group and the heterocyclic group of the disulfide compound represented by L in formula (1) have the same meanings as in the case where L is a thioether compound, and preferred ranges are also the same.

In formula (1), when L is a thioamide, the thioamide group may be a part of a cyclic structure or may be an acyclic thioamide group. Examples of useful thioamides include those described in U.S. Pat. Nos. 4,030,925, 4,031,127, 4,080,207, 4,245,037, 4,255,511, 4,266,031 and 4,276,364, *Research Disclosure*, Vol. 151, Item 15162 (November, 1976), and *ibid.*, Vol. 176, Item 17626 (December, 1978). In the case where L is a thioamide, preferred examples of the thioamide compound include thiourea, thiourethane, dithiocarbamic acid ester, 4-thiazoline-2-thione, thiazolidine-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolidinedione, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione. These compounds each may be further substituted.

Specific examples of the selenol compound represented by L in formula (1) include alkylselenols, arylselenols and heterocyclic selenols. The selenol compound may be substituted and representative examples of the substituent include those described above as the substituent of $R^1$ to $R^4$.

The alkyl group of the alkylselenol compound represented by L in formula (1) is a substituted or unsubstituted linear, branched or cyclic alkyl group having from 1 to 30 carbon atoms, preferably an alkyl group having from 1 to 20 carbon atoms.

The aryl group of the arylselenol compound represented by L in formula (1) is a substituted or unsubstituted monocyclic or condensed cyclic aryl group having from 6 to 30 carbon atoms, such as phenyl group or naphthyl group, preferably a substituted or unsubstituted phenyl group.

The heterocyclic group of the heterocyclic selenol compound represented by L in formula (1) is a substituted or unsubstituted saturated or unsaturated 5-, 6- or 7-membered heterocyclic ring containing at least one of a nitrogen atom, an oxygen atom and a sulfur atom. This heterocyclic ring may be monocyclic or may form a condensed ring with another aryl or heterocyclic ring. The heterocyclic group is preferably a 5- or 6-membered heterocyclic group and examples thereof include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, a quinolyl group, an isoquinolyl group, an indolyl group, an indazolyl group, a benzimidazolyl group, a pyranyl group, a chromenyl group, a thienyl group, an oxazolyl group, an oxadiazolyl group, a thiazolyl group, a thiadiazolyl group, a benzoxazolyl group, a benzothiazolyl group, a morpholino group and a morpholinyl group.

The selenoether compound represented by L in formula (1) is a selenoether compound where an alkyl group, an aryl group or a heterocyclic group is bonded to a selenium atom. The substitution may be symmetric or asymmetric with respect to the selenium atom. Specific examples of the compound include dialkyl selenoethers, diaryl selenoethers, di-heterocyclic selenoethers, alkyl-aryl selenoethers, alkyl-heterocyclic selenoethers and aryl-heterocyclic selenoethers. In the present invention, the selenoether compound is preferably a symmetric or asymmetric dialkyl selenoether, diaryl selenoether or alkyl-aryl selenoether. The alkyl group, the aryl group or the heterocyclic group of the selenoether compound represented by L may be substituted and representative examples of the substituent include those described above as the substituent of $R^1$ to $R^4$ The alkyl group, the aryl group and the heterocyclic group of the selenoether compound represented by L in formula (1) have the same meanings as in the case where L is a thioether compound, and preferred ranges are also the same.

The compound having a diselenide group, represented by L in formula (1), is a diselenide compound where an alkyl group, an aryl group or a heterocyclic group is bonded to a selenium atom. The substitution may be symmetric or asymmetric with respect to the diselenide group. Specific examples of the compound include dialkyl diselenides, diaryl diselenides, di-heterocyclic diselenides, alkyl-aryl diselenides, alkyl-heterocyclic diselenides and aryl-heterocyclic diselenides. In the present invention, the diselenide is preferably a symmetric or asymmetric dialkyl diselenide, diaryl diselenide or alkyl-aryl diselenide. The alkyl group, the aryl group or the heterocyclic group of the diselenide compound represented by L may be substituted and representative examples of the substituent include those described above as the substituent of $R^1$ to $R^4$.

The alkyl group, the aryl group and the heterocyclic group of the diselenide compound represented by L in formula (1) have the same meanings as in the case where L is a thioether compound, and preferred ranges are also the same.

In formula (1), when L is a selenoamide compound, examples of L include compounds where the sulfur atom of thioamide compounds represented by L is replaced by a selenium atom.

Specific examples of the tellurol compound represented by L in formula (1) include alkyl tellurols, aryl tellurols and heterocyclic tellurols. The tellurol compound may be substituted and representative examples of the substituent include those described above as the substituent of $R^1$ to $R^4$.

The alkyl group of the alkyltellurol compound represented by L in formula (1) is a substituted or unsubstituted linear, branched or cyclic alkyl group having from 1 to 30 carbon atoms, preferably an alkyl group having from 1 to 20 carbon atoms.

The aryl group of the aryltellurol compound represented by L in formula (1) is a substituted or unsubstituted monocyclic or condensed cyclic aryl group having from 6 to 30 carbon atoms, such as phenyl group or naphthyl group, preferably a substituted or unsubstituted phenyl group.

The heterocyclic group of the heterocyclic tellurol compound represented by L in formula (1) is a substituted or unsubstituted saturated or unsaturated 5-, 6- or 7-membered heterocyclic ring containing at least one of a nitrogen atom, an oxygen atom and a sulfur atom. This heterocyclic ring may be monocyclic or may form a condensed ring with another aryl or heterocyclic ring. The heterocyclic group is preferably a 5- or 6-membered heterocyclic group and examples thereof include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, a quinolyl group, an isoquinolyl group, an indolyl group, an indazolyl group, a benzimidazolyl group, a pyranyl group, a chromenyl group, a thienyl group, an oxazolyl group, an oxadiazolyl group, a thiazolyl group, a thiadiazolyl group, a benzoxazolyl group, a benzothiazolyl group, a morpholino group and a morpholinyl group.

The telluroether compound represented by L in formula (1) is a telluroether compound where an alkyl group, an aryl group or a heterocyclic group is bonded to a tellurium atom. The substitution may be symmetric or asymmetric with respect to the tellurium atom. Specific examples of the compound include dialkyl telluroethers, diaryl telluroethers, di-heterocyclic telluroethers, alkyl-aryl telluroethers, alkyl-heterocyclic telluroethers and aryl-heterocyclic telluroethers. In the present invention, the telluroether compound is preferably a symmetric or asymmetric dialkyl telluroether, diaryl telluroether or alkyl-aryl telluroether. The alkyl group, the aryl group or the heterocyclic group of the telluroether compound represented by L may be substituted and representative examples of the substituent include those described above as the substituent of $R^1$ to $R^4$.

The alkyl group, the aryl group and the heterocyclic group of the telluroether compound represented by L in formula (1) have the same meanings as in the case where L is a thioether compound, and preferred ranges are also the same.

The compound having a ditelluride group, represented by L in formula (1), is a ditelluride compound where an alkyl group, an aryl group or a heterocyclic group is bonded to a sulfur atom. The substitution may be symmetric or asymmetric with respect to the ditelluride group. Specific examples of the compound include dialkyl ditellurides, diaryl ditellurides, di-heterocyclic ditellurides, alkyl-aryl ditellurides, alkyl-heterocyclic ditellurides and aryl-heterocyclic ditellurides. In the present invention, the ditelluride is preferably a symmetric or asymmetric dialkyl ditelluride, diaryl ditelluride or alkyl-aryl ditelluride. The alkyl group, the aryl group or the heterocyclic group of the ditelluride compound represented by L may be substituted and representative examples of the substituent include those described above as the substituent of $R^1$ to $R^4$.

The alkyl group, the aryl group and the heterocyclic group of the ditelluride compound represented by L in formula (1) have the same meanings as in the case where L is a thioether compound, and preferred ranges are also the same.

In formula (1), when L is a telluroamide compound, examples of L include compounds where the sulfur atom of thioamide compounds represented by L is replaced by a tellurium atom.

In the present invention, L is not a ligand which coordinates to Au by a phosphorus atom. The P ligand is considered to firmly bond to Au(I) and affect the formation of sensitization specks. Actually, those having a P ligand are not preferred in view of exposure temperature dependency, latent image stability and the like.

In the present invention, L is preferably a 5- or 6-membered nitrogen-containing heterocyclic ring, a thiol, a thioether, a thioamide, a selenol, a selenoether, a selenoamide or a tellurol, more preferably a 5- or 6-membered nitrogen-containing heterocyclic ring, a thiol, a thioether, a thioamide, a selenol or a tellurol, and most preferably a thiol, a thioether, a thioamide or a selenol.

In formula (1), n represents 0 or 1. In the present invention, n is preferably 0.

In the present invention, among the compounds represented by formula (1), preferred are the compounds where Ch is S or Se, A is O, S or $NR^4$, $R^1$ and $R^2$ each is a hydrogen atom, an alkyl group, an aryl group, a heterocyclic group, an alkoxy group, an aryloxy group, a heterocyclic oxy group, an alkylthio group, an arylthio group or a heterocyclic thio group, $R^3$ is an alkyl group, an aryl group or a heterocyclic group, and $R^4$ is a hydrogen atom, an alkyl group, an aryl group, a heterocyclic group, an amino group, an acylamino group or an alkyl- or arylsulfonylamino group, more preferred are the compounds where Ch is S or Se, A is O, S or $NR^4$, $R^1$ and $R^2$ each is a hydrogen atom, an alkyl group, an aryl group or a heterocyclic group, $R^3$ is an alkyl group, an aryl group or a heterocyclic group, and $R^4$ is a hydrogen atom, an alkyl group, an aryl group or a heterocyclic group, and most preferred are the compounds where Ch is S or Se, A is O or S, $R^1$ and $R^2$ each is a hydrogen atom, an alkyl group or an aryl group, and $R^3$ is an alkyl group or an aryl group. Particularly preferred is the case where the cyclic structure formed by $R^3$ together with $R^1$ or $R^2$ is a sugar derivative (when A in formula (1) is O) such as glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine or glucuronic acid, or a sulfur analogue thereof (when A in formula (1) is S). The sugar derivative as used herein means a compound such that the hydroxyl, amino or carboxy group in the sugar structure is substituted by an alkoxy group (including a group repeatedly containing an ethylene oxy group or propylene oxy group unit), an aryloxy group, a heterocyclic oxy group, an acyloxy group, an alkoxycarbonyloxy group, an aryloxycarbonyloxy group, a carbamoyloxy group, a sulfonyloxy group, a silyloxy group, an alkyl-, aryl- or heterocyclic-amino group, an acylamino group, a sulfonamido group, a ureido group, a thioureido group, an N-hydroxyureido group, an alkoxycarbonylamino group, an aryloxycarbonylamino group, a sulfamoylamino group, a semicarbazide group, a thiosemicarbazide group, an oxamoylamino group, an N-alkyl- or aryl-sulfonylureido group, an N-acylureido group, an N-acylsulfamoylamino group, a hydroxyamino group, an acyl group, an alkoxycarbonyl group, an aryloxycarbonyl group, a heterocyclic oxy carbonyl group, a carbamoyl group, an N-hydroxycarbamoyl group, an N-acylcarbamoyl group, an N-sulfonylcarbamoyl group, an N-carbamoylcarbamoyl group or an N-sulfamoylcarbamoyl group. This sugar structure has α isomer and β isomer different in the steric structure at the 1-position, and D form and L form in the enantiomeric relation and although these isomers are not differentiated in the present invention, a type is more preferred. In the present invention, the sugar mother nucleus is preferably glucose, mannose, galactose, xylose, lyxose, arabinose, ribose, rhamnose, 2-deoxyglucose, 2-deoxygalactose, glucosamine or galactosamine, more preferably glucose, mannose, galactose, xylose or glucosamine, and most preferably glucose. However, when in formula (1), n is 0 and Ch is S, formula (1) of the present invention does not represent a mercaptoglucoside gold(I) salt described in JP-B-45-29274 (the term "JP-B" as used herein means an "examined Japanese patent publication").

The present inventors have synthesized the mercaptoglucoside gold(I) described in JP-B-45-29274 and studied thereon together with the compound of the present invention.

The mercaptoglucoside gold(I) salt represented by the formula described in JP-B-45-29274 indicates a compound group including four isomers and therefore, specific compounds are not disclosed. Out of four isomers, the difference between D form and L form is not important because these are the same in the chemical properties except that the inexpensive D form is advantageous in the industrial use. The chemical and physical properties highly probably differ depending on whether the steric structure at the anomer position is α type or β type, and this difference is important.

In JP-B-45-29274, the steric structure at the anomer position is unknown. The present inventors have succeeded in separating and determining the α type and the β type by applying the fact that the steric structure at the anomer position of a sugar can be distinguished by observing the NMR of proton at the anomer position. By this separation and determination, the compound according to the synthesis method described in JP-B-45-29274 is found to be a mixture of steric isomers, mainly comprising β type. The present inventors have studied the mercaptoglucoside gold(I) described in JP-B-45-29274 and the compound of the present invention and found that by using the compound of the present invention, photographic performance not attainable by the mercaptoglucoside gold(I) described in JP-B-45-29274 can be achieved as described later in Examples. Incidentally, the performance of the mercaptoglucoside gold (I) is excellent as compared with conventionally well-known gold-sulfur sensitization such as a combination of chloroauric acid and hypo. However, the β-type mercaptoglucoside gold(I) is considered to have a problem in the properties.

The compound represented by formula (2) is described below.

In formula (2), Ch represents a sulfur atom, a selenium atom or a tellurium atom, X represents O, S or $NR^5$, Y represents a hydrogen atom, an alkyl group, an alkenyl group, an alkynyl group, an aryl group, a heterocyclic group, $OR^6$, $SR^7$ or $N(R^8)R^9$, $R^5$ to $R^9$ each represents a hydrogen atom, an alkyl group, an alkenyl group, an alkynyl group, an aryl group or a heterocyclic group, X and Y may combine with each other to form a cyclic structure, L represents a compound capable of coordinating to gold through a nitrogen atom, a sulfur atom, a selenium atom or a tellurium atom, and n represents 0 or 1.

In formula (2), X represents O, S or $NR^5$. In the present invention, when Ch is Se or Te, X is preferably O, S or $NR^5$, more preferably O or S; when Ch is S and n is 1, X is preferably O, S or $NR^5$, more preferably O or S; and when Ch is S and n is O, X is preferably O or $NR^5$, more preferably O.

In formula (2), Y represents a hydrogen atom, an alkyl group, an alkenyl group, an alkynyl group, an aryl group, a heterocyclic group, $OR^6$, $SR^7$ or $N(R^8)R^9$.

The alkyl, alkenyl or alkynyl group represented by Y is a substituted or unsubstituted linear, branched or cyclic alkyl, alkenyl or alkynyl group having from 1 to 30 carbon atoms, preferably an alkyl group having from 1 to 20 carbon atoms.

The aryl group represented by Y is a substituted or unsubstituted monocyclic or condensed cyclic aryl group having from 6 to 30 carbon atoms, such as phenyl group or naphthyl group, preferably a substituted or unsubstituted phenyl group.

The heterocyclic group represented by Y is a substituted or unsubstituted saturated or unsaturated 5-, 6- or 7-membered heterocyclic ring containing at least one of a nitrogen atom, an oxygen atom and a sulfur atom. This heterocyclic ring may be monocyclic or may form a condensed ring with another aryl or heterocyclic ring. The heterocyclic group is preferably a 5- or 6-membered heterocyclic group and examples thereof include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a quinolyl group, an isoquinolyl group, an indolyl group, an indazolyl group, a benzimidazolyl group, a pyranyl group, a chromenyl group, a thienyl group, an oxazolyl group, a thiazolyl group, a benzoxazolyl group, a benzothiazolyl group, a morpholino group and a morpholinyl group.

In the present invention, Y is preferably an alkyl group, an aryl group, a heterocyclic group, $OR^6$, $SR^7$ or $N(R^8)R^9$, more preferably an alkyl group, an aryl group, a heterocyclic group or $N(R^8)R^9$, still more preferably an alkyl group, an aryl group or a heterocyclic group.

The alkyl, alkenyl or alkynyl group represented by $R^5$ to $R^9$ is a substituted or unsubstituted linear, branched or cyclic alkyl, alkenyl or alkynyl group having from 1 to 30 carbon atoms, preferably an alkyl group having from 1 to 20 carbon atoms.

The aryl group represented by $R^5$ to $R^9$ is a substituted or unsubstituted monocyclic or condensed cyclic aryl group having from 6 to 30 carbon atoms, such as phenyl group or naphthyl group, preferably a substituted or unsubstituted phenyl group.

The heterocyclic group represented by $R^5$ to $R^9$ is a substituted or unsubstituted saturated or unsaturated 5-, 6- or 7-membered heterocyclic ring containing at least one of a nitrogen atom, an oxygen atom and a sulfur atom. This heterocyclic ring may be monocyclic or may form a condensed ring with another aryl or heterocyclic ring. The heterocyclic group is preferably a 5- or 6-membered heterocyclic group and examples thereof include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a quinolyl group, an isoquinolyl group, an indolyl group, an indazolyl group, a benzimidazolyl group, a pyranyl group, a chromenyl group, a thienyl group, an oxazolyl group, a thiazolyl group, a benzoxazolyl group, a benzothiazolyl group, a morpholino group and a morpholinyl group.

In the present invention, $R^5$ to $R^9$ each is preferably a hydrogen atom, an alkyl group, an aryl group or a heterocyclic group, more preferably an alkyl group or an aryl group.

In formula (2), X and Y may combine with each other to form a cyclic structure. The cyclic structure formed here is a 3-, 4-, 5-, 6- or 7-membered nitrogen-containing heterocyclic ring and specific examples thereof include pyrroles, indoles, imidazoles, benzimidazoles, thiazoles, benzothiazoles, isoxazoles, oxazoles, benzoxazoles, indazoles, purines, pyridines, pyrazines, pyrimidines, quinolines and quinazolines.

In formula (2), L and n have the same meanings as L and n in formula (1) and preferred ranges are also the same.

In the present invention, among the compounds represented by formula (2), preferred are the compounds where Ch is S or Se, X is O or S, and Y is an alkyl group, an aryl group, a heterocyclic group, $OR^6$, $SR^7$ or $N(R^8)R^9$, more preferred are the compounds where Ch is S or Se, X is O or S, and Y is an alkyl group, an aryl group or a heterocyclic group, and most preferred are the compounds where Ch is S or Se, X is 0, and Y is an alkyl group, an aryl group or a heterocyclic group. When Ch is S and n is 0, preferred is the case where X is O or $NR^5$ and Y is an alkyl group, an aryl group, a heterocyclic group, $OR^6$, $SR^7$ or $N(R^8)R^9$, and more preferred is the case where X is O and Y is an alkyl group, an aryl group or a heterocyclic group.

Formula (3) is described below.

In formula (3), Ch represents a sulfur atom, a selenium atom or a tellurium atom, $W^1$ represents an electron-withdrawing group, $R^{10}$ and $R^{11}$ each independently represents a hydrogen atom or a substituent, $W^1$ and $R^{10}$, $W^1$ and $R^{11}$, or $R^{10}$ and $R^{11}$ may combine with each other to form a cyclic structure, L represents a compound capable of coordinating to gold through a nitrogen atom, a sulfur atom, a selenium atom or a tellurium atom, and n represents 0 or 1.

$W^1$ represents an electron-withdrawing group. The electron-withdrawing group as used herein means a substituent having a Hammett's substituent constant $\sigma_p$ value of a positive value, preferably a substituent having a $\sigma_p$ value of 0.2 or more with the upper limit being 1.0 or less. Specific examples of the electron-withdrawing group having a $\sigma_p$ value of 0.2 or more include an acyl group, a formyl group, an acyloxy group, an acylthio group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, a phosphoryl group, an alkyl-sulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an imino group, an imino group substituted by an N atom, a carboxy group (or a salt thereof), an alkyl group substituted by at least two or more halogen atoms, an alkoxy group substituted by at least two or more halogen atoms, an aryloxy group substituted by at least two or more halogen atoms, an acylamino group, an alkylamino group substituted by at least two or more halogen atoms, an alkylthio group substituted by at least two or more halogen atoms, an aryl group substituted by other electron-withdrawing group having a $\sigma_p$ value of 0.2 or more, a heterocyclic group, a halogen atom, an azo group and a selenocyanate group.

In the present invention, $W^1$ is preferably an acyl group, a formyl group, a carbamoyl group, an alkoxycarbonyl group, an aryloxycarbonyl group, a cyano group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted by an N atom, a phosphoryl group, a carboxy group (or a salt thereof), an alkyl group substituted by at least two or more halogen atoms, an aryl group substituted by other electron-withdrawing group having a $\sigma_p$ value of 0.2 or more, a heterocyclic group or a halogen atom, more preferably an acyl group, a carbamoyl group, an alkoxycarbonyl group, an aryloxycarbonyl group, a cyano group, a carboxy group, an alkyl group substituted by at least two or more halogen atoms, an aryl group substituted by other electron-withdrawing group having a $\sigma_p$ value of 0.2 or more, or a heterocyclic group.

In formula (3), $R^{10}$ and $R^{11}$ each independently represents a hydrogen atom or a substituent. When $R^{10}$ and $R^{11}$ each represents a substituent, examples thereof include those described above as the substituent. $R^{10}$ is preferably a hydrogen atom or a group having the same meaning as the electron-withdrawing group represented by $W^1$, more preferably an electron-withdrawing group. $R^{11}$ is preferably a hydrogen atom, an alkyl group, an aryl group, a heterocyclic group, an alkoxy group, an aryloxy group, a heterocyclic oxy group, an amino group, an acylamino group, an alkylthio group, an arylthio group, a heterocyclic thio group, an alkyl- or aryl-sulfonyl group, an acyl group, an aryloxycarbonyl group, an alkoxycarbonyl group or a carbamoyl group, more preferably a hydrogen atom, an alkyl group, an aryl group, a heterocyclic group, an alkoxy group, an aryloxy group, a heterocyclic oxy group, an amino group or an acylamino group.

In formula (3), when $W^1$ and $R^{10}$ are different and geometrical isomers (cis form and trans form) are present in the steric structure of the compound, these isomers are not differentiated in the present invention.

In formula (3), it is also preferred when $W^1$ and $R^{10}$, $W^1$ and $R^{11}$, or $R^{10}$ and $R^{11}$ combine with each other to form a cyclic structure. The cyclic structure formed here is an aromatic carbon ring or a non-aromatic heterocyclic ring, preferably a 5-, 6- or 7-membered ring. $W^1$ for forming a cyclic structure is preferably an acyl group, a carbamoyl group, an oxycarbonyl group, a thiocarbonyl group or a sulfonyl group. $R^{10}$ and $R^{11}$ therefor each is preferably an acyl group, a carbamoyl group, an oxycarbonyl group, a thiocarbonyl group, a sulfonyl group, an imino group, an imino group substituted by an N atom, an acylamino group or a carbonylthio group.

In formula (3), L and n have the same meanings as L and n in formula (1), and preferred ranges are also the same.

In the present invention, among the compounds represented by formula (3), preferred are the compounds where Ch is a sulfur atom or a selenium atom. Also, preferred are the compounds where $W^1$ and $R^{10}$ each is an electron-withdrawing group and $R^{11}$ is a hydrogen atom, an alkyl group, an aryl group, a heterocyclic group, an alkoxy group, an aryloxy group, a heterocyclic oxy group, an amino group or an acylamino group, more preferred are the compounds where $W^1$ and $R^{10}$ each is an electron-withdrawing group and $R^{11}$ is a hydrogen atom, an alkyl group, an aryl group or a heterocyclic group, and most preferred are the compounds where $W^1$ and $R^{10}$ each is an electron-withdrawing group and $R^{11}$ is a hydrogen atom, an alkyl group or an aryl group.

Furthermore, among the compounds represented by formula (3), preferred in the present invention are the compounds where $W^1$ and $R^{10}$ form a non-aromatic 5-, 6- or 7-membered ring structure and preferably $R^{11}$ is a hydrogen atom, an alkyl group, an aryl group, a heterocyclic group, an alkoxy group, an aryloxy group, a heterocyclic oxy group, an amino group or an acylamino group, more preferred are the compounds where $W^1$ and $R^{10}$ form a non-aromatic 5-, 6- or 7-membered ring structure and $R^{11}$ is a hydrogen atom, an alkyl group, an aryl group or a heterocyclic group, and most preferred are the compounds where $W^1$ and $R^{10}$ form a non-aromatic 5-, 6- or 7-membered ring structure and $R^{11}$ is a hydrogen atom, an alkyl group or an aryl group.

The compound represented by formula (4) is described below.

In formula (4), Ch represents a sulfur atom, a selenium atom or a tellurium atom, W2 represents an electron-withdrawing group, $R^{12}$ to $R^{14}$ each independently represents a hydrogen atom or a substituent, L represents a compound capable of coordinating to gold through a nitrogen atom, a sulfur atom, a selenium atom or a phosphorus atom, n represents 0 or 1, and $W^2$ and $R^{12}$ may combine with each other to form a cyclic structure.

In formula (4), $W^2$ has the same meaning as $W^1$ in formula (3), and when Ch is Se or Te, the preferred range is also the same.

In the case where Ch is S, $W^2$ is preferably an acyl group, a formyl group, an acyloxy group, an acylthio group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfonyloxy group, an acylthio group, a thiocyanate group, a thiocarbonyl group, a carboxy group (or a salt thereof), an alkyl group substituted by at least two halogen atoms, or a halogen atom, more preferably an acyl group, a formyl group, an acyloxy group, an acylthio group, an alkoxycarbonyl group, an aryloxycarbonyl group, a cyano group, a nitro group, an alkylsulfonyl group, an arylsulfonyl group, an alkyl group substituted by at least two halogen atoms, or a halogen atom.

In formula (4), $R^{12}$ to $R^{14}$ each represents a hydrogen atom or a substituent. When $R^{12}$ to $R^{14}$ each represents a substituent, examples thereof include those described above as the substituent. When Ch is Se or Te, $R^{12}$ to $R^{14}$ each is preferably a hydrogen atom, a halogen atom, an alkyl group, an alkenyl group, an alkynyl group, an aryl group, a heterocyclic group, a cyano group, a carboxy group, an alkoxy group, an aryloxy group, a heterocyclic oxy group, an acyloxy group, an amino group, an acylamino group, an alkyl- or aryl-sulfonylamino group, an alkylthio group, an arylthio group, a heterocyclic thio group, a sulfamoyl group, an alkyl- or aryl-sulfonyl group, an acyl group, an aryloxycarbonyl group, an alkoxycarbonyl group, a carbamoyl group or an imide group, more preferably a hydrogen atom, an alkyl group, an alkenyl group, an alkynyl group, an aryl group, a heterocyclic group, an alkoxy group, an aryloxy group, a heterocyclic oxy group, an acyloxy group, an amino group, an acylamino group, an alkylthio group, an arylthio group or a heterocyclic thio group.

In the case where Ch represents S, $R^{12}$ to $R^{14}$ each is preferably a hydrogen atom, a halogen atom, an alkyl group, an aryl group, a cyano group, an acyloxy group, an alkyl- or aryl-sulfonyl group, an acyl group, an aryloxycarbonyl group or an alkoxycarbonyl group, more preferably a hydrogen atom, an alkyl group, an aryl group, a cyano group, an alkyl- or aryl-sulfonyl group, an acyl group, an aryloxycarbonyl group or an alkoxycarbonyl group.

In formula (4), L and n have the same meanings as L and n in formula (1), and preferred ranges are also the same.

W2 and $R^{12}$ may be combined with each other to form a 5-, 6- or 7-membered cyclic structure. In particular, when Ch is S, a cyclic structure is preferably formed. The cyclic structure formed here is a non-aromatic carbon ring or a non-aromatic heterocyclic ring, preferably a 5- or 6-membered ring, more preferably a 6-membered ring. $W^2$ for forming the cyclic structure is preferably an acyl group, an oxycarbonyl group, a thiocarbonyl group or a sulfonyl group, and $R^{12}$ is preferably an alkyl group, an alkenyl group, an aryl group or a heterocyclic group.

In formula (4), when Ch is S and $W^2$ and $R^{12}$ are not combined with each other to form a 5-, 6- or 7-membered cyclic structure, at least one of $R^{13}$ and $R^{14}$ is preferably an aryl group. When at least one of $R^{13}$ and $R^{14}$ is an aryl group, the aryl group is preferably a substituted or unsubstituted monocyclic or condensed cyclic aryl group having from 6 to 30 carbon atoms, such as phenyl group and naphthyl group.

In formula (4), when Ch is S and $R^{13}$ and $R^{14}$ each is not an aryl group or $W^2$ and $R^{12}$ are not combined with each other to form a cyclic structure, the sum of Hammett's substituent constant $\sigma_p$ values of $W^2$ and $R^{12}$ to $R^{14}$ is preferably 0.6 or more. At this time, depending on the case, $R^{12}$ to $R^{14}$ are also selected from the above-described electron-withdrawing groups. Examples of the combination thereof include a combination where $W^2$ is a cyano group and $R^{12}$ to $R^{14}$ each is a hydrogen atom, a combination where $W^2$ is an alkylsulfonyl group and $R^{12}$ to $R^{14}$ each is a hydrogen atom, a combination where $W^2$ is an arylsulfonyl group and $R^{12}$ to $R^{14}$ each is a hydrogen atom, a combination where $W^2$ and $R^{12}$ each is an alkoxycarbonyl group and $R^{13}$ and $R^{14}$ each is a hydrogen atom, a combination where $W^2$ is an alkoxycarbonyl group, $R^{12}$ is an acyl group and $R^{13}$ and $R^{14}$ each is a hydrogen atom, and a combination where $W^2$ is an acyl group, $R^{12}$ is an alkoxycarbonyl group and $R^{13}$ and $R^{14}$ each is a hydrogen atom.

The compound represented by formula (4) is used as a sensitizer of a silver halide emulsion and therefore, may be substituted by a hydrophilic group such as hydroxyl group, carboxyl group, alkoxy group, acyloxy group, amino group, acylamino group, alkyl- or aryl-sulfonylamino group, sulfamoyl group, sulfo group and carbamoyl group, however, it is not preferred that the hydrophilicity excessively increases by the substitution of a plurality of these substituents. In particular, as for the carboxyl group, when Ch is S, the compound represented by formula (4) does not have two or more carboxyl groups.

In the present invention, among the compounds represented by formula (4), preferred are the compounds where Ch is S or Se. Also, when Ch is Se or Te, preferred are the compounds where $W^2$ is an electron-withdrawing group, $R^{12}$ and $R^{13}$ each is a hydrogen atom, a halogen atom, an alkyl group, an alkenyl group, an alkynyl group, an aryl group, a heterocyclic group, a cyano group, a carboxy group, an alkoxy group, an aryloxy group, a heterocyclic oxy group, an acyloxy group, an acylamino group, an alkylthio group, an arylthio group, a heterocyclic thio group, a sulfo group, an alkyl- or aryl-sulfonyl group, an acyl group, an aryloxycarbonyl group, an alkoxycarbonyl group or a carbamoyl group, and $R^{14}$ is a hydrogen atom, a halogen atom, an alkyl group, an alkenyl group, an alkynyl group, an aryl group, a heterocyclic group, a cyano group, a carboxy group, a hydroxy group, an alkoxy group, an aryloxy group, a heterocyclic oxy group, an acyloxy group, an amino group, an acylamino group, an alkyl- or aryl-sulfonylamino group, an alkylthio group, an arylthio group, a heterocyclic thio group, a sulfamoyl group, an alkyl- or aryl-sulfonyl group, an acyl group, an aryloxycarbonyl group, an alkoxycarbonyl group or a carbamoyl group, more preferred are the compounds where $W^2$ is an electron-withdrawing group, $R^{12}$ and $R^{13}$ each is a hydrogen atom, an alkyl group, an alkenyl group, an aryl group, a heterocyclic group, a carboxy group, an alkoxy group, an aryloxy group, a heterocyclic oxy group, an acyloxy group, an acylamino group, an alkylthio group, an arylthio group, a heterocyclic thio group, an alkyl- or aryl-sulfonyl group, an acyl group, an aryloxycarbonyl group, an alkoxycarbonyl group or a carbamoyl group, and $R^{14}$ is a hydrogen atom, a halogen atom, an alkyl group, an alkenyl group, an alkynyl group, an aryl group, a heterocyclic group, a cyano group, a carboxy group, a hydroxy group, an alkoxy group, an aryloxy group, a heterocyclic oxy group, an acyloxy group, an amino group, an acylamino group, an alkyl- or aryl-sulfonylamino group, an alkylthio group, an arylthio group, a heterocyclic thio group, a sulfamoyl group, an alkyl- or aryl-sulfonyl group, an acyl group, an aryloxycarbonyl group, an alkoxycarbonyl group or a carbamoyl group, and most preferred are the compounds where $W^2$ is an electron-withdrawing group, $R^{12}$ and $R^{13}$ each is a hydrogen atom, an alkyl group, an alkenyl group, an aryl group, a heterocyclic group, a carboxy group, an alkoxy group, an aryloxy group, a heterocyclic oxy group, an acyloxy group, an acylamino group, an alkylthio group, an arylthio group or a heterocyclic thio group, and $R^{14}$ is a hydrogen atom, a halogen atom, an alkyl group, an alkenyl group, an alkynyl group, an aryl group, a heterocyclic group, a cyano group, a carboxy group, an alkoxy group, an aryloxy group, a heterocyclic oxy group, an acyloxy group, an amino group, an acylamino group, an alkyl- or aryl-sulfonylamino group, an alkylthio group, an arylthio group, a heterocyclic thio group, a sulfamoyl group, an alkyl- or aryl-sulfonyl group, an acyl group, an aryloxycarbonyl group, an alkoxycarbonyl group or a carbamoyl group.

Furthermore, among the compounds represented by formula (4), preferred in the present invention are the compounds where $W^2$ and $R^{12}$ combine with each other to form a non-aromatic 5-, 6- or 7-membered cyclic structure, $R^{12}$ is an alkyl group, an alkenyl group, an aryl group or a heterocyclic group, and $R^{13}$ and $R^{14}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or arylsulfonyl group, an acyl group, an aryloxycarbonyl group, an alkoxycarbonyl group or a carbamoyl group, more preferred are the compounds where $W^2$ and $R^{12}$ combine with each other to form a non-aromatic 5-, 6- or 7-membered cyclic structure, and $R^{13}$ and $R^{14}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or arylsulfonyl group, an acyl group, an aryloxycarbonyl group, an alkoxycarbonyl group or a carbamoyl group, and most preferred are the compounds where $W^2$ and $R^{12}$ combine with each other to form a non-aromatic 5-, 6- or 7-membered cyclic structure, and $R^{13}$ and $R^{14}$ each is a hydrogen atom, a halogen atom, an alkyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or arylsulfonyl group, an acyl group, an aryloxycarbonyl group, an alkoxycarbonyl group or a carbamoyl group.

In the present invention, among the compounds represented by formula (4) where Ch is S, preferred are the compounds where $W^2$ is an electron-withdrawing group, $W^2$ and $R^{12}$ are combined with each other to form a non-aromatic 5-, 6- or 7-membered cyclic structure, $R^{12}$ is an alkyl group, an alkenyl group or an aryl group, $R^{13}$ is a hydrogen atom, a halogen atom, an alkyl group, an aryl group, a cyano group, a carboxy group, a sulfo group, an alkyl- or aryl-sulfonyl group, an acyl group, an aryloxycarbonyl group, an alkoxycarbonyl group or a carbamoyl group, and $R^{14}$ is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or aryl-sulfonyl group, an acyl group, an aryloxycarbonyl group, an alkoxycarbonyl group or a carbamoyl group, more preferred are the compounds where $W^2$ and $R^{12}$ are combined with each other to form a non-aromatic 5- or 6-membered cyclic structure, $R^{12}$ is an alkyl group or an aryl group, $R^{13}$ is a hydrogen atom, a halogen atom, an alkyl group, an aryl group, a cyano group, a sulfo group, an alkyl- or aryl-sulfonyl group, an acyl group, an aryloxycarbonyl group or an alkoxycarbonyl group, and $R^{14}$ is a hydrogen atom, a halogen atom, an alkyl group, an aryl group, a cyano group, an acyloxy group, a sulfo group, an alkyl- or aryl sulfonyl group, an acyl group, an aryloxycarbonyl group or an alkoxycarbonyl group, and most preferred are the compounds where $W^2$ and $R^{12}$ are combined with each other to form a non-aromatic 6-membered cyclic structure, $R^{12}$ is an alkyl group or an aryl group, $R^{13}$ is a hydrogen atom, a halogen atom, an alkyl group or an aryl group, and $R^{14}$ is a hydrogen atom, a halogen atom, an alkyl group, an aryl group, a cyano group, an acyloxy group, a sulfo group, an alkyl- or aryl-sulfonyl group, an acyl group, an aryloxycarbonyl group or an alkoxycarbonyl group.

In the present invention, among the compounds represented by formula (4) where Ch is S, when $W^2$ and $R^{12}$ are not combined with each other to form a non-aromatic 5-, 6- or 7-membered cyclic structure, preferred are the compounds where $W^2$ is an electron-withdrawing group, at least one of $R^{13}$ and $R^{14}$ is an aryl group, $R^{12}$ and $R^{13}$ each is a hydrogen atom, a halogen atom, an alkyl group, an aryl group, a cyano group, a carboxy group, a sulfo group, an alkyl- or aryl-sulfonyl group, an acyl group, an aryloxycarbonyl group, an alkoxycarbonyl group or a carbamoyl group, and $R^{14}$ is a hydrogen atom, a halogen atom, an alkyl group, an aryl group, a cyano group, a carboxy group, an acyloxy group, a sulfo group, an alkyl- or aryl-sulfonyl group, an acyl group, an aryloxycarbonyl group, an alkoxycarbonyl group or a carbamoyl group, more preferred are the compounds where $W^2$ is an electron-withdrawing group, at least one of $R^{13}$ and $R^{14}$ is an aryl group, $R^{12}$ and $R^{13}$ each is a hydrogen atom, an alkyl group, an aryl group, an alkyl- or aryl-sulfonyl group, an acyl group, an aryloxycarbonyl group or an alkoxycarbonyl group, and $R^{14}$ is a hydrogen atom, a halogen atom, an alkyl group, an aryl group, a cyano group, a carboxy group, an acyloxy group, a sulfo group, an alkyl- or aryl-sulfonyl group, an acyl group, an aryloxycarbonyl group or an alkoxycarbonyl group, and most preferred are the compounds where $W^2$ is an electron-withdrawing group, at least one of $R^{13}$ and $R^{14}$ is an aryl group, $R^{12}$ and $R^{13}$ each is a hydrogen atom, an alkyl group or an aryl group, and $R^{14}$ is a hydrogen atom, a halogen atom, an alkyl group, an aryl group, a eyano group, a sulfo group, an alkyl- or aryl-sulfonyl group, an acyl group, an aryloxycarbonyl group or an alkoxycarbonyl group.

Among the compounds represented by formula (4) where Ch is S, when $W^2$ and $R^{12}$ are not combined to form a 5-, 6- or 7-membered cyclic structure and $R^{13}$ and $R^{14}$ both are not an aryl group, preferred are the compounds where the sum of Hammett's substituent constant $\sigma_p$ values of $W^2$ and $R^{12}$ to $R^{14}$ is 0.6 or more, $R^{12}$ and $R^{13}$ each is a hydrogen atom, a halogen atom, an alkyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group, $R^{14}$ is a hydrogen atom, a halogen atom, an alkyl group, an aryl group, a cyano group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or aryl-sulfonyl group, an acyl group, an aryloxycarbonyl group, an alkoxycarbonyl group or a carbamoyl group, and n is 0 or 1, more preferred are the compounds where the sum of Hammett's substituent constant $\sigma_p$ values of $W^2$ and $R^{12}$ to $R^{14}$ is 0.6 or more, $R^{12}$ and $R^{13}$ each is a hydrogen atom, an alkyl group, an aryl group, an alkyl- or aryl-sulfonyl group, an acyl group, an aryloxycarbonyl group or an alkoxycarbonyl group, $R^{14}$ is a hydrogen atom, a halogen atom, an alkyl group, an aryl group, a cyano group, a carboxy group, an acylamino group, a sulfo group, an alkyl- or aryl-sulfonyl group, an acyl group, an aryloxycarbonyl group or an alkoxycarbonyl group, and n is 0 or 1, and most preferred are the compounds where the sum of Hammett's substituent constant $\sigma_p$ values of $W^2$, $R^{12}$ and $R^{14}$ is 0.6 or more, $R^{12}$ and $R^{13}$ each is a hydrogen atom, an alkyl group or an aryl group, and $R^{14}$ is a hydrogen atom, a halogen atom, an alkyl group, an aryl group, a cyano group, an acylamino group, a sulfo group, an alkyl- or aryl-sulfonyl group, an acyl group, an aryloxycarbonyl group or an alkoxycarbonyl group.

In the present invention, when Ch is S, the compound represented by formula (4) is more preferably a compound where $W^2$ and $R^{12}$ are combined with each other to form a 5-, 6- or 7-membered cyclic structure or a compound where $W^2$ and $R^{12}$ are not combined with each other to form a 5-, 6- or 7-membered cyclic structure and at least one of $R^{13}$ and $R^{14}$ is an aryl group, and most preferably a compound where $W^2$ and $R^{12}$ are combined with each other to form a 5-, 6- or 7-membered cyclic structure.

Among the compounds represented by formulae (1) to (4), preferred in the present invention are the compounds represented by formulae (1), (2) and (4), more preferred are the compounds represented by formulae (1) and (4), and most preferred is the compound represented by formula (1).

In formulae (1) to (4) of the present invention, n represents 0 or 1. When n represents 1, L is preferably an anionic chalcogenide, more preferably a compound selected from the compounds represented by the following formulae (5), (6), (7) and (8):

(5)

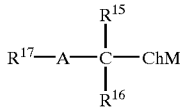

(6)

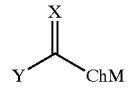

(7)

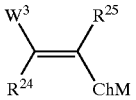

(8)

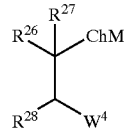

wherein Ch represents S, Se or Te, M represents a hydrogen atom or a counter cation for neutralizing the electric charge of the compound, A represents O, S or $NR^{18}$, $R^{15}$ to $R^{18}$ each represents a hydrogen atom or a substituent, $R^{17}$ may form a 5-, 6- or 7-membered ring together with $R^{15}$ or $R^{16}$, X represents O, S or $NR^{19}$, Y represents H, an alkyl group, an alkenyl group, an alkynyl group, an aryl group, a heterocyclic group, $OR^{20}$, $SR^{21}$ or $N(R^{22})R^{23}$, $R^{19}$ to $R^{23}$ each represents a hydrogen atom, an alkyl group, an alkenyl group, an alkynyl group, an aryl group or a heterocyclic group, X and Y may combine with each other to form a ring, $W^3$ represents an electron-withdrawing group, $R^{24}$ and $R^{25}$ each independently represents a hydrogen atom or a substituent, $W^4$ represents an electron-withdrawing group, $R^{26}$ to $R^{28}$ each represents a hydrogen atom or a substituent, and $W^4$ and $R^{26}$ may combine with each other to form a cyclic structure.

When L is a compound selected from the compounds represented by formulae (5) to (8), the compound represented by formula (1), (2), (3) or (4) may be a symmetric complex or an asymmetric complex with respect to gold(I). In the present invention, both are preferred but a symmetric complex with respect to gold(I) is more preferred.

In formulae (5) to (8), Ch represents S, Se or Te. In the present invention, Ch is preferably S or Se, more preferably S.

In formulae (5) to (8), M represents a hydrogen atom or a counter cation for neutralizing the electric charge of the compound. When M represents a counter cation, M specifically represents an inorganic cation such as alkali metal (e.g., Li, Na, K, Rb, Cs) or alkaline earth metal (e.g., Mg, Ca, Ba), or an organic cation (e.g., substituted or unsubstituted ammonium ion, phosphonium ion) . However, in the present invention, when M is an inorganic cation, M does not represent $Ag^+$ ion or $Au^-$ ion. In the present invention, M is preferably a hydrogen atom, an alkali metal cation, an alkaline earth metal cation or a substituted or unsubstituted ammonium ion, more preferably an alkali metal cation or a substituted or unsubstituted ammonium ion, still more preferably an alkali metal cation or a substituted or unsubstituted ammonium ion.

In formula (5), A represents O, S or $NR^{18}$, preferably O or S, more preferably O.

In formula (5), $R^{15}$ to $R^{18}$ represents a hydrogen atom or a substituent. More specifically, $R^{15}$, $R^{16}$, $R^{17}$ and $R^{18}$ have the same meanings as $R^1$, $R^2$, $R^3$ and $R^4$ in formula (1), respectively, and preferred ranges are also the same.

In the present invention, among the compounds represented by formula (5) , preferred are the compounds where Ch is S or Se, A is O, S or $NR^{18}$, $R^{15}$ and $R^{16}$ each is a hydrogen atom, an alkyl group, an aryl group, a heterocyclic group, an alkoxy group, an aryloxy group, a heterocyclic oxy group, an alkylthio group, an arylthio group or a heterocyclic thio group, $R^{17}$ is an alkyl group, an aryl group or a heterocyclic group, and $R^1$ is a hydrogen atom, an alkyl group, an aryl group, a heterocyclic group, an amino group, an acylamino group, an alkyl- or arylsulfonylamino group, an alkyl- or aryl-sulfonyl group, or an acyl group, more preferred are the compounds where Ch is S or Se, A is O or S, $R^{15}$ and $R^{16}$ each is a hydrogen atom, an alkyl group, an aryl group or a heterocyclic group, and $R^{17}$ is an alkyl group, an aryl group or a heterocyclic group, still more preferred are the compounds where Ch is S, A is O or S, $R^{15}$ and $R^{16}$ each is a hydrogen atom, an alkyl group or an aryl group, and $R^{17}$ is an alkyl group or an aryl group. Particularly preferred is the case where the cyclic structure formed by $R^{17}$ together with $R^{15}$ or $R^{16}$ is a sugar derivative (when A in formula (5) is O) such as glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine or glucuronic acid, or a sulfur analogue thereof (when A in formula (5) is S). The sugar derivative as used herein means a compound such that the hydroxyl, amino or carboxy group in the sugar structure is substituted by an alkoxy group (including a group repeatedly containing an ethylene oxy group or propylene oxy group unit), an aryloxy group, a heterocyclic oxy group, an acyloxy group, an alkoxycarbonyloxy group, an aryloxycarbonyloxy group, a carbamoyloxy group, a sulfonyloxy group, a silyloxy group, an alkyl-, aryl- or heterocyclic-amino group, an acylamino group, a sulfonamido group, a ureido group, a thioureido group, an N-hydroxyureido group, an alkoxycarbonylamino group, an aryloxycarbonylamino group, a sulfamoylamino group, a semicarbazide group, a thiosemicarbazide group, an oxamoylamino group, an N-alkyl- or aryl-sulfonylureido group, an N-acylureido group, an N-acylsulfamoylamino group, a hydroxyamino group, an acyl group, an alkoxycarbonyl group, an aryloxycarbonyl group, a heterocyclic oxy carbonyl group, a carbamoyl group, an N-hydroxycarbamoyl group, an N-acylcarbamoyl group, an N-sulfonylcarbamoyl group, an N-carbamoylcarbamoyl group or an N-sulfamoylcarbamoyl group. This sugar structure has a isomer and β isomer different in the steric structure at the 1-position, and D form and L form in the enantiomeric relation but these isomers are not differentiated in the present invention. Preferred examples of the compound for L include thioglucose, thiomannose, thiogalactose, thiolyxose, thioxylose, thioarabinose, selenoglucose, selenomannose, selenogalactose, selenolyxose, selenoxylose, selenoarabinose, telluroglucose, and salts, sulfur analogues and derivatives thereof.

In formula (6), X represents O, S or $NR^{19}$, preferably O or S, more preferably O.

In formula (6), Y represents H, an alkyl group, an alkenyl group, an alkynyl group, an aryl group, a heterocyclic group, $OR^{20}$, $SR^{21}$ or $N(R^{22})R^{23}$, preferably H, an alkyl group, an aryl group, a heterocyclic group, $OR^{20}$, $SR^{21}$ or $N(R^{22})R^{23}$, more preferably H, an alkyl group, an aryl group, a heterocyclic group or $N(R^{22})R^{23}$, still more preferably an alkyl group, an aryl group or a heterocyclic group.

In formula (6), $R^{19}$ to $R^{23}$ each represents a hydrogen atom, an alkyl group, an alkenyl group, an alkynyl group, an aryl group or a heterocyclic group. More specifically, $R^{19}$, $R^{20}$, $R^{21}$, $R^{22}$ and $R^{23}$ have the same meanings as $R^5$, $R^6$, $R^7$, $R^8$ and $R^9$ in formula (2), respectively, and preferred ranges are also the same.

Among the compounds represented by formula (6), preferred are the compounds where Ch is S or Se, X is O or S, Y is H, an alkyl group, an aryl group, a heterocyclic group, $OR^{20}$, $SR^{21}$ or $N(R^{22})R^{23}$, $R^{20}$ to $R^{23}$ each is an alkyl group, an aryl group or a heterocyclic group, more preferred are the compounds where Ch is S or Se, X is O, and Y is an alkyl group, an aryl group or a heterocyclic group, and most preferred are the compounds where Ch is S, X is O and Y is an alkyl group, an aryl group or a heterocyclic group.

In formula (7), $W^3$ represents an electron-withdrawing group. More specifically, $W^3$ has the same meaning as $W^2$ in formula (3) and the preferred range is also the same.

In formula (7), $R^{24}$ and $R^{25}$ each represents a hydrogen atom or a substituent. More specifically, $R^{24}$ and $R^{25}$ have the same meanings as $R^{10}$ and $R^{11}$ in formula (3), respectively, and preferred ranges are also the same.

In the present invention, among the compounds represented by formula (7), preferred are the compounds where Ch is S or Se, $W^3$ and $R^{24}$ each is an electron-withdrawing group, and $R^{25}$ is a hydrogen atom, an alkyl group, an aryl group, a heterocyclic group, an alkoxy group, an aryloxy group, a heterocyclic oxy group, an amino group or an acylamino group, more preferred are the compounds where Ch is Se, $W^3$ and $R^{24}$ each is an electron-withdrawing group, and $R^{25}$ is a hydrogen atom, an alkyl group, an aryl group or a heterocyclic group, and most preferred are the compound where Ch is a selenium atom, $W^3$ and $R^{24}$ each is an electron-withdrawing group, and $R^{25}$ is a hydrogen atom, an alkyl group, an aryl group or a heterocyclic group.

Also, among the compounds represented by formula (7), preferred in the present invention are the compounds where $W^3$ and $R^{24}$ form a non-aromatic 5-, 6- or 7-membered cyclic structure and $R^{25}$ is a hydrogen atom, an alkyl group, an aryl group, a heterocyclic group, an alkoxy group, an aryloxy group, a heterocyclic oxy group, an amino group or an acylamino group, more preferred are the compounds where $W^3$ and $R^{24}$ form a non-aromatic 5-, 6- or 7-membered cyclic structure and $R^{25}$ is a hydrogen atom, an alkyl group, an aryl group or a heterocyclic group, and most preferred are the compounds where $W^3$ and $R^{24}$ form a non-aromatic 5-, 6- or 7-membered cyclic structure and $R^{25}$ is a hydrogen atom, an alkyl group, an aryl group or a heterocyclic group.

In formula (8), $W^4$ represents an electron-withdrawing group. More specifically, $W^4$ has the same meaning as $W^2$ in formula (4) and the preferred range is also the same.

In formula (8), $R^{26}$ to $R^{28}$ each represents a hydrogen atom or a substituent. More specifically, $R^{26}$, $R^{27}$ and $R^{28}$ have the same meanings as $R_{12}$, $R^{13}$ and $R^{14}$ in formula (4), respectively, and preferred ranges are also the same.

Among the compounds represented by formula (8), preferred are the compounds where Ch is S or Se, $W^4$ is an electron-withdrawing group, and $R^{26}$ and $R^{27}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or aryl-sulfonyl group, an acyl group, an aryloxycarbonyl group, an alkoxycarbonyl group or a carbamoyl group, more preferred are the compounds where Ch is S or Se, $W^4$ is an electron-withdrawing group, and $R^{26}$ and $R^{27}$ each is a hydrogen atom, a halogen atom, an alkyl group, an alkenyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or aryl-sulfonyl group, an acyl group, an aryloxycarbonyl group, an alkoxycarbonyl group or a carbamoyl group, and most preferred are the compounds where Ch is S or Se, $W^4$ is an electron-withdrawing group, and $R^{26}$ to $R^{28}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or aryl-sulfonyl group, an acyl group, an aryloxycarbonyl group, an alkoxycarbonyl group or a carbamoyl group.

Also, among the compounds represented by formula (8), preferred are the compounds where $W^4$ and $R^{26}$ combine with each other to form a non-aromatic 5-, 6- or 7-membered ring, Ch is S or Se, $R^{26}$ is an alkyl group, an alkenyl group, an aryl group or a heterocyclic group, and $R^{27}$ and $R^{28}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or arylsulfonyl group, an acyl group, an aryloxycarbonyl group, an alkoxycarbonyl group or a carbamoyl group, more preferred are the compounds where Ch is S or Se, $W^4$ and $R^{26}$ combine with each other to form a non-aromatic 5-, 6- or 7-membered ring, and $R^{27}$ and $R^{28}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or arylsulfonyl group, an acyl group, an aryloxycarbonyl group, an alkoxycarbonyl group or a carbamoyl group, and most preferred are the compounds where Ch is S, $W^4$ and $R^{26}$ combine with each other to form a non-aromatic 5-, 6- or 7-membered ring, and $R^{27}$ and $R^{28}$ each is a hydrogen atom, a halogen atom, an alkyl group, an alkenyl group, an alkynyl group, an aryl group, a heterocyclic group, a cyano group, a hydroxyl group, a carboxy group, an alkoxy group, an aryloxy group, a heterocyclic oxy group, an acyloxy group, an amino group, an acylamino group, an alkylthio group, an arylthio group, a heterocyclic thio group, a sulfo group, an alkyl- or arylsulfonyl group, an acyl group, an aryloxycarbonyl group, an alkoxycarbonyl group or a carbamoyl group.

Among the compounds represented by formula (5) to (8), preferred as L are the compounds represented by formulae (5), (6) and (8), more preferred are the compounds represented by formulae (5) and (8), and most preferred is the compound represented by formula (5).

The compound for use in the present invention is more preferably the compound represented by formula (1) or (3), and most preferably the compound represented by formula (1), because in addition to the properties shown in Examples, excellent latent image stability can be attained.

Specific examples of the compound capable of releasing a gold-chalcogen anion species for use in the present invention are set forth below, however, the present invention is not limited thereto. As for the compounds which may have a plurality of geometrical or steric isomers, the steric structure thereof is not limited.

1-1

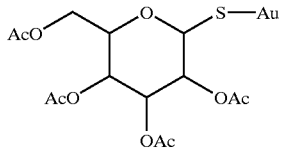

1-3

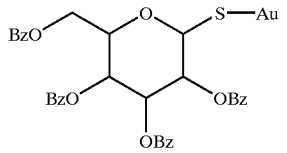

1-4

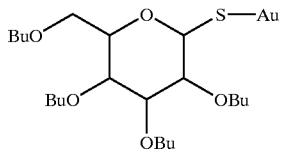

-continued
1-5
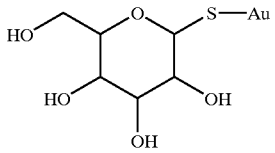
1-7
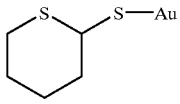
1-9
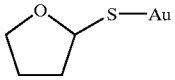
1-10
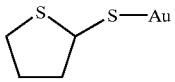
1-11
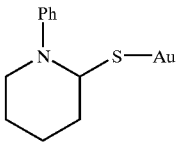
1-12
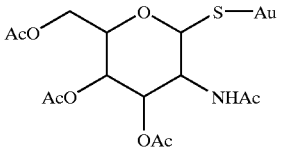
1-14
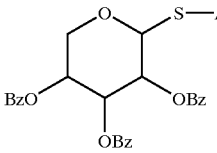
1-15
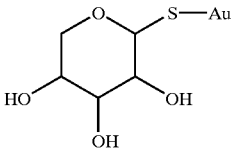
1-16
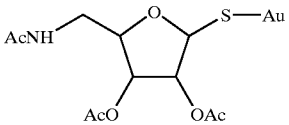
1-17
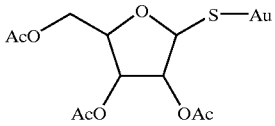
1-18
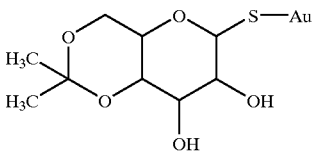
-continued
1-19
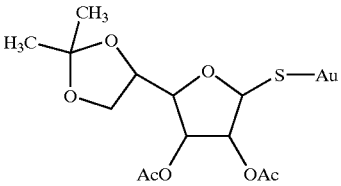
1-20
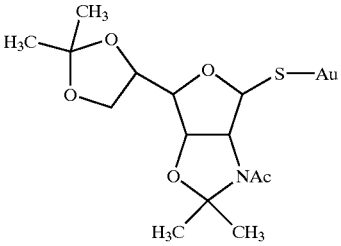
1-21
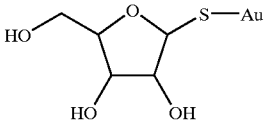
1-22
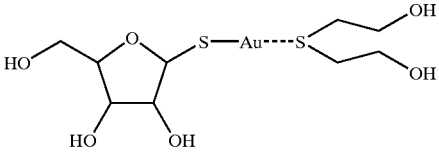
1-23
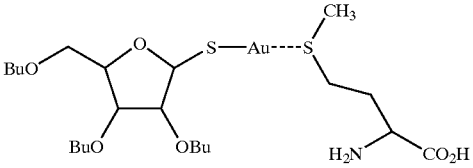
1-24
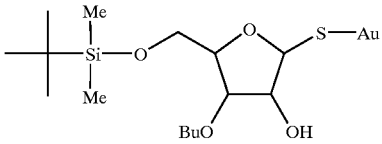
1-25
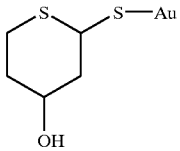
1-26
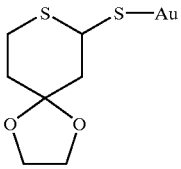
1-27
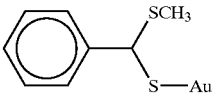
1-28
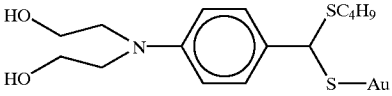

-continued
1-29
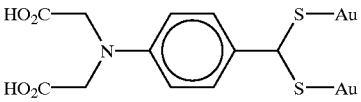
1-30
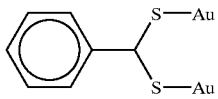
1-31
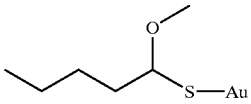
1-32
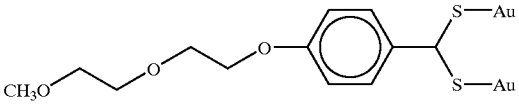
1-33
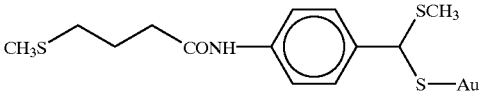
1-34
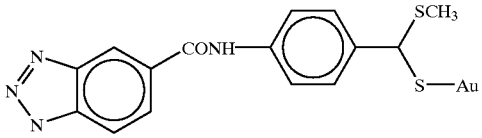
1-35
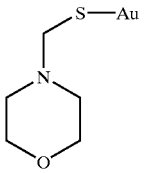
1-36
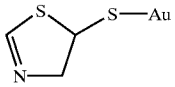
1-37
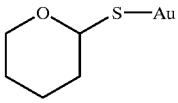
1-40
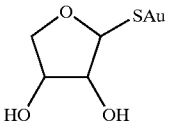
1-41
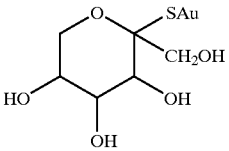
1-42
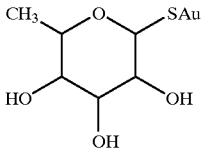
-continued
1-43
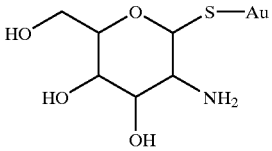
1-44
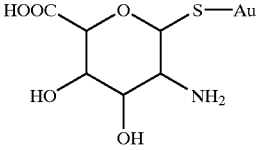
1-45
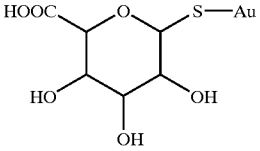
1-46
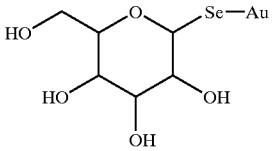
1-48
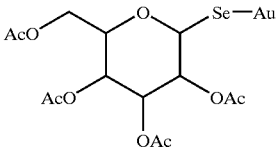
1-50
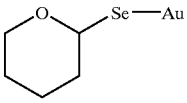
1-51
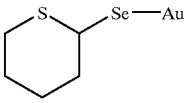
1-53
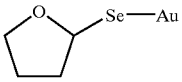
1-54
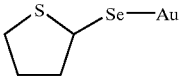
1-55
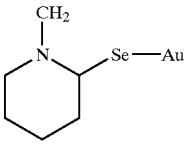
1-56
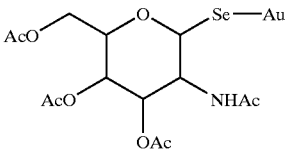

-continued
1-58
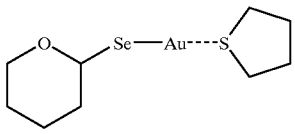
1-59
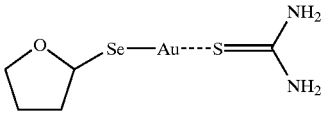
1-60
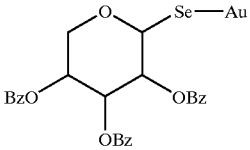
1-61
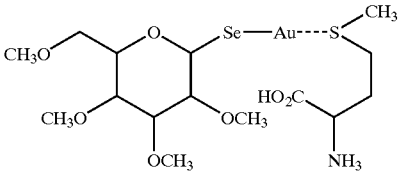
1-62
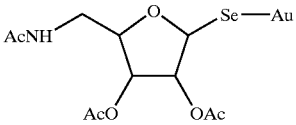
1-63
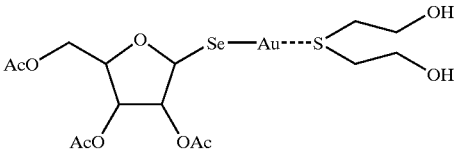
1-64
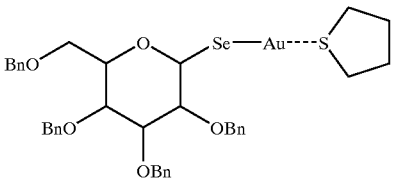
1-65
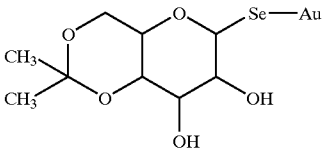
1-66
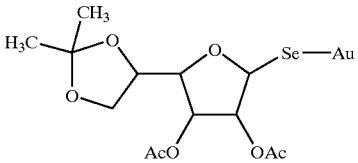
-continued
1-67
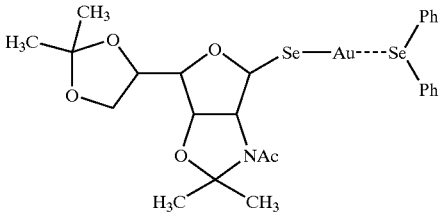
1-68
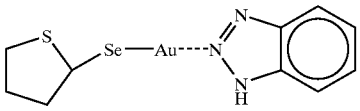
1-70
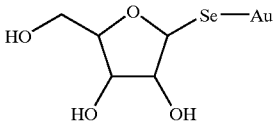
1-71
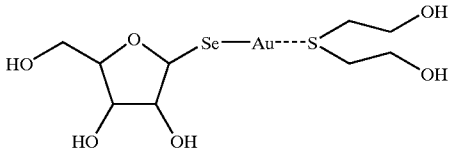
1-72
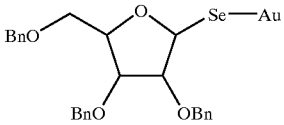
1-73
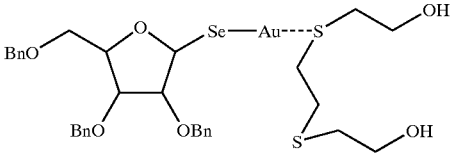
1-74
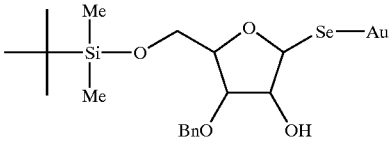
1-76
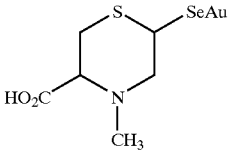
1-77
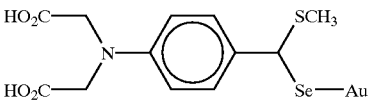
1-78
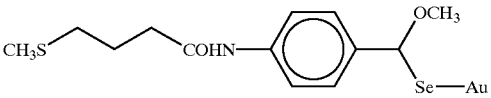
1-79
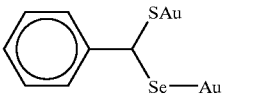

-continued
1-80
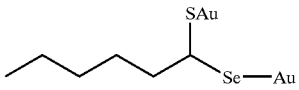
1-81
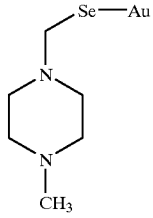
1-82
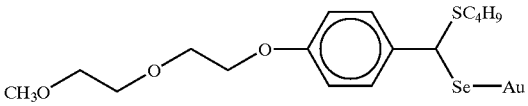
1-84
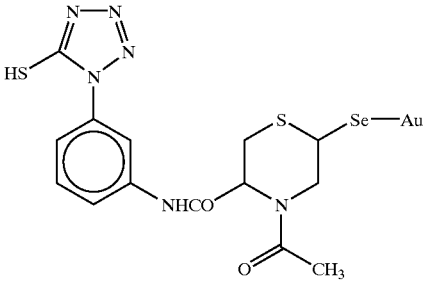
1-85
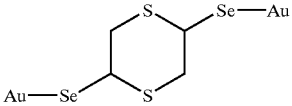
1-86
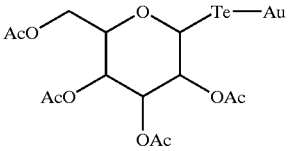
1-88
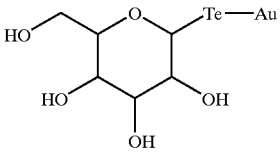
1-89
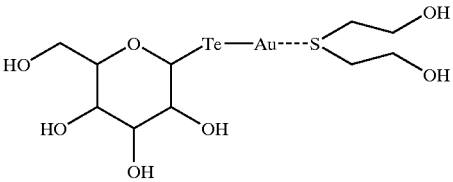
1-90
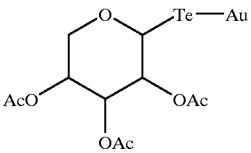
-continued
1-91
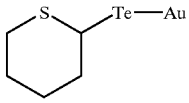
1-92
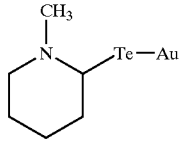
1-93
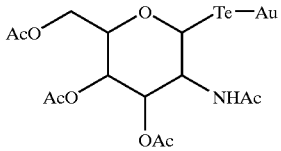
1-94
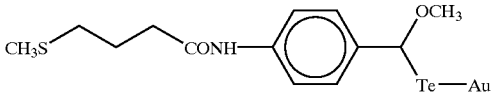
1-95
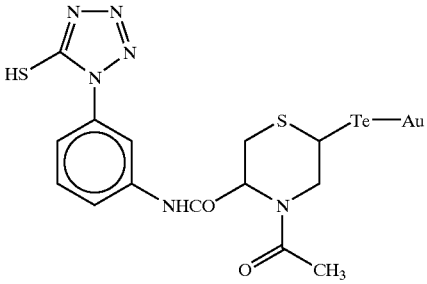
1-96
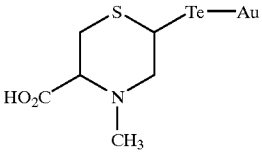
1-97
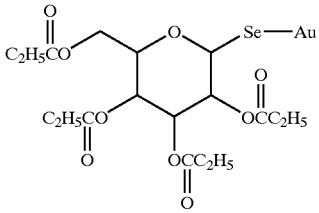
1-98
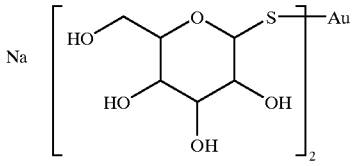
1-99
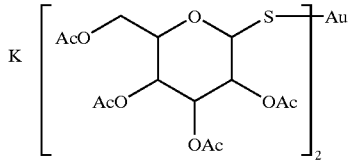

-continued
1-100
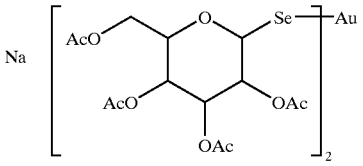
1-101
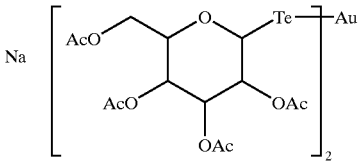
1-102
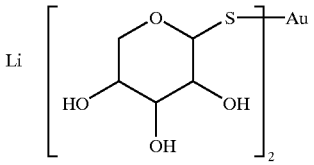
1-103
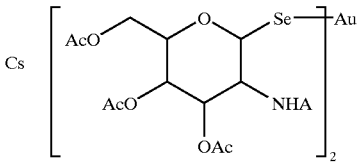
1-104
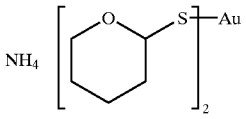
1-105
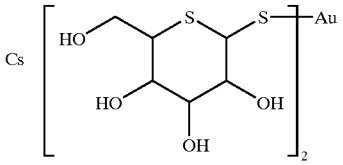
1-106
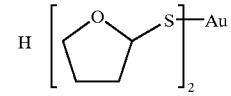
1-107
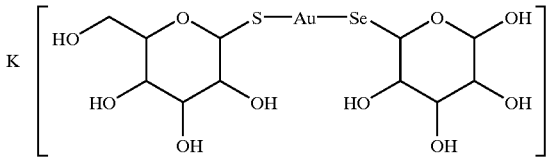
1-108
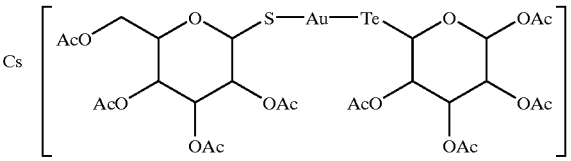
-continued
1-109
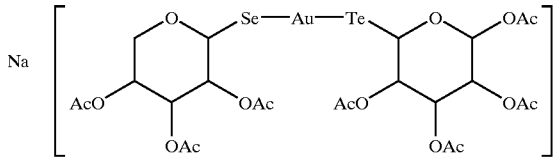
1-110
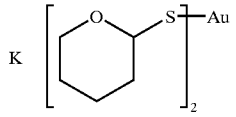
1-111
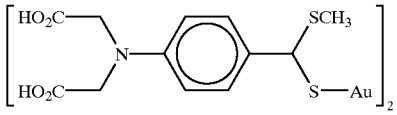
1-112
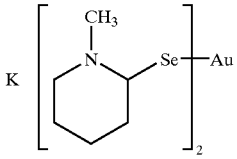
1-113
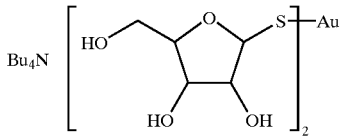
2-1
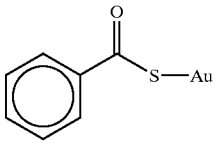
2-3
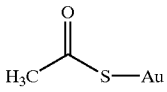
2-5
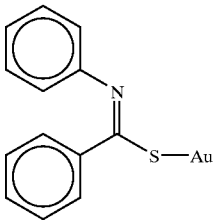
2-6
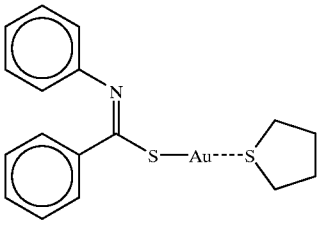

-continued
2-7
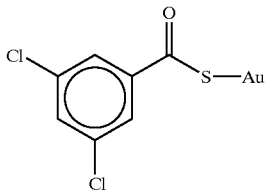
2-8
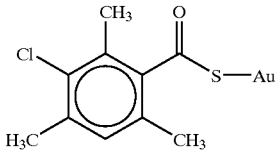
2-9
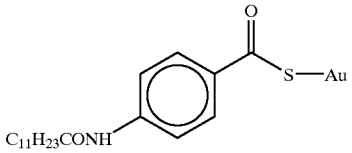
2-10
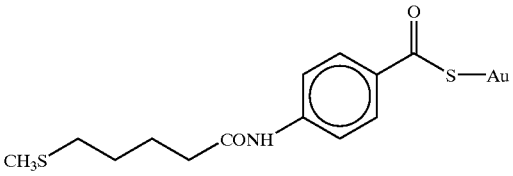
2-11
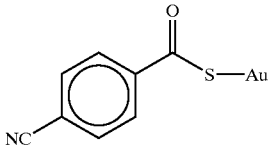
2-12
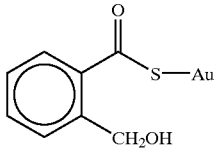
2-13
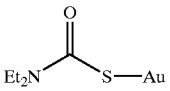
2-15
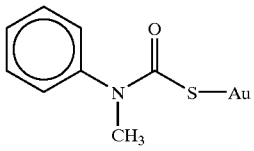
2-16
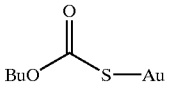
2-17
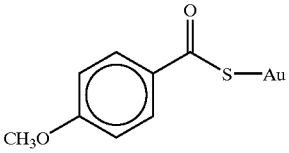
-continued
2-18
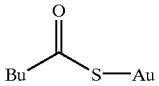
2-19
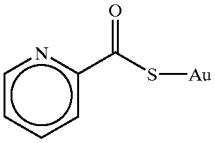
2-20
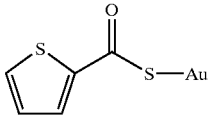
2-21
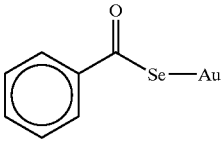
2-23
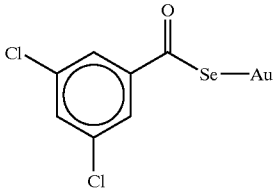
2-24
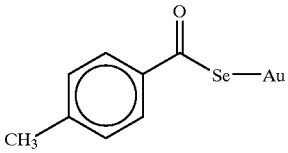
2-25
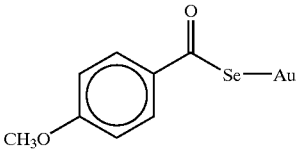
2-26
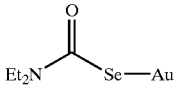
2-27
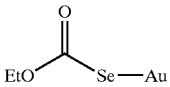
2-28
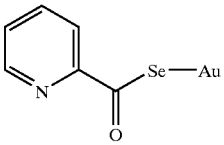
2-29
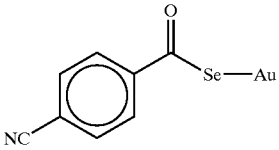

-continued
2-30
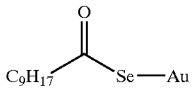
2-31
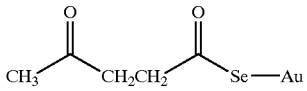
2-32
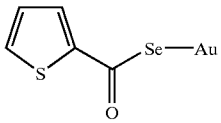
2-34
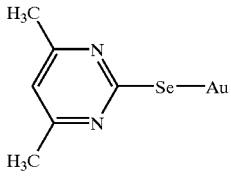
2-40
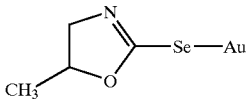
2-41
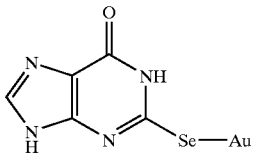
2-42
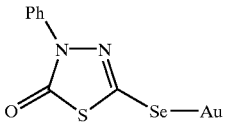
2-43
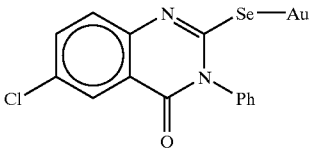
2-44
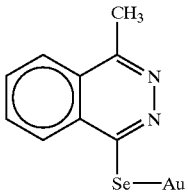
2-45
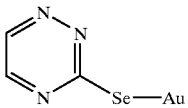
2-46
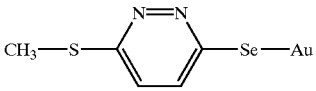
-continued
2-47
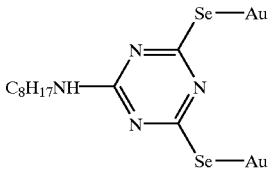
2-49
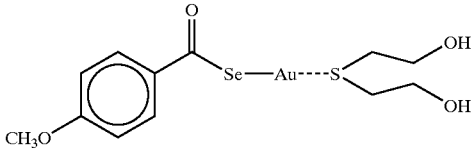
2-50
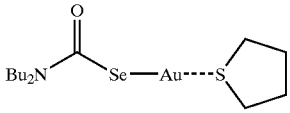
2-52
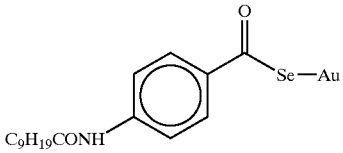
2-54
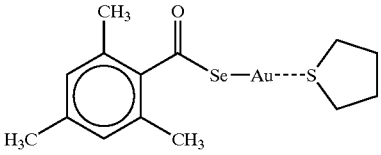
2-55
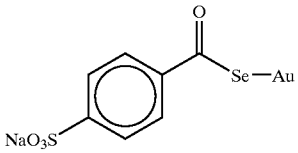
2-56
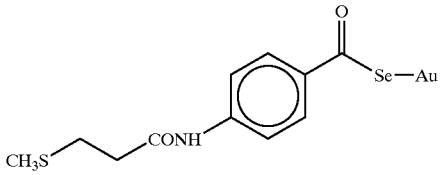
2-59
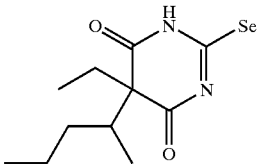
2-61
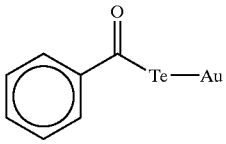

-continued
2-62
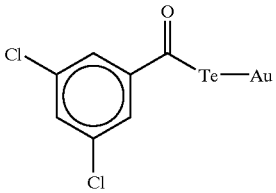
2-63
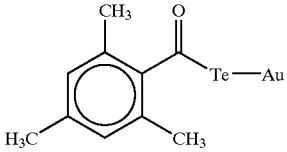
2-64
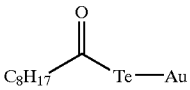
2-65
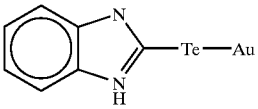
2-67
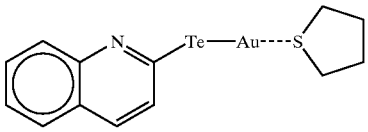
2-70
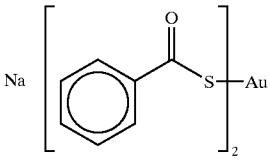
2-71
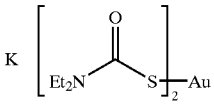
2-72
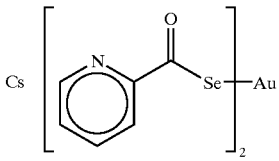
2-73
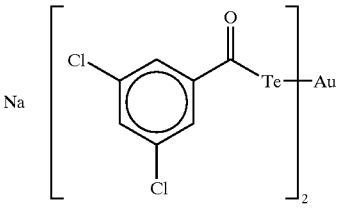
2-74
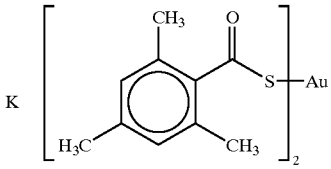
-continued
2-75
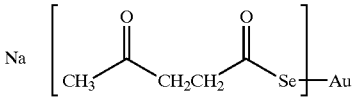
2-76
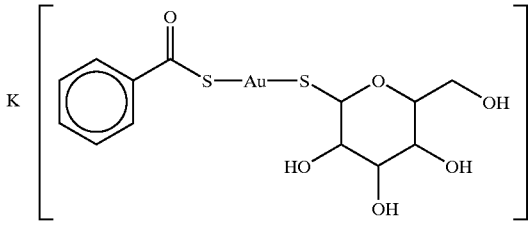
2-77
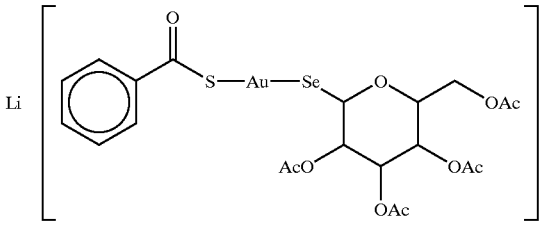
2-78
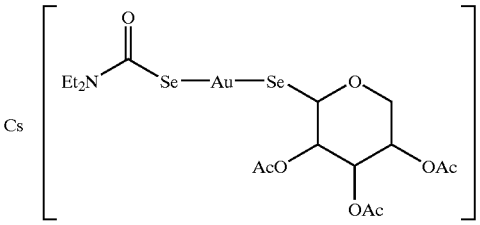
2-79
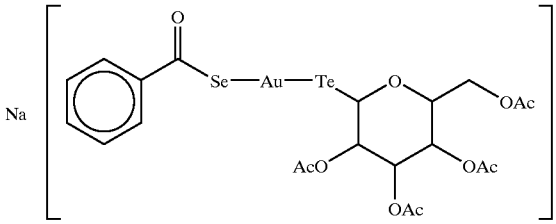
3-1
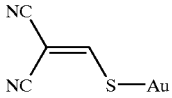
3-2
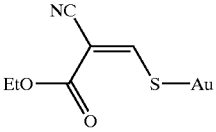
3-3
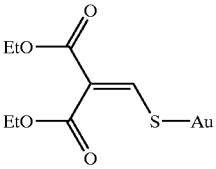

-continued
3-4
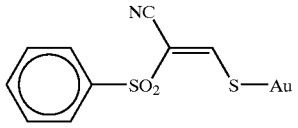
3-5
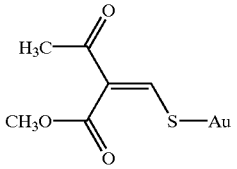
3-6
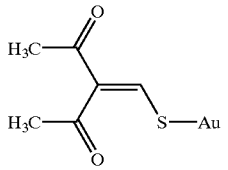
3-7
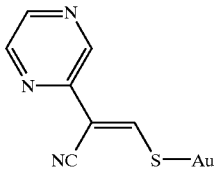
3-8
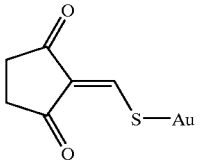
3-9
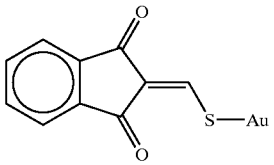
3-10
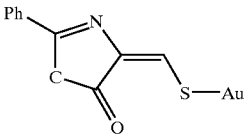
3-11
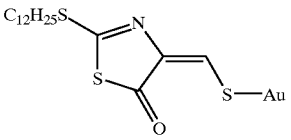
3-12
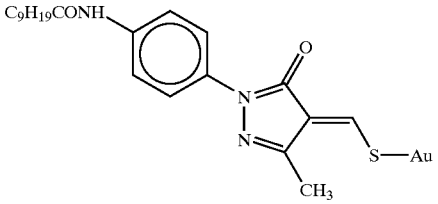
-continued
3-13
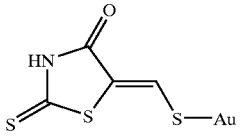
3-14
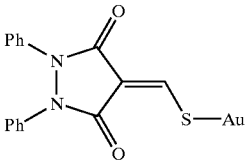
3-15
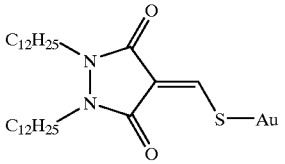
3-16
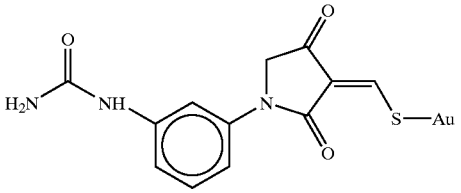
3-17
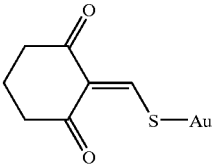
3-18
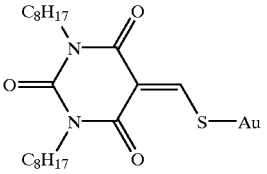
3-19
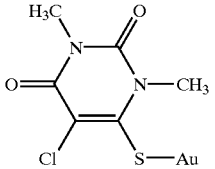
3-21
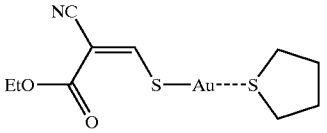
3-22
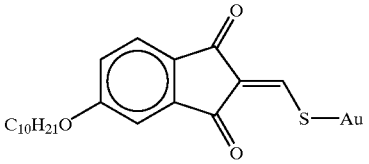

-continued
3-23
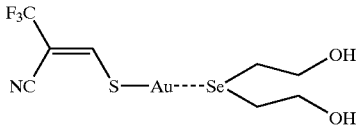
3-24
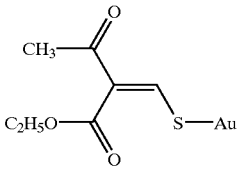
3-27
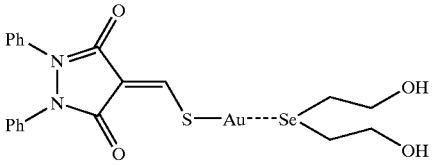
3-28
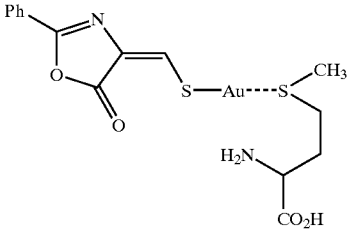
3-29
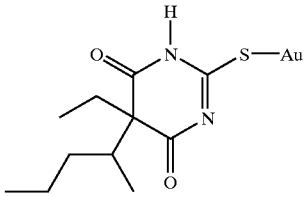
3-30
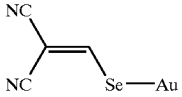
3-31
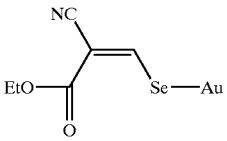
3-32
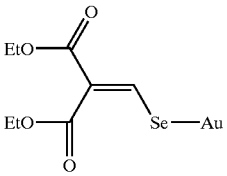
3-33
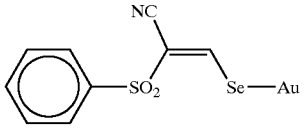
-continued
3-34
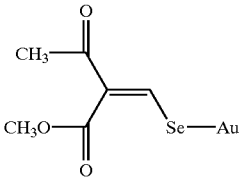
3-35
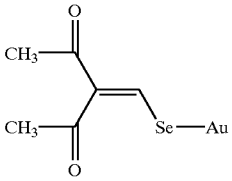
3-36
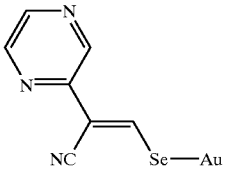
3-37
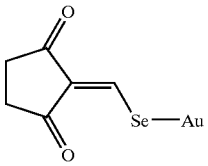
3-38
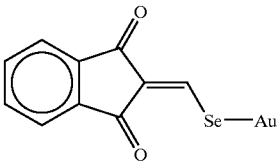
3-39
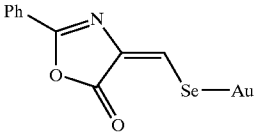
3-40
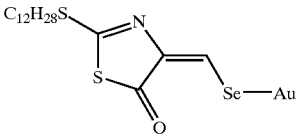
3-41
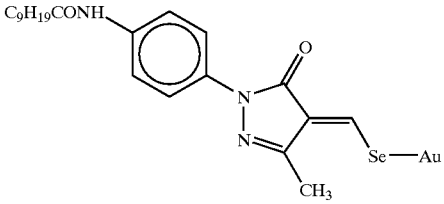
3-42
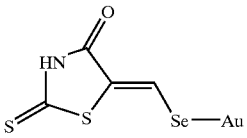

-continued
3-43
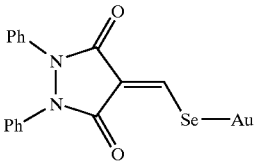
3-44
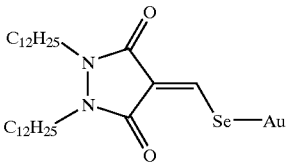
3-45
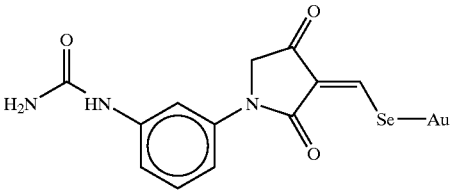
3-46
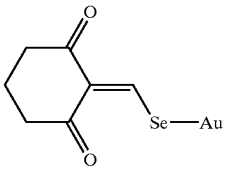
3-47
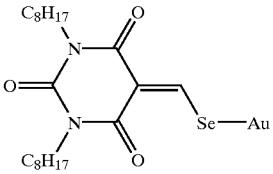
3-48
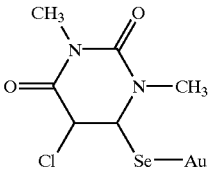
3-50
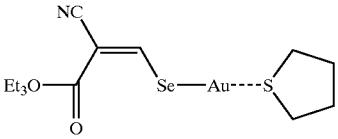
3-51
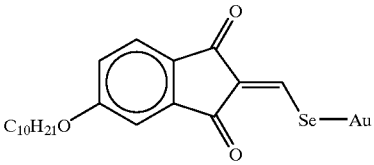
3-52
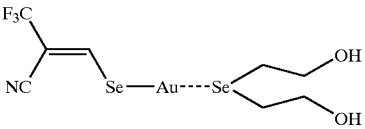
-continued
3-53
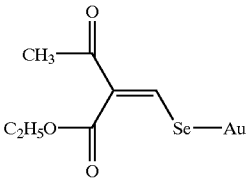
3-56
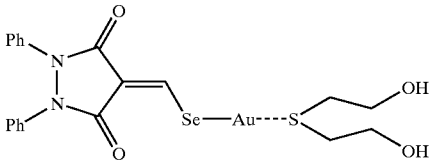
3-57
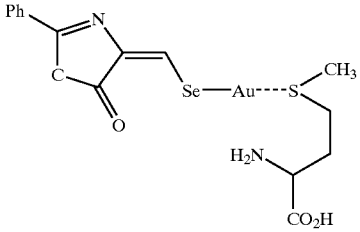
3-59
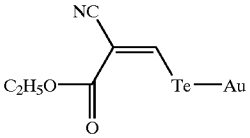
3-61
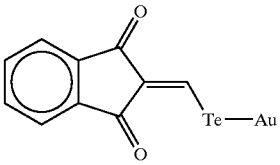
3-62
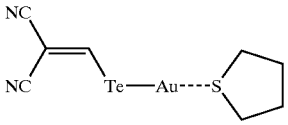
3-63
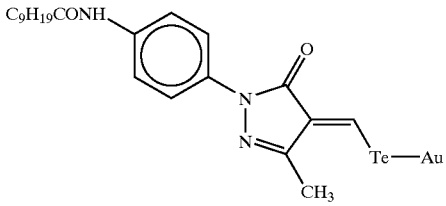
3-64
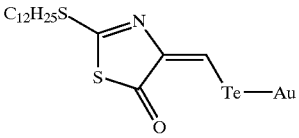
3-65
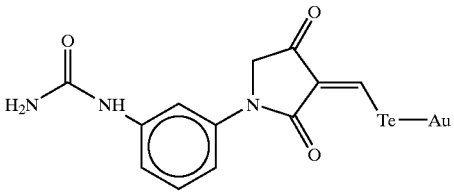

-continued
3-66
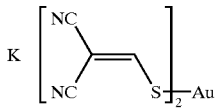
3-67
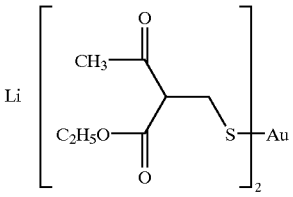
3-68
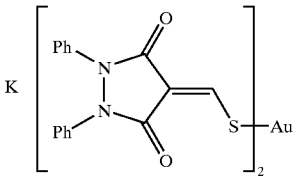
3-69
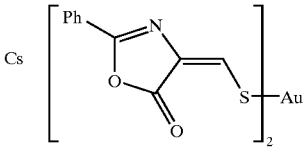
3-70
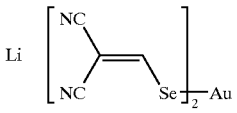
3-71
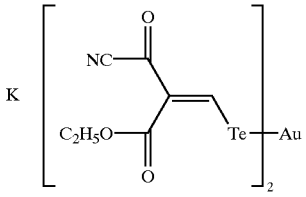
3-72
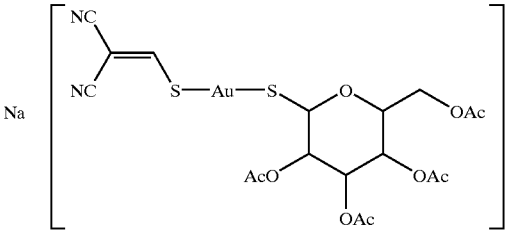
3-73
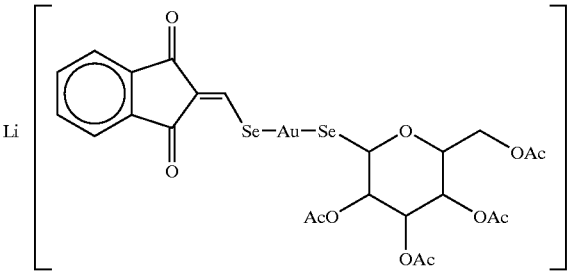
-continued
3-74
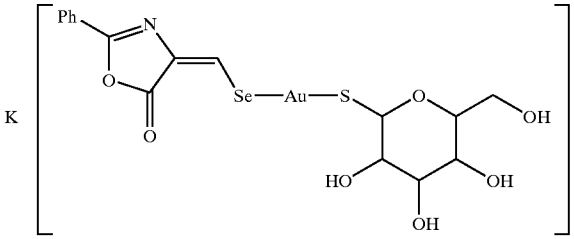
4-1
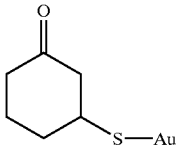
4-3
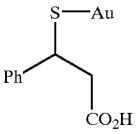
4-4
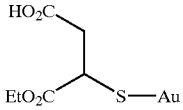
4-5
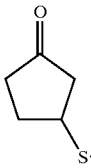
4-6
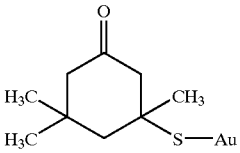
4-8
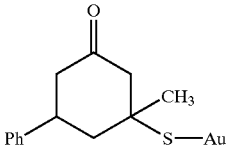
4-10
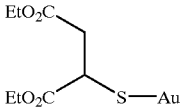
4-11
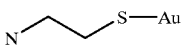
4-12
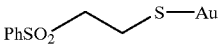
4-14
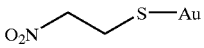
4-15
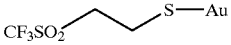

-continued
4-18
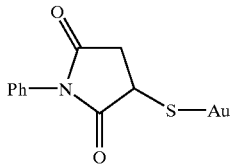
4-21
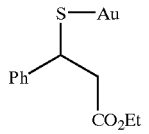
4-22
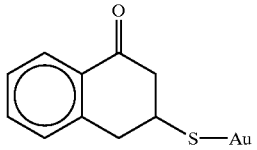
4-23
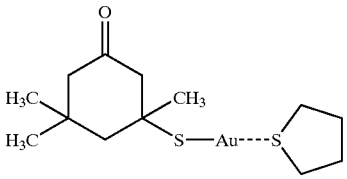
4-27
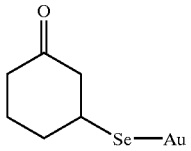
4-28
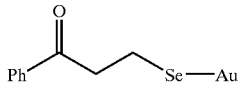
4-29
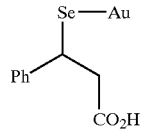
4-30
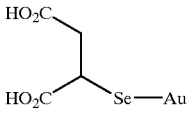
4-31
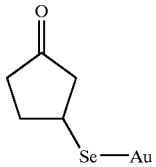
4-32
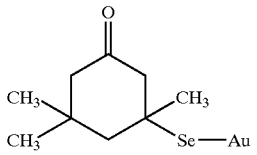
-continued
4-34
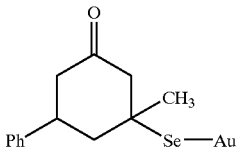
4-36
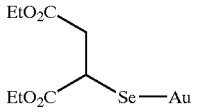
4-37
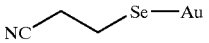
4-38
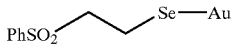
4-39
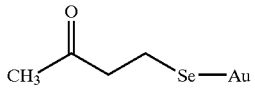
4-40
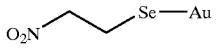
4-41
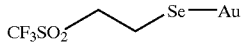
4-42
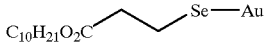
4-43
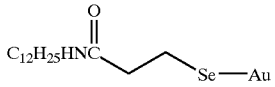
4-44
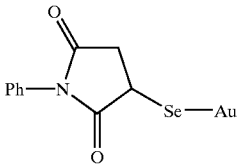
4-47
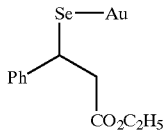
4-48
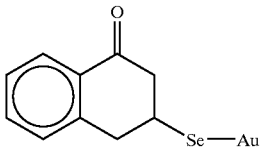
4-49
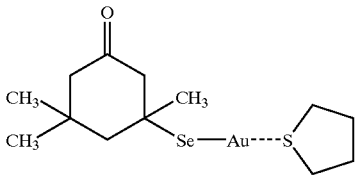

-continued 4-51

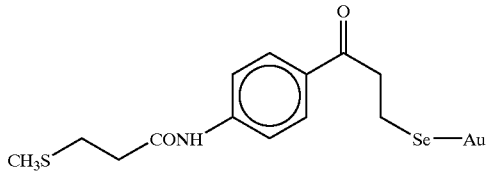

4-54

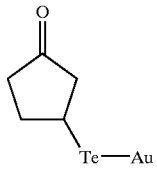

4-55

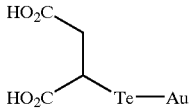

4-56

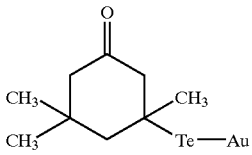

4-58

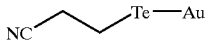

4-59

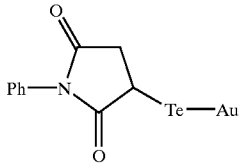

4-60

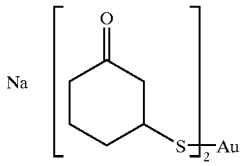

4-61

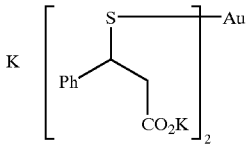

4-62

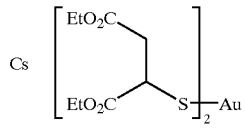

4-63

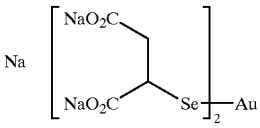

-continued 4-64

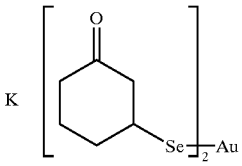

4-65

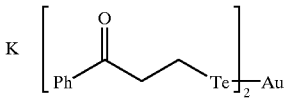

4-66

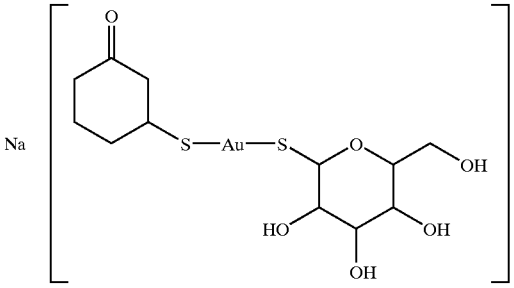

4-67

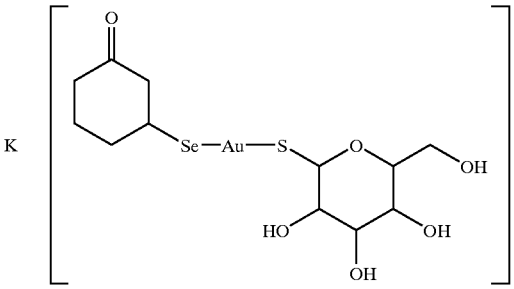

4-68

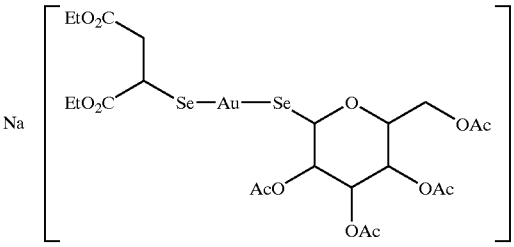

4-69

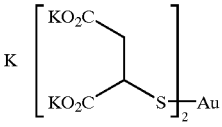

In these chemical formulae, Bn indicates benzyl.

The compounds represented by formulae (1) to (4) for use in the present invention can be synthesized by various known methods. For example, Compound 1-5(a) (gold(I) (D)-α-thioglucose) can be synthesized according to an ordinary method of synthesizing 1-thio-α-D-glucose and synthesizing an Au(I) salt of mercapto compound from a mercapto compound by referring to *Organic Letter*, Vol. 3, No. 3, page 405 (2001) and *Carbohydrate Research*, Vol. 200, page 497 (1990). An optimal synthesis method is selected according to individual compounds and a general synthesis method cannot be specified, but some particularly useful synthesis routes are described below.

Synthesis of Compound 2-1

To 0.3 g of thiobenzoic acid, 10 ml of chloroform and 0.3 ml of triethylamine were added. Thereto, a solution obtained by dissolving 1.1 g of triphenylphosphine chloroaurate complex in 10 ml of chloroform was added. The resulting solution was stirred at room temperature for 30 minutes, concentrated under reduced pressure and recrystallized from methanol to obtain 1 g of Compound 2-1.

Synthesis of Compound 4-1

Compound 4-1 was synthesized according to Scheme 1.

Scheme 1:

(Snythesis of Intermediate 1 )

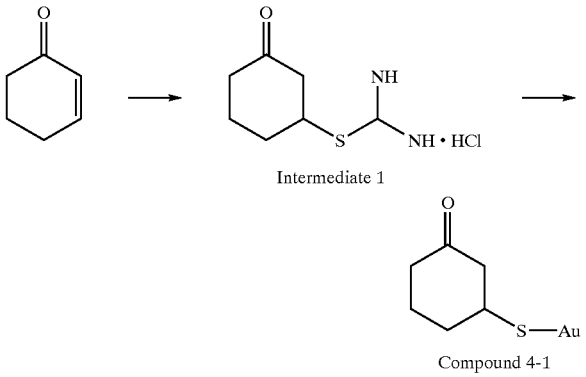

To 0.5 g of thiourea, 6 ml of 2 mol/liter hydro-chloric acid was added. After cooling with ice, 0.5 g of 2-cyclohexen-1-one was added and the resulting mixture was stirred at room temperature for 1 hour. Thereto, 6 ml of concentrated hydrochloric acid was added and the crystals precipitated were collected by filtration to obtain 0.8 g of Intermediate 1.

Synthesis of Compound 4-1

To 0.5 of Intermediate 1,3 ml of water was added. After cooling with ice, a solution obtained by dissolving 0.1 g of potassium carbonate in 2 ml of water was added dropwise and then 0.3 g of tetrahydrothiophene chloroaurate complex was added. The resulting mixture was stirred at room temperature for 1 hour. Thereto, 4 ml of water was added and the crystals precipitated were collected by filtration to obtain 0.4 g of Compound 4-1.

Synthesis of Compound 1-1

In 5 ml of methylene chloride, 0.5 g of 1-thio-β-D-glucose tetraacetate was dissolved. Thereto, a 10 ml methylene chloride solution containing 0.4 g of tetrahydrothiophene chloroaurate complex was added. The resulting solution was stirred at room temperature for 30 minutes and concentrated under reduced pressure to about ⅓ as a total amount. Then, 20 ml of ethanol was added thereto and the crystals precipitated were collected by filtration to obtain 0.4 g of Compound 1-1.

Synthesis of Compound 1-5 (Thiomannose Gold

To a methanol 30 ml solution containing 1.5 g of 2-S-(2,3,4,6-tetra-O-acetyl-α-D-mannopyranosyl)-2-thiopseudourea hydrogen bromide salt prepared according to a known method (see, *Carbohydrate Research*, 81, 261–274 (1980)), 2.5 ml of sodium methoxide (a 28% methanol solution) was added. The resulting solution was stirred at room temperature for 12 hours and 5 ml of water was added to 370 mg of the precipitate produced. Thereto, an ethanol 18 ml solution containing 472 mg of sodium chloroaurate and 436 mg of thiodiethanol was added dropwise. The resulting solution was stirred for 30 minutes and the precipitate produced was collected by filtration to obtain 470 ml of α-thiomannose gold(I) salt (Compound 1-5).

Synthesis of Compound 1-7

Compound 1-7 was synthesized according to Scheme 2.

Scheme 2:

(Snythesis of Intermediate 2)

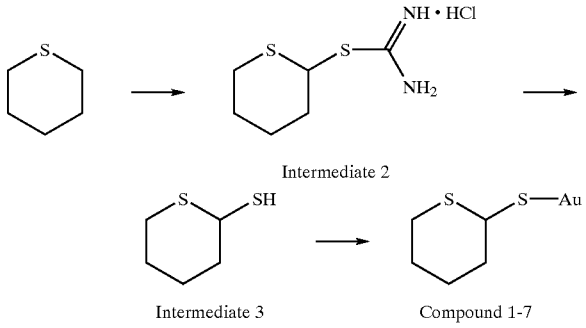

A carton tetrachloride 100 ml solution containing 4.1 g of pentamethylenesulfide was cooled on ice and thereto, 5.6 g of N-chlorosuccinimide was added. The resulting mixture was stirred for 2 hours under ice cooling. The insoluble matter was separated by filtration, and an acetone 75 ml solution containing 3.2 g of thiourea was added to the filtrate. The resulting solution was stirred at room temperature for 1 hour and the solid precipitated was collected by filtration to obtain 7 g of Intermediate 2.

Synthesis of Intermediate 3

In 80 ml of water, 4 g of sodium hydroxide and 7 g of Intermediate 2 were dissolved while cooling on ice and then stirred for 2 hours. Thereto, 50 ml of 2 mol/liter hydrochloric acid was added while cooling on ice and then 100 ml of methylene chloride was added, followed by extraction. The organic layer was washed with a saturated aqueous sodium hydrogen carbonate solution, dried over sodium sulfate and concentrated under reduced pressure. The concentrate was purified by silica gel column chromatography to obtain 4 g of Intermediate 3.

Synthesis of Compound 1-7

In 10 ml of chloroform, 0.2 g of Intermediate 3 was dissolved. Thereto, 0.2 ml of triethylamine was added and then a solution obtained by dissolving 491 mg of tetrahydrothiophene chloroaurate complex in 10 ml of chloroform was added. The reaction solution was concentrated under reduced pressure and recrystallized from methanol to obtain 0.8 g of Compound 1-7.

Synthesis of Compound 1-48

Compound 1-48 was synthesized according to Scheme 3.

Scheme 3:

(Synthesis of Intermediate 4)

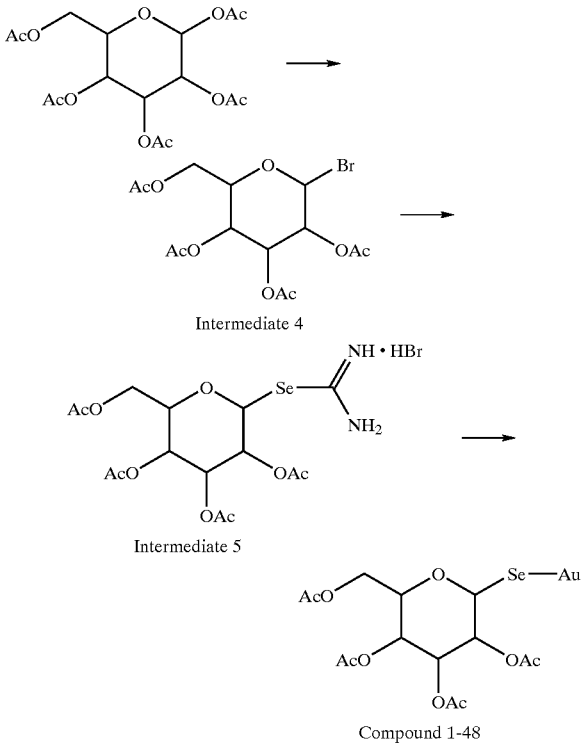

To a methylene chloride 60 ml solution containing 13 g of pentaacetyl-D-glucose, 25 g of a hydrogen bromide 30% acetic acid solution was added. The resulting solution was stirred over night at room temperature and then subjected to liquid separation by adding 100 ml of ice water and 100 ml of methylene chloride. The organic layer was washed with 30 ml of a saturated aqueous hydrogen carbonate solution and 30 ml of a saturated aqueous sodium chloride solution, dried over sodium sulfate and concentrated under reduced pressure. To the obtained oily material, 60 ml of ethanol was added. Then, the crystals precipitated were collected by filtration to obtain 11 g of Intermediate 4.

Synthesis of Intermediate 5

To 100 ml of acetone, 10.5 g of Intermediate 4 and 3.1 g of selenourea were added and ref luxed under heating for 1 hour. The reaction solution was cooled on ice and the crystals precipitated were collected by filtration to obtain 9 g of Intermediate 5.

Synthesis of Compound 1-48

In 8 ml of water, 0.8 g of Intermediate 5 was dissolved. Thereto, an aqueous solution obtained by dissolving 204 ml of potassium carbonate in 8 ml of water while cooling on ice was added dropwise and then a solution obtained by dissolving 474 mg of tetrahydrothiophene chloroaurate complex in 30 ml of acetone was added. Thereafter, the crystals precipitated were collected by filtration to obtain 0.8 g of Compound 1-48.

Synthesis of Compound 4-30

Compound 4-30 could be obtained by performing thoroughly the same operation as in Synthesis of Compound 1-48 except for using bromosuccinic acid in place of Intermediate 4.

Synthesis of Compound 1-86

In 10 ml of methanol, 1.0 g of bis(tetra-O-acetyl-β-D-glucopyranosyl)ditelluride which can be synthesized by the method descried in *J. Chem. Soc. Chem. Commun.*, No. 11, page 693 (1985) was dissolved. Thereto, 110 mg of sodium boron hydride was gradually added while cooling to 0° C. and after stirring at 0° C. for 30 minutes, a solution previously obtained by adding 900 mg of chloroauric acid and 800 mg of thiodiethanol to 5 ml of ethanol was gradually added dropwise. The precipitate produced was collected by filtration and dried, whereby Compound 1-86 could be obtained.

Synthesis of Compound 1-98

To a solution prepared by dissolving 290 mg of chloroauric acid in 2 ml of water, a solution obtained by dissolving 709 mg of 1-thio-α-D-mannose in 5 ml of water was added. The resulting solution was stirred for 20 minutes and after adding 1 g of sodium chloride, cooled on ice. The crystals precipitated were collected by filtration to obtain Compound 1-98.

The amount added of the compound capable of releasing a gold-chalcogen anion species for use in the present invention may vary over a wide range depending on the case but is preferably from $1\times10^{-6}$ to $5\times10^{-3}$ mol, more preferably from $5\times10^{-6}$ to $5\times10^{-4}$ mol, per mol of silver halide.

The compound capable of releasing a gold-chalcogen anion species for use in the present invention is preferably added after dissolving it in water or a solvent such as alcohols (e.g., methanol, ethanol), ketones (e.g., acetone), amides (e.g., dimethylformamide), glycols (e.g., methylpropylene glycol) and esters (e.g., ethyl acetate).

The compound capable of releasing a gold-chalcogen anion species for use in the present invention may be added at any stage during the preparation of emulsion but is preferably added between after the formation of silver halide grains and before the completion of chemical sensitization. When the compound of the present invention is added to emulsion and reacted, the silver halide emulsion is chemically sensitized and the objective effect of the present invention can be attained.

In the present invention, when Ch in formulae (1) to (4) represents S, the following embodiment of the invention can be preferably used.

The silver halide grain in the silver halide emulsion for use in the present invention is preferably a cubic or tetradecahedral crystal grain having substantially {100} faces (this grain may have rounded corners and may have a (hkl) plane) or an octahedral crystal grain. Alternatively, 50% or more of the entire projected area are preferably occupied by a tabular grain comprising a {100} face or a {111} face and having an aspect ratio of 2 or more. The aspect ratio is a value obtained by dividing the diameter of a circle corresponding to the projected area of a grain by the thickness of the grain. In the present invention, a cubic grain, a tabular grain having {100} main planes and a tabular grain having {111} are preferably used.

The silver halide emulsion for use in the present invention may be a silver chloride, silver bromide, silver iodobromide or silver chloro(iodo)bromide emulsion but in view of rapid processability, is preferably a silver chloride, silver chlorobromide, silver chloroiodide or silver chlorobromoiodide emulsion having a silver chloride content of 90 mol % or more, more preferably 95 mol % or more, still more preferably 98 mol % or more. Among these, a silver halide emulsion comprising silver halide grains having in the shell part thereof a silver iodochloride phase in an amount of 0.01 to 0.50 mol %, preferably from 0.05 to 0.40 mol %, per mol of the entire silver is preferred because high sensitivity can be obtained and suitability for high-intensity exposure is excellent. Furthermore, a silver halide emulsion comprising silver halide grains having on the surface thereof a silver bromide localized phase in an amount of 0.2 to 5 mol %, preferably from 0.5 to 3 mol %, per mol of the entire silver is more preferred because high sensitivity can be obtained and moreover, the photographic properties can be stabilized.

In the case where the emulsion of the present invention contains silver iodide, the iodide ion may be introduced by adding an iodide salt solution solely or adding an iodide salt solution together with the addition of a silver salt solution and a high chloride salt solution. In the latter case, the iodide salt solution and the high chloride solution may be added separately or may be added as a mixed solution of iodide salt and high chloride salt. The iodide salt is added in the form of a soluble salt such as alkali or alkaline earth iodide salt. The iodide may also be introduced by cleaving iodide ion from an organic molecule as described in U.S. Pat. No. 5,389,508. Also, fine silver iodide grain may be used as another iodide ion source.

The iodide salt solution may be added concentrically at a certain period in the grain formation or may be added over a certain period of time. In the high chloride emulsion, the site to which iodide ion is introduced is limited from the standpoint of obtaining a high-sensitive and low-fogging emulsion. As the iodide ion is introduced more inside an emulsion grain, the sensitivity less increases. Therefore, the iodide salt solution is preferably added in the outer side than 50% of the grain volume, more preferably in the outer side than 70%, most preferably in the outer side than 80%. At the same time, the iodide salt solution is preferably added to end in the inner side than 98% of the grain volume, most preferably in the inner side of 96%. By ending the addition of the iodide salt solution slightly inside the grain surface, the obtained emulsion can have higher sensitivity and lower fogging.

The distribution of iodide ion concentration in the depth direction inside a grain can be measured by an etching/TOF-SIMS (Time of Flight·Secondary Ion Mass Spectrometry) method using, for example, TRIFT II-type TOF-SIMS manufactured by Phi Evans. The TOF-SIMS method is specifically described in *Hyomen Bunseki Gijutsu Sensho Niji Ion Shitsuryou Bunseki Ho* (*Surface Analysis Technology Selection, Secondary Ion Mass Spectrometry*), compiled by Nippon Hyomen Kagaku Kai, issued by Maruzen (1999). When emulsion grains are analyzed by the etching/TOF-SIMS method, the analysis may show that even if the addition of iodide salt solution is ended inside a grain, the iodide ion is bleeding out toward the grain surface. In the case where the emulsion of the present invention contains silver iodide, it is preferably shown in the analysis by the etching/TOF-SIMS method that the iodide ion has a concentration maximum on the grain surface and the iodide ion concentration is attenuated toward the inside.

In the case where the emulsion of the present invention contains a silver bromide localized phase, a silver bromide localized phase having a silver bromide content of at least 10 mol % is preferably formed on the grain surface by the epitaxial growth. The silver bromide content of the silver bromide localized phase is preferably from 10 to 60 mol %, most preferably from 20 to 50 mol %. The silver bromide localized phase is preferably constituted by from 0.1 to 5 mol % of silver, more preferably from 0.3 to 4 mol % of silver, based on the total amount of silver constituting the silver halide grain for use in the present invention. The silver bromide localized phase preferably contains Group VIII metal complex ion such as iridium(III) chloride, iridium(III) bromide, iridium(IV) chloride, sodium hexachloroiridate (III), potassium hexachloroiridate(IV), hexaammineiridate (IV), trioxalatoiridate(III) and trioxalatoiridate(IV). The amount of this compound added varies over a wide range according to the purpose but is preferably from $10^{-9}$ to $10^{-2}$ mol per mol of silver halide.

In the present invention, a metal ion may be integrated into the inside and/or surface of a silver halide grain by adding a transition metal ion in the process of forming and/or growing silver halide grains. The metal ion used is preferably a transition metal ion, more preferably iron, ruthenium, iridium, osmium, lead, cadmium or zinc. This metal ion is preferably accompanied by a ligand and used as a six-coordinated octahedral complex. In the case of using an inorganic compound as the ligand, cyanide ion, halide ion, thiocyan, hydroxide ion, peroxide ion, azide ion, nitrite ion, water, ammonia, nitrosyl ion or thionitrosyl ion is preferably used. This ligand compound is preferably used by coordinating it to any metal ion of iron, ruthenium, iridium, osmium, lead, cadmium and zinc. It is also preferred to use a plurality of ligands in one complex molecule. An organic compound may also be used as the ligand and the organic compound is preferably a cyclic compound containing a main chain having 5 or less carbon atoms and/or a 5- or 6-membered heterocyclic compound, more preferably a compound having within the molecule a nitrogen atom, a phosphorus atom, an oxygen atom or a sulfur atom as a coordination atom to the metal, most preferably furan, thiophene, oxazole, isoxazole, thiazole, isothiazole, imidazole, pyrazole, triazole, furazane, pyrane, pyridine, pyridazine, pyrimidine or pyrazine. A compound having such a compound as a basic skeleton and having a substituent introduced into the skeleton is also preferred.

The combination of metal ion and ligand is preferably a combination of iron ion and ruthenium ion with cyanide ion. In the compound, the cyanide ion preferably occupies a majority in the coordination number to iron or ruthenium as a center metal and the remaining coordination sites are preferably occupied by thiocyan, ammonia, water, nitrosyl ion, dimethylsulfoxide, pyridine, pyrazine or 4,4'-bipyridine. The complex formed is most preferably a hexacyanoiron or hexacyanoruthenium complex where 6 coordination sites of the center metal are all occupied by cyanide ion. This complex having a cyanide ion ligand is preferably added during the grain formation in an amount of $1\times10^{-8}$ to $1\times10^{-2}$ mol, most preferably from $1\times10^{-6}$ to $5\times10^{-4}$ mol, per mol of silver. In the case of using iridium as the central metal, the ligand is preferably fluoride ion, chloride ion, bromide ion or bromide ion, more preferably chloride ion or bromide ion. Specific preferred examples of the iridium complex include $[IrCl_6]^{3-}$, $[IrCl_6]^{2-}$, $[IrCl_5$ (thiazole)]2–, $[IrCl_5(5\text{-}CH_3\text{-thiazole})]$2–, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$ and $[IrBr_3(H_2O)_3]^{+}$. This iridium complex is preferably added during the grain formation in an amount of $1\times10^{-10}$ to $1\times10^{-3}$ mol, most preferably from $1\times10^{-8}$ to $1\times10^{-5}$ mol, per mol of silver. In the case of using ruthenium and osmium as center metals, nitrosyl ion, thionitrosyl ion or water molecule is preferably used as a ligand together with chloride ion and it is more preferred to form a pentachloronitrosyl complex, a pentachlorothionitrosyl complex or a pentachloroaqua complex. A hexachloro complex is also preferably formed. This complex is preferably added during the grain formation in an amount of $1\times10^{-10}$ to $1\times10^{-6}$ mol, more preferably from $1\times10^{-9}$ to $1\times10^{-6}$ mol, per mol of silver.

In the present invention, the above-described complex is preferably integrated inside a silver halide grain by adding the complex to a reaction solution under grain formation, more specifically, by adding the complex directly to the reaction solution during the silver halide grain formation or adding the complex to an aqueous halide solution for forming silver halide grains or to other solution. It is also preferred to incorporate the complex inside a silver halide grain using these methods in combination.

In the case of integrating the complex into a silver halide grain, this is preferably performed such that the complex is uniformly present inside a grain or as disclosed in JP-A-4-208936, JP-A-2-125245 and JP-A-3-188437, present only in the grain surface layer or such that the complex is present only inside a grain and a complex-free layer is added to the grain surface. It is also preferred to subject a fine grain having integrated therein a complex to physical ripening to modify the grain surface phase as disclosed in U.S. Pat. Nos. 5,252,451 and 5,256,530. Furthermore, these methods may be used in combination and a plurality of complexes may be integrated into one silver halide grain. The halogen composition at the site where the complex is incorporated is not particularly limited, and the complex is preferably incorporated into any of a silver chloride layer, a silver chlorobromide layer, a silver bromide layer, a silver iodochloride layer and a silver iodobromide layer.

The silver halide grain contained in the silver halide emulsion for use in the present invention preferably has an average grain size (a number average of grain sizes, assuming that the diameter of a circle equivalent to the projected area of a grain is a grain size) of 0.1 to 2 $\mu$m.

The grain size distribution is preferably so-called monodisperse, where the coefficient of variation (obtained by dividing the standard deviation of the grain size distribution by an average grain size) is 20% or less, preferably 15% or less, more preferably 10% or less. At this time, for the purpose of obtaining a wide latitude, two or more kinds of these monodisperse emulsions different in the average grain size are preferably blended and used in the same layer or coated one on another to form multiple layers.

The silver halide emulsion for use in the present invention may contain various compounds or precursors thereof for the purpose of preventing fogging during the production, storage or photographic processing of a light-sensitive material or for stabilizing the photographic performance. Specific examples of these compounds which are preferably used include those described in JP-A-62-215272 supra., pages 39 to 72. In addition, 5-arylamino-1,2,3,4-thiatriazole compounds (the aryl residue has at least one electron-withdrawing group) described in EP0447647 are also preferably used.

For elevating storability of the silver halide emulsion, the following compounds are preferably used in the present invention: hydroxamic acid derivatives described in JP-A-11-109576; cyclic ketones having in adjacency to the carbonyl group a double bond with both ends being substituted by an amino group or a hydroxyl group described in JP-A-11-327094 (in particular, those represented by formula (S1); the paragraphs 0036 to 0071 may be incorporated into the present specification by reference); sulfo-substituted catechol and hydroquinones (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts thereof) described in JP-A-11-143011; hydroxylamines represented by formula (A) of U.S. Pat. No. 5,556,741 (the description in column 4, page 56 to column 11, line 22 of U.S. Pat. No. 5,556,741 is preferably applied also in the present invention and is incorporated into the present specification by reference); and water-soluble reducing agents represented by formulae (I) to (III) of JP-A-11-102045.

The spectral sensitization is performed for the purpose of imparting spectral sensitivity in a desired light wavelength region to the emulsion of each layer in the light-sensitive material of the present invention.

Examples of the spectral sensitizer used for the spectral sensitization in blue, green and red regions of the light-sensitive material of the present invention include those described in F. M. Harmer, *Heterocyclic compounds-Cyanine dyes and related compounds*, John Wiley & Sons [New York, London] (1964). Specific examples of the compound and the spectral sensitization method which are preferably used include those described in JP-A-62-215272 supra., page 22, right upper column to page 38. As for the red-sensitive spectral sensitizing dye for silver halide emulsion grains having a high silver chloride content, spectral sensitizing dyes described in JP-A-3-123340 are very preferred in view of stability, strong adsorption, temperature dependency of exposure and the like.

The amount of these spectral sensitizing dyes added may be selected over a wide range and is preferably from $0.5\times10^{-6}$ to $1.0\times10^{-2}$ mol, more preferably from $1.0\times10^{-6}$ to $5.0\times10^{-3}$ mol, per mol of silver halide.

The silver halide grain for use in the present invention may be subjected to, in addition to the treatment with the compound of the present invention, at least one of conventional chalcogen sensitization (e.g., sulfur sensitization, selenium sensitization, tellurium sensitization), noble metal sensitization (e.g., gold sensitization, palladium sensitization) and reduction sensitization at any step during the preparation of the silver halide emulsion. It is preferred to combine two or more sensitization methods. Various types of emulsions can be prepared by varying the step at which the chemical sensitization is performed. Examples thereof include a type where a chemical sensitization speck is embedded inside the grain, a type where a chemical sensitization speck is embedded in the shallow position from the grain surface, and a type where a chemical sensitization speck is formed on the surface. In the emulsion of the present invention, the position of the chemical sensitization speck can be selected according to the purpose. In general, at least one kind of chemical sensitization speck is preferably formed in the vicinity of the grain surface.

One of the chemical sensitization methods which can be preferably used in combination is the sole use of chalcogenide sensitization or noble metal sensitization, or a combination of these sensitization methods. The chemical sensitization may be performed using active gelatin as described in T. H. James, *The Theory of the Photographic Process*, 4th ed., pp. 67–76, Macmillan (1977), or may be performed using sulfur, selenium, tellurium, gold, platinum, palladium, iridium or a combination of two or more of these sensitizing dyes at a pAg of from 5 to 10, a pH of from 5 to 8 and a temperature of from 30 to 80° C. as descried in *Research Disclosure*, Vol. 120, 12008 (April 1974),

*Research Disclosure*, Vol. 34, 13452 (June 1975), U.S. Pat. Nos. 2,642,361, 3,297,446, 3,772,031, 3,857,711, 3,901,714, 4,266,018 and 3,904,415, and British Patent 1,315,755. In the noble metal sensitization, a salt of noble metal such as gold, platinum, palladium and iridium may be used. Among these, gold sensitization, palladium sensitization and a combination use thereof are preferred.

The selenium sensitizer which can be used in combination may be a selenium compound disclosed in conventionally known patents. The selenium sensitization is usually performed by adding a labile selenium compound and/or a non-labile selenium compound and stirring the emulsion at a high temperature, preferably 40° C. or more, for a predetermined time. Examples of the labile selenium compound which is preferably used include the compounds described in JP-B-44-15748, JP-B-43-13489, JP-A-4-25832 and JP-A-4-109240. The amount added of the selenium sensitizer for use in the present invention varies depending on the activity of selenium sensitizer used, the kind and size of silver halide, or the temperature and time of ripening but is preferably from $2\times10^{-6}$ to $5\times10^{-6}$ mol per mol of silver halide. In the case of using a selenium sensitizer, the chemical sensitization temperature is preferably 40° C. or more and at the same time, 80° C. or less. The pAg and the pH may be freely selected. For example, the effect of the present invention can be obtained over a wide pH range from 4 to 9. The gold sensitizer for the gold sensitization which can be used in combination may have a gold oxidation number of either +1 valence or +3 valence and gold compounds usually used as a gold sensitizer can be used. Representative examples thereof include chloroaurate, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The amount of the gold sensitizer added varies depending on various conditions but is, as a standard, preferably $1\times10^{-7}$ mol or more per mol of silver halide and at the same time, $5\times10^{-5}$ mol or less per mol of silver halide.

In the chemical sensitization of the present invention, sulfur sensitization is preferably used in combination. In the sulfur sensitization, a known sulfur sensitizer may be used and examples thereof include thiosulfate, allylthiocarbamidethiourea, allylisothiacyanate, cystine, p-toluenethiosulfonate and rhodanine. In addition, sulfur sensitizers described, for example, in U.S. Pat. Nos. 1,574,944, 2,410,689, 2,278,947, 2,728,668, 3,501,313 and 3,656,955, German Patent 1,422,869, JP-B-56-24937 and JP-A-55-45016 can also be used. The amount of the sulfur sensitizer added may be sufficient if it is large enough to effectively increase the sensitivity of emulsion. This amount varies over a wide range depending on various conditions such as pH, temperature and size of silver halide grain, but is preferably from $1\times10^{-7}$ to $5\times10^{-5}$ mol per mol of silver halide.

In the chemical sensitization of the silver halide emulsion of the present invention, gold sensitization known in the art may further be used in combination. By applying gold sensitization, the emulsion can be elevated in the sensitivity and reduced in the fluctuation of photographic performance at the scanning exposure with a laser ray or the like. The gold sensitization which can be used in combination includes colloidal gold sulfide sensitization, and various inorganic gold compounds, gold(I) complexes having an inorganic ligand, and gold(I) compounds having an organic ligand can be used. Examples of the inorganic gold compound include chloroauric acid and salts thereof, and examples of the gold(I) complex having an inorganic ligand include aurous dithiocyanate compounds such as potassium gold(I) dithiocyanate, and aurous dithiosulfate compounds such as trisodium gold(I) dithiosulfate.

Examples of the gold(I) compound having an organic ligand, which can be used, include bis-gold(I) mesoionic heterocyclic rings such as bis(1,4,5-trimethyl-1,2,4-triazolium-3-thiolate) gold(I) tetrafluoroborate described in JP-A-4-267249, organic mercaptogold(I) complexes such as bis(1-[3-(2-sulfonatobenzamide)phenyl]-5-mercaptotetrazole potassium salt) aurate(I) pentahydrate described in JP-A-11-218870, and gold(I) compounds coordinated with nitrogen compound anion such as bis(1-methylhydantoinato) gold(I) sodium salt tetrahydrate described in JP-A-4-268550. In addition, gold(I) thiolate compounds described in U.S. Pat. Nos. 3,503,749, gold compounds described in JP-A-8-69074, JP-A-8-69075 and JP-A-9-269554, and compounds described in U.S. Pat. Nos. 5,620,841, 5,912,112, 5,620,841, 5,939,245 and 5,912,111 may also be used. The amount of such a compound added may vary over a wide range according to the case but is usually from $5\times10^{-7}$ to $5\times10^{-3}$ mol, preferably from $5\times10^{-6}$ to $5\times10^{-4}$ mol, per mol of silver halide.

In the silver halide photographic light-sensitive material of the present invention, conventionally known photographic materials and additives may be used.

For example, the photographic support which can be used includes a transmission-type support and a reflection-type support. Examples of the transmission-type support which can be preferably used include transparent film such as cellulose nitrate film and polyethylene terephthalate, and polyester of 2,6-naphthalenedicarboxylic acid (NDCA) and ethylene glycol (EG) or polyester of NDCA, terephthalic acid and EG, where an information recording layer such as magnetic layer is provided. The reflection-type support is preferably a reflective support having laminated thereon a plurality of polyethylene layers or polyester layers and containing a white pigment such as titanium oxide in at least one of these water-resistant resin layers (laminated layers).

The reflective support for use in the present invention is more preferably a reflective support obtained by providing a polyolefin layer having fine holes on a paper substrate in the side where a silver halide emulsion layer is provided. The polyolefin layer may comprise multiple layers and in this case, it is preferred that the polyolefin layer (for example, polypropylene, polyethylene) adjacent to the gelatin layer in the silver halide emulsion layer side has no fine hole and the polyolefin layer (for example, polypropylene, polyethylene) in the side closer to the paper substrate has fine holes. The density of the polyolefin layer having a multilayer structure or a single layer structure interposed between the paper substrate and a photographic constituent layer is preferably from 0.40 to 1.0 g/ml, more preferably from 0.50 to 0.70 g/ml. The thickness of the polyolefin layer having a multilayer structure or a single layer structure interposed between the paper substrate and a photographic constituent layer is preferably from 10 to 100 $\mu$m, more preferably from 15 to 70 $\mu$m. The ratio of the thickness of the polyolefin layer to the thickness of the paper substrate is preferably from 0.05 to 0.2, more preferably from 0.1 to 0.5.

From the standpoint of enhancing the rigidity of the reflective support, it is also preferred to provide the polyolefin layer on the surface opposite the photographic constituent layer (back surface) of the paper support. In this case, the polyolefin layer on the back surface is preferably formed of polyethylene or polypropylene having a matted surface, more preferably polypropylene. The thickness of the polyolefin layer on the back surface is preferably from 5 to 50 μm, more preferably from 10 to 30 μm, and the density thereof is preferably from 0.7 to 1.1 g/ml. Examples of the preferred embodiment of the polyolefin layer provided on the paper substrate of the reflective support for use in the present invention include those described in JP-A-10-333277, JP-A-10-333278, JP-A-11-52513, JP-A-11-65024, EP0880065 and EP0880066.

The above-described water-resistant resin layer preferably contains a fluorescent brightening agent. The fluorescent brightening agent may also be dispersed in a hydrophilic colloid layer of the light-sensitive material. The florescent brightening agent which can be used is preferably a florescent brightening agent of benzoxazole type, coumarin type or pyrazoline type, more preferably a florescent brightening agent of benzoxazolyl naphthalene type or benzoxazolyl stilbene type. The amount used thereof is not particularly limited but is preferably from 1 to 100 mg/m$^2$. In the case of mixing the fluorescent brightening agent with the water-resistant resin, the mixing ratio to the resin is preferably from 0.0005 to 3% by mass, more preferably from 0.001 to 0.5% by mass.

The reflection-type support may also be a support obtained by providing a hydrophilic colloid layer containing a white pigment on the transmission-type support or on the above-described reflection-type support.

The reflection-type support may also have a metal surface with mirror reflection or secondary diffuse reflection.

Also, the support for use in the light-sensitive material of the present invention may be a white polyester-base support for display or a support after a layer containing a white pigment is provided on the support in the side having a silver halide emulsion layer. Furthermore, in order to improve the sharpness, an antihalation layer is preferably provided on the support in the side where a silver halide emulsion layer is coated or on the back surface thereof. The support is preferably set to have a transmission density of 0.35 to 0.8 so that the display can be viewed with either reflected light or transmitted light.

For the purpose of enhancing the sharpness or the like of an image, it is preferred to add a dye capable of decoloration upon processing (particularly, oxonol-base dye) described in EP-A-0337490, pp. 27–76, to a hydrophilic colloid layer of the light-sensitive material of the present invention such that the light-sensitive material has an optical reflection density of 0.70 or more at 680 nm, or to incorporate 12% by mass or more (more preferably 14% by mass or more) of titanium oxide surface-treated with a di-, tri- or tetra-hydric alcohol (e.g., trimethylolethane), into the water-resistant resin layer of the support.

In the light-sensitive material of the present invention, a dye capable of decoloration upon processing (particularly, oxonol dye or cyanine dye) described in EP-A-0337490, pp. 27–76, is preferably added to a hydrophilic colloid layer so as to prevent irradiation or halation or enhance the safelight immunity or the like. In addition, the dyes described in European Patent 0819977 may also be preferably used in the present invention.

Some of these water-soluble dyes deteriorate the color separation or safelight immunity when the amount used thereof is increased. As for the dye which can be used without changing the color separation for the worse, the water-soluble dyes described in JP-A-5-127324, JP-A-5-127325 and JP-A-5-216185 are preferred.

In the present invention, a colored layer capable of decoloration upon processing is used in place of or in combination with the water-soluble dye. The colored layer capable of decoloration upon processing may be directly contacted with an emulsion layer or may be disposed to contact with an emulsion layer through an interlayer containing a process color mixing inhibitor such as gelatin or hydroquinone. This colored layer is preferably provided as an underlayer (in the support side) of an emulsion layer which forms the same primary color as the color of the colored layer. All colored layers corresponding to respective primary colors may be individually provided or only a part thereof may be freely selected and provided. Also, a colored layer subjected to colorings corresponding to a plurality of primary color regions may also be provided. The optical reflection density of the colored layer is preferably such that the optical density value at a wavelength having a highest optical density in the wavelength region used for exposure (in a normal printer exposure, a visible light region of 400 to 700 nm and in the case of scanning exposure, the wavelength of the light source used for the scanning exposure) is from 0.2 to 3.0, more preferably from 0.5 to 2.5, still more preferably from 0.8 to 2.0.

For the formation of the colored layer, a conventionally known method may be used. Examples thereof include a method of incorporating a dye described in JP-A-2-282244, page 3, right upper column to page 8, or a dye described in JP-A-3-7931, page 3, right upper column to page 11, left lower column, which is in the form of a solid fine particle dispersion, into a hydrophilic colloid layer, a method of mordanting an anionic dye to a cationic polymer, a method of allowing a dye to adsorb to a fine particle such as silver halide and thereby fixing the dye in a layer, and a method of using colloidal silver described in JP-A-1-239544. With respect to the method of dispersing fine powder of a dye in the solid state, a method of incorporating a fine powder dye which is substantially water-insoluble at least at a pH of 6 or less but substantially water-soluble at least at a pH of 8 or more, is described, for example, in JP-A-2-308244, pages 4 to 13. The method of mordanting an anionic dye to a cationic polymer is described, for example, in JP-A-2-84637, pages 18 to 26. Also, the preparation method of colloidal silver as a light absorbent is disclosed in U.S. Pat. Nos. 2,688,601 and 3,459,563. Among these methods, the method of incorporating a fine powder dye and the method of using colloidal silver are preferred.

The silver halide photographic light-sensitive material of the present invention can be used for color negative film, color positive film, color reversal film, color reversal printing paper, color printing paper and the like but is preferably used as color printing paper.

The color printing paper preferably comprises at least one yellow color-forming silver halide emulsion layer, at least one magenta color-forming silver halide emulsion layer and at least one cyan color-forming silver halide emulsion layer. In general, these silver halide emulsion layers are provided in the order of, from the side closer to the support, a yellow color-forming silver halide emulsion layer, a mag enta color-forming silver halide emulsion layer and a cyan color-forming silver halide emulsion layer.

However, a layer structure different from the above may also be employed.

The silver halide emulsion layer containing a yellow coupler may be disposed at any position on the support but when the yellow coupler-containing layer comprises silver halide tabular grains, the layer is preferably provided at the position more distant from the support than at least one of the magenta coupler-containing silver halide emulsion layer and the cyan coupler-containing silver halide emulsion layer. From the standpoint of accelerating the color development, promoting the desilvering and reducing the residual color due to sensitizing dyes, the yellow coupler-containing silver halide emulsion layer is preferably provided at the position most distant from the support than other silver halide emulsion layers. In view of the reduction in the bleach-fixing discoloration, the cyan coupler-containing silver halide emulsion is preferably provided as a midmost layer of other silver halide emulsion layers and in view of the reduction in the light discoloration, the cyan coupler-containing silver halide emulsion layer is preferably provided as a lowermost layer. The yellow, magenta and cyan color-forming layers each may be composed of two or three layers. It is also preferred to provide a coupler layer containing no silver halide emulsion in adjacency to a silver halide emulsion layer to form a color-forming layer as described, for example, in JP-A-4-75055, JP-A-9-114035, JP-A-10-246940 and U.S. Pat. No. 5,576,159.

As for the silver halide emulsions, other materials (for example, additives) and photographic constituent layers (for example, layer arrangement), which can be used in the present invention, and the processing method and additives for the processing, which can be used for the processing of the light-sensitive material, those described in JP-A-62-215272, JP-A-2-33144 and EP-A-0355660, particularly those described in EP-A-0355660, are preferably used. In addition, the silver halide color photographic light-sensitive materials and the processing methods therefor described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and EP-A-0520457 may also be preferably used.

Particularly, as for the reflection-type support, silver halide emulsion, dissimilar metal ion species doped in a silver halide grain, storage stabilizer and antifoggant for silver halide emulsion, chemical sensitization method (including sensitizer), spectral sensitization method (including spectral sensitizer), cyan, magenta and yellow couplers and emulsification-dispersion method therefor, dye image preservability improver (for example, staining inhibitor and discoloration inhibitor), dye (colored layer), gelatin species, layer structure of light-sensitive material and coating pH of light-sensitive material, those described in patents shown in the Table below may be preferably applied to the present invention.

TABLE

| Element | JP-A-7-104448 | JP-A-7-77775 | JP-A-7-301895 |
|---|---|---|---|
| Reflection-type support | column 7, line 12 to column 12, line 19 | column 35, line 43 to column 44, line 1 | column 5, line 40 to column 9, line 26 |
| Silver halide emulsion | column 72, line 29 to column 74, line 18 | column 44, line 36 to column 46, line 29 | column 77, line 48 to column 80, line 28 |
| Foreign metal ion species | column 74, lines 19 to 44 | column 46, line 30 to column 47, line 5 | column 80, line 29 to column 81, line 6 |
| Storage stabilizer and antifoggant | column 75, lines 9 to 18 | column 47, lines 20 to 29 | column 18, line 11 to column 31, line 37 (particularly mercapto-heterocyclic compounds) |
| Chemical sensitization method (chemical sensitizer) | column 74, line 45 to column 75, line 6 | column 47, lines 7 to 17 | column 81, lines 9 to 17 |
| Spectral sensitization method (spectral sensitizer) | column 75, line 19 to column 76, line 45 | column 47, line 30 to column 49, line 6 | column 81, line 21 to column 82, line 48 |
| Cyan coupler | column 12, line 20 to column 39, line 49 | column 62, line 50 to column 63, line 16 | column 88, line 49 to column 89, line 16 |
| Yellow coupler | column 87, line 40 to column 88, line 3 | column 63, lines 17 to 30 | column 89, lines 17 to 30 |
| Magenta coupler | column 88, lines 4 to 18 | column 63, line 3 to column 64, line 11 | column 31, line 34 to column 77, line 44 and column 88, lines 32 to 46 |
| Emulsification-dispersion method of coupler | column 71, line 3 to column 72, line 11 | column 61, lines 36 to 49 | column 87, lines 35 to 48 |
| Dye image preservability improver (staining inhibitor) | column 39, line 50 to column 70, line 9 | column 61, line 50 to column 62, line 49 | column 87, line 49 to column 88, line 48 |
| Discoloration inhibitor | column 70, line 10 to column 71, line 2 | | |
| Dye (colorant) | column 77, line 42 to column 78, line 41 | column 7, line 14 to column 19, line 42 and column 50, line 3 to column 51, line 14 | column 9, line 27 to column 18, line 10 |
| Gelatin species | column 78, lines 42 to 48 | column 51, lines 15 to 20 | column 83, lines 13 to 19 |
| Layer structure of light-sensitive material | column 39, lines 11 to 26 | column 44, lines 2 to 35 | column 31, line 38 to column 32, line 33 |
| coating pH of light-sensitive material | column 72, lines 12 to 28 | | |
| Scanning exposure | column 76, line 6 to column 77, line 41 | column 49, line 7 to column 50, line 2 | column 82, line 49 to column 83, line 12 |
| Preservative in developer | column 88, line 19 to column 89, line 22 | | |

In addition, the couplers described in JP-A-62-215272, from page 91, right upper column, line 4 to page 121, left upper column, line 6, JP-A-2-33144, from page 3, right upper column, line 14 to page 18, left upper column, last line and from page 30, right upper column, line 6 to page 35, right lower column, line 11, and EP-A-0355660, page 4, lines 15 to 27, from page 5, line 30 to page 28, last line, page 45, lines 29 to 31, and from page 47, line 23 to page 63, line 50 are also useful as the cyan, magenta and yellow couplers for use in the present invention.

Furthermore, the compounds represented by formulae (II) and (III) of WO-98/33760 and formula (D) of JP-A-10-221825 may also be preferably used in the present invention.

These are described in more detail below.

The cyan coupler which can be used in the present invention is preferably a pyrrolotriazole-base coupler and preferred examples thereof include the couplers represented by formulae (I) and (II) of JP-A-5-313324, the couplers represented by formula (I) of JP-A-6-347960 and the couplers described in these patents.

Also, phenol-base and naphthol-base cyan couplers are preferably used and preferred examples thereof include the cyan couplers represented by formula (ADF) of JP-A-10-333297.

Other preferred examples of the cyan coupler include pyrroloazole-type cyan couplers described in European Patent 0488248 and EP-A-0491197, 2,5-diacylaminophenol couplers described in U.S. Pat. No. 5,888,716, pyrazoloazole-type cyan couplers having an electron-withdrawing group or a hydrogen bond group at the 6-position described in U.S. Pat. No. 4,873,183 and 4,916,051, and particularly pyrazoloazole-type cyan couplers having a carbamoyl group at the 6-position described in JP-A-8-171185, JP-A-8-311360 and JP-A-8-339060.

In addition, diphenylimidazole-base cyan couplers described in JP-A-2-33144, 3-hydroxypyridine-base cyan couplers described in EP-A-0333185 (in particular, Coupler (42) as a 4-equivalent coupler allowed to have a chlorine splitting-off group and converted into a 2-equivalent coupler, and Couplers (6) and (9) are preferred), cyclic active methylene-base cyan couplers described in JP-A-64-32260 (in particular, Couplers 3, 8 and 34 are preferred), pyrrolopyrazole-type cyan couplers described in EP-A-0456226, and pyrroloimidazole-type cyan couplers described in European Patent 0484909 may also be used.

Among these cyan couplers, pyrroloazole-base cyan couplers represented by formula (I) of JP-A-11-282138 are particularly preferred and the description in paragraphs 0012 to 0059 of this patent publication including Cyan couplers (1) to (47) is applied as it is to the present invention and preferably incorporated as a part of the present application.

The magenta coupler for use in the present invention may be a 5-pyrazolone-base magenta coupler or a pyrazoloazole-base magenta coupler described in known publications shown in the Table above. Among these, preferred in view of hue, image stability and color formability are pyrazolotriazole couplers described in JP-A-61-65245, in which a secondary or tertiary alkyl group is directly bonded to the 2-, 3- or 6-position of the pyrazolotriazole ring; pyrazoloazole couplers containing a sulfonamide group within the molecule described in JP-A-61-65246; pyrazoloazole couplers having an alkoxyphenyl-sulfamide ballast group described in JP-A-61-147254; and pyrazoloazole couplers having an alkoxy group or an aryloxy group at the 6-position described in EP-A-226849 and EP-A-294785.

In particular, the magenta coupler is preferably a pyrazoloazole coupler represented by formula (M-I) of JP-A-8-122984 and the description in the paragraphs 0009 to 0026 of this patent publication is applied as it is to the present invention and incorporated as a part of the present specification.

In addition, pyrazoloazole couplers having a steric hindrance group at both the 3-position and the 6-position described in European Patents 854384 and 884640 are also preferably used.

Examples of the yellow coupler which can be preferably used include, in addition to the compounds shown in the Table above, acylacetamide-type yellow couplers having a 3- to 5-membered ring structure at the acyl group described in EP-A-0447969; malondianilide-type yellow coupler having a cyclic structure described in EP-A-0482552; pyrrol-2 or 3-yl- or indol-2- or 3-yl-carbonylacetic acid anilide-base couplers described in EP-A-953870, EP-A-953871, EP-A-953872, EP-A-953873, EP-A-953874 and EP-A-953875; and acylacetamide-type yellow couplers having a dioxane structure described in U.S. Pat. No. 5,118,599. Among these, more preferred are acylacetamide-type yellow couplers where the acyl group is 1-alkylcyclopropane-1-carbonyl group, and malondianilide-type yellow couplers where one of the anilides constitutes an indoline ring. These couplers can be used individually or in combination.

The coupler for use in the present invention is preferably emulsification-dispersed in an aqueous solution of hydrophilic colloid after impregnating the coupler in a loadable latex polymer (for example, the polymer described in U.S. Pat. No. 4,203,716) in the presence (or absence) of a high-boiling point organic solvent shown in the Table above or after dissolving the coupler together with a water-insoluble and organic solvent-soluble polymer.

Examples of the water-insoluble and organic solvent-soluble polymer which can be preferably used include homopolymers and copolymers described in U.S. Pat. No. 4,857,449, columns 7 to 15, and International Patent Publication WO88/00723, pages 12 to 30. In view of the dye image stability, methacrylate-base and acrylamide-base polymers are preferred, and acrylamide-base polymer is more preferred.

In the present invention, known color mixing inhibitors can be used and among these, those described in the following patents are preferred.

Examples of the color mixing inhibitor which can be used include high molecular weight redox compounds described in JP-A-333501, phenidone or hydrazine-based compounds described in WO98/33760 and U.S. Pat. No. 4,923,787, and white couplers described in JP-A-5-249637, JP-A-10-282615 and German Patent 19629142A1. In the case of elevating the pH of the developer and thereby expediting the development, the redox compounds described in German Patent 19618786A1, EP-A-839623, EP-A-842975, German Patent 19806846A1 and French Patent 2760460A1 are preferably used.

In the present invention, a compound containing a triazine skeleton having a high molar absorption coefficient is preferably used as an ultraviolet absorbent and for example, the compounds described in the following patents can be used. This compound is preferably added to a light-sensitive layer and/or a light-insensitive layer.

The compounds described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent 19739797A, EP-A-711804 and Japanese Published Unexamined International Application 8-501291 can be used.

Although gelatin is advantageously used as the binder or protective colloid for use in the light-sensitive material of the present invention, other hydrophilic colloid can be used by itself or in combination with gelatin. In a preferred gelatin, the content of heavy metal impurities such as iron, copper, zinc and manganese is preferably 5 ppm or less, more preferably 3 ppm or less.

The amount of calcium contained in the light-sensitive material is preferably 20 mg/m$^2$ or less, more preferably 10 mg/m$^2$ or less, most preferably 5 mg/m$^2$ or less.

In the present invention, bactericide/antifungal described in JP-A-63-271247 is preferably added so as to prevent various molds and bacteria from proliferating in a hydrophilic colloid layer and thereby deteriorating the image.

The coating pH of the light-sensitive material is preferably from 4.0 to 7.0, more preferably from 4.0 to 6.5.

In the present invention, from the standpoint of improving the coating stability of the light-sensitive material, preventing the generation of electrostatic charge, controlling the electrostatic charge amount and the like, a surfactant may be added to the light-sensitive material. The surfactant includes an anionic surfactant, a cationic surfactant, a betaine surfactant and a nonionic surfactant and examples thereof include those described in JP-A-5-333492. The surfactant for use in the present invention is preferably a surfactant containing a fluorine atom. In particular, a fluorine atom-containing surfactant can be preferably used.

The amount of the surfactant added to the light-sensitive material is not particularly limited but is generally from $1\times10^{-5}$ to 1 g/m$^2$, preferably from $1\times10^{-4}$ to $1\times10^{-1}$ g/m$^2$, more preferably from $1\times10^{-3}$ to $1\times10^{-2}$ g/m$^2$.

The fluorine atom-containing surfactant may be used by itself or in combination with another conventionally known surfactant but is preferably used in combination with another conventionally known surfactant.

The light-sensitive material of the present invention is used for the printing system using a normal negative printer and additionally, is suitably used for the scanning exposure system using a cathode ray tube (CRT). The cathode ray tube exposure apparatus is simple and compact as compared with apparatuses using a laser and therefore, costs low. Also, the control of optical axis and colors is facilitated.

For the cathode ray tube used in the image exposure, various light emitters capable of emitting light in the required spectral region are used. For example, a red light emitter, a green light emitter and a blue light emitter are used individually or in combination of two or more thereof. The spectral region is not limited to these red, green and blue regions but a phosphor capable of emitting light in the yellow, orange, ultraviolet or infrared region may also be used. In particular, a cathode ray tube using a mixture of these light emitters to emit white light is often used.

In the case where the light-sensitive material has a plurality of light-sensitive layers different in the spectral sensitivity distribution and the cathode ray tube also has phosphors which emit light in a plurality of spectral regions, multiple colors may be exposed at a time, namely, the light may be emitted from the tube surface after image signals of multiple colors are input to the cathode ray tube. A method of sequentially inputting the image signals every each color, sequentially emitting light of respective colors, and performing the exposure through a film which cuts colors other than those colors (surface sequential exposure) may also be employed. In general, the surface sequential exposure is advantageous for attaining high image quality because a high resolution cathode ray tube can be used.

The light-sensitive material of the present invention is preferably used for digital scanning exposure system using monochromatic high-density light such as gas laser, light-emitting diode, semiconductor laser or second harmonic generating light source (SHG) comprising a combination of a nonlinear optical crystal with a semiconductor laser or a solid state laser using a semiconductor laser as an excitation light source. In order to make the system compact and inexpensive, a semiconductor laser or a second harmonic generating light source (SHG) comprising a combination of a nonlinear optical crystal with a semiconductor laser or a solid state laser is preferably used. Particularly, in order to design a compact and inexpensive apparatus having a long life and high stability, a semiconductor laser is preferably used and at least one of exposure light sources is preferably a semiconductor laser.

In the case of using this scanning exposure light source, the spectral sensitivity maximum wavelength of the light-sensitive material of the present invention can be freely set according to the wavelength of the scanning exposure light source used. In the case of an SHG light source obtained by combining a nonlinear optical crystal with a semiconductor laser or a solid state laser using a semiconductor laser as an excitation light source, the oscillation wavelength of the laser can be halved and therefore, blue light and green light are obtained. As a result, the light-sensitive material can have a spectral sensitivity maximum in normal three wavelength regions of blue, green and red.

The exposure time in this scanning exposure is, when defined as the time for exposing a picture element size with a picture element density of 400 dpi, preferably $10^{-4}$ sec or less, more preferably $10^{-6}$ sec or less.

The preferred scanning exposure system which can be applied to the present invention is described in detail in the patents set forth in the Table above.

In processing the light-sensitive material of the present invention, the processing materials and processing methods described in JP-A-2-207250, from page 26, right lower column, line 1 to page 34, right upper column, line 9, and in JP-A-4-97355, from page 5, left upper column, line 17 to page 18, right lower column, line 20, may be preferably applied. For the preservative used in this developer, the compounds described in the patents shown in the Table above may be preferably used.

The present invention is preferably applied also to a light-sensitive material having suitability for rapid processing.

The color development time means a time period from a light-sensitive material enters in a color developer until it enters in a bleach-fixing solution in the subsequent processing step. For example, in the case of processing the light-sensitive material in an automatic developing machine, the sum total of two time periods, namely, the time period where the light-sensitive material is immersed in a color developer (so-called in-liquid time) and the time period where the light-sensitive material is departed from the color developer and transferred in air toward the bleach-fixing bath in the subsequent step (so-called in-air time), is called a color development time. In the same way, the bleach-fixing time means the time period from the light-sensitive material enters in a bleach-fixing solution until it enters in the subsequent water washing or stabilizing bath. Also, the water washing or stabilization time means a time period where the light-sensitive material enters in the water washing or stabilizing solution and stays in the liquid (so-called in-liquid time) in preparation for the drying step.

In the present invention, when a rapid processing is performed, the color development time is preferably 60 seconds or less, more preferably from 6 to 50 seconds, still more preferably from 6 to 30 seconds. Similarly, the bleach-fixing time is preferably 60 seconds or less, more preferably from 6 to 50 seconds, still more preferably from 6 to 30 seconds. The water washing or stabilization time is preferably 150 seconds or less, more preferably from 6 to 130 seconds.

After the exposure, the light-sensitive material of the present invention is developed and the method therefor may be a wet system such as a conventional development method using a developer containing an alkali agent and a developing agent or a method of incorporating a developing agent into the light-sensitive material and performing the development using an activator solution (e.g., alkali solution)

containing no developing agent, or a heat development system using no processing solution. Particularly, the activator method uses a processing solution not containing a developing agent and therefore, the processing solution is facilitated in the control and handling. Furthermore, the load at the treatment of waste solution is reduced and this method is preferred also in view of environmental conservation.

In the activator method, the developing agent or a precursor thereof incorporated into the light-sensitive material is preferably a hydrazine-type compound described, for example, in JP-A-8-234388, JP-A-9-152686, JP-A-9-152693, JP-A-9-211814 and JP-A-9-160193.

Furthermore, a development method where the coated silver amount of the light-sensitive material is reduced and a treatment for amplifying the image (intensification treatment) using hydrogen peroxide is performed, is also preferably used. In particular, it is preferred to use this method for the activator method. More specifically, an image formation method using an activator solution containing hydrogen peroxide described in JP-A-8-297354 and JP-A-9-152695 is preferred.

In the activator method, desilvering generally follows the processing with the activator solution, however, in the image amplification treatment using a light-sensitive material having a low silver amount, a simple and easy method such as water washing or stabilization may be performed by omitting desilvering. In the case of a system of reading image information from a light-sensitive material using a scanner or the like, a processing form dispensing with desilvering can be employed even when a light-sensitive material having a high silver amount, such as a light-sensitive material for photographing, is used.

For the processing with the activator solution, the desilvering solution (bleach/fixing solution) and the washing and stabilizing solution, known processing materials and known processing methods may be used. Preferred examples thereof include those described in *Research Disclosure*, Item 36544 (September, 1994), pages 536 to 541, and JP-A-8-234388.

In exposing the light-sensitive material of the present invention in a printer, a band stop filter described in U.S. Pat. No. 4,880,726 is preferably used, whereby light color mixing can be eliminated and color reproducibility can be greatly improved.

In the present invention, copy restriction may be applied by pre-exposing a yellow microdot pattern in advance of imparting the image information as described in EP-A-0789270 and EP-A-0789480.

The light-sensitive material of the present invention can be preferably used in combination with exposure and development systems described in the following publications:

- the automatic printing and developing system described in JP-A-10-333253;
- the light-sensitive material conveying device described in JP-A-2000-10206;
- the recording system containing an image reading device described in JP-A-11-215312;
- the exposure system comprising a color image recording unit described in JP-A-11-88619 and JP-A-10-202950; and
- the digital photoprinting system containing a remote diagnosis unit described in JP-A-10-210206.

In the present invention, when Ch in formulae (1) to (4) represents Se or Te, the following embodiment of the invention can be preferably used.

The emulsion for use in the present invention is preferably a silver iodobromide or silver chloroiodobromide emulsion.

The shape of the silver halide grain for use in the present invention is not particularly limited and a grain having a regular crystal form such as cubic, octahedral or tetradecahedral form, a tabular grain having (111) main planes, a tabular grain having (100) main planes or a grain having epitaxial junction may be used but a tabular grain is preferred.

In the tabular silver halide grain (hereinafter sometimes referred to as a tabular grain), the aspect ratio means a ratio of the diameter to the thickness of silver halide, namely, a value obtained by dividing the diameter of individual silver halide grains by the thickness. Here, the diameter indicates the diameter of a circle having, when a silver halide grain is observed through a microscope or an electron microscope, an area equal to the projected area of the grain.

The color photographic light-sensitive material of the present invention comprises at least one red-sensitive silver halide emulsion layer, at least one green-sensitive silver halide emulsion layer and at least one blue-sensitive silver halide emulsion layer on a support. Preferably, each silver halide emulsion consists of two or more silver halide emulsion layers different in the sensitivity, 50% or more of the entire projected area of silver halide grains contained in at least two layers out of emulsion layers having highest sensitivity in respective two or more silver halide emulsion layers is occupied by tabular silver halide grains, and the average aspect ratio thereof is 8 or more, more preferably 10 or more, most preferably 12 or more. The upper limit of the aspect ratio is preferably 200 or less, more preferably 50 or less.

In the present invention, the average aspect ratio is an average value of aspect ratios of all tabular grains in the emulsion.

As one example of the method for measuring an aspect ratio, a replica method of taking a transmission electron microphotograph and determining the equivalent-circle diameter of individual grains is known. In this case, the thickness is calculated from the length of the shadow of replica.

The tabular grain for use in the present invention usually has a hexagonal shape. The hexagonal shape means that the main plain of the tabular grain has a hexagonal shape and the ratio of adjacent sides (maximum side length/minimum side length) thereof is 2 or less. The ratio of adjacent sides is preferably 1.6 or less, more preferably 1.2 or less. The lower limit is of course 1.0. Particularly in grains having a high aspect ratio, triangular tabular grains increase in the tabular grains. The triangular tabular grain appears when Ostwald ripening excessively proceeds. In order to obtain substantially hexagonal tabular grains, the time period for this ripening is preferably as short as possible. For this purpose, the ratio of tabular grains must be designed to increase by the nucleation. As described in JP-A-63-11928 by Saito, for increasing the generation possibility of hexagonal tabular grains, one or both of an aqueous silver ion solution and an aqueous bromide ion solution at the time of adding silver ion and bromide ion to the reaction solution by a double jet method preferably contains gelatin.

The hexagonal tabular grain for use in the present invention is formed through the steps of nucleation, Ostwald ripening and growth. All of these steps are important for preventing the broadening of the grain size distribution but since the broadening of size distribution generated in the previous step cannot be narrowed in the after step, the broadening of size distribution must be prevented in the first step of nucleation process. In the nucleation process, important is the relationship between the nucleation time of adding silver ion and bromide ion to a reaction solution by a double jet method to produce precipitates and the temperature of the reaction solution. In JP-A-63-92942 by Saito, it is stated that for attaining good monodispersity, the temperature of the reaction solution at the nucleation is preferably from 20 to 45° C. In JP-A-2-222940 by Zola et al., it is stated that the temperature at the nucleation is preferably 60° C. or less.

In order to obtain monodisperse tabular grains having a high aspect ratio, gelatin is additionally added during the grain formation in some cases. The gelatin used here is preferably a chemically modified gelatin (a gelatin where at the chemical modification of —$NH_2$ group in gelatin, at least two —COOH groups are newly added) described in JP-A-10-148897 and JP-A-11-143002. This chemically modified gelatin is a gelatin characterized in that at the chemical modification of an amino group in gelatin, at least two carboxyl groups are newly introduced. A trimellited gelatin is preferably used and a succinated gelatin is also preferably used.

The halogen composition of the tabular grain emulsion comprises silver iodobromide or silver chloroiodobromide. Silver chloride may be contained but the silver chloride content is preferably 8 mol % or less, more preferably 3 mol % or less, or 0 mol %. The silver iodide content is preferably 20 mol % or less because the coefficient of variation in the grain size distribution of tabular grain emulsion is preferably 30% or less. By reducing the silver iodide content, the coefficient of variation in the equivalent-circle diameter distribution of the tabular grain emulsion can be easily made small. In particular, the coefficient of variation in the grain size distribution of the tabular grain emulsion preferably 20% or less and the silver iodide content is preferably 10 mol % or less.

The silver iodide distribution of the tabular grain emulsion preferably has a structure within the grain. In this case, the structure of the silver iodide distribution may be a duple structure, a triple structure, a quadruple structure or a grater structure.

In the present invention, the tabular grain preferably has a dislocation line. The dislocation line of the tabular grain can be observed by a direct method using a low-temperature transmission-type electron microscope described, for example, in J. F. Hamilton, *Phot. Sci. Eng.*, 11, 57 (1967) and T. Shiozawa, *J. Soc. Phot. Sci. Jap.*, 3, 5, 213 (1972). More specifically, a silver halide grain is taken out from an emulsion by taking care not to impose a pressure high enough to generate any dislocation line on the grain, the silver halide grain is placed on a mesh for the observation through an electron microscope, and the sample is observed according to the transmission method while keeping the sample in the cooled state so as to prevent damages (for example, print-out) by the electron beam. At this time, as the thickness of the grain is larger, the electron beam is more difficult to transmit, therefore, a high-pressure type (200 kV or more for the grain having a thickness of 0.25 $\mu$m) electron microscope is preferably used for attaining clearer observation. From the photograph of grains taken by this method, the position and the number of dislocation lines on each grain when viewed from the direction perpendicular to the main plane can be determined.

The number of dislocation lines of the tabular grain for use in the present invention is preferably 10 or more on average, more preferably 20 or more on average, per one grain. In the case where the dislocation lines observed are densely present or intersected with each other, the number of dislocation lines per one grain may not be exactly counted in some cases. However, even in these cases, an approximate number may be counted like about 10, 20 or 30 lines and the case can be distinguished from the case where only a few dislocation lines are present. The average number of dislocation lines per one grain is determined as a number average by counting the number of dislocation lines on 100 or more grains. In some cases, hundreds of dislocation lines are observed.

The dislocation line can be introduced, for example, in the vicinity of the outer circumference of the tabular grain. In this case, the dislocation is nearly perpendicular to the outer circumference and the dislocation line generated extends from the position at the x% length of the distance between the center of the tabular grain and the side (outer circumference) to reach the outer circumference. This x value is preferably from 10 to less than 100, more preferably from 30 to less than 99, most preferably from 50 to less than 98. In this case, the shape formed by connecting the starting points of dislocation lines is nearly similar to the grain form but not completely a similar figure and may deform in some cases. This type of dislocation line is not observed in the center region of a grain. The dislocation lines crystallographically direct towards the (211) direction but frequently weave or sometimes intersect with each other.

The dislocation lines may be present nearly uniformly throughout the outer circumference of the tabular grain or may be present at a local site on the outer circumference. More specifically, for example, in the case of a hexagonal tabular silver halide grain, the dislocation lines may be limited only to the neighborhood of six apexes or may be limited only to the neighborhood of one apex among them. On the contrary, the dislocation lines may be limited only to the sides exclusive of the neighborhood of six apexes.

Furthermore, the dislocation lines may be formed over the region including the centers of two parallel main planes of the tabular grain. When the dislocation lines are formed over the entire surface of a main plane, these may be crystallographically directed nearly towards the (211) direction upon viewing from the direction perpendicular to the main plane but sometimes directed towards the (110) direction or formed randomly. Also, respective dislocation lines are random in the length and some dislocation line may be observed as a short line on the main plane or some dislocation line may be observed as a long line reaching the side (outer circumference). The dislocation lines are linear or weaving in many cases. Also, the dislocation lines often intersect with each other.

As described above, the sites of dislocation lines may be limited on the outer circumference, on the main plane or at the local site, or the dislocation lines may be formed on these sites together, that is, may be present on the outer circumference and on the main plane at the same time.

The dislocation line may be introduced into the tabular grain by a method of adding aqueous solutions of silver ion and iodide ion by a double jet method and forming a silver halide layer containing silver iodide described in JP-A-63-220238, a method of abruptly adding silver iodide fine grains and then forming a shell described in JP-A-11-15088, a method of forming a silver halide layer containing silver iodide while abruptly adding iodide ion using an iodide ion-releasing agent described in U.S. Pat. No. 5,496,694, a method of selectively introducing a dislocation line into a specific site of a silver halide grain described in JP-A-4-14951 and JP-A-9-189974, or a method of preparing fine silver halide grains containing 95 mol % or more of silver iodide in a mixing vessel provided outside a reactor and while adding the fine silver halide grains, forming a silver halide layer containing silver iodide described in JP-A-3-213845.

In the silver halide grain for use in the present invention, the coefficient of variation in the iodide distribution among grains is preferably 20% or less, more preferably 15% or less, still more preferably 10% or less. If the coefficient of variation in the iodide content distribution of individual silver halides exceeds 20%, this is not preferred because the contrast is not high and the sensitivity greatly decreases on application of a pressure.

The silver halide grain for use in the present invention may be subjected to, in addition to the treatment with the compound of the present invention, at least one of conventional chalcogen sensitization (e.g., sulfur sensitization, selenium sensitization, tellurium sensitization), noble metal sensitization (e.g., gold sensitization, palladium sensitization) and reduction sensitization at any step during the preparation of the silver halide emulsion. It is preferred to combine two or more sensitization methods. Various types of emulsions can be prepared by varying the step at which the chemical sensitization is performed. Examples thereof include a type where a chemical sensitization speck is embedded inside the grain, a type where a chemical sensitization speck is embedded in the shallow position from the grain surface, and a type where a chemical sensitization speck is formed on the surface. In the emulsion of the present invention, the position of the chemical sensitization speck can be selected according to the purpose. In general, at least one kind of chemical sensitization speck is preferably formed in the vicinity of the grain surface.

One of the chemical sensitization methods which can be preferably used in combination is the sole use of chalcogenide sensitization or noble metal sensitization, or a combination of these sensitization methods. The chemical sensitization may be performed using active gelatin as described in T. H. James, The *Theory of the Photographic Process*, 4th ed., pp. 67–76, Macmillan (1977), or may be performed using sulfur, selenium, tellurium, gold, platinum, palladium, iridium or a combination of two or more of these sensitizing dyes at a pAg of from 5 to 10, a pH of from 5 to 8 and a temperature of from 30 to 80° C. as descried in *Research Disclosure*, Vol. 120, 12008 (April 1974), *Research Disclosure*, Vol. 34, 13452 (June 1975), U.S. Pat. Nos. 2,642,361, 3,297,446, 3,772,031, 3,857,711, 3,901, 714, 4,266,018 and 3,904,415, and British Patent 1,315,755. In the noble metal sensitization, a salt of noble metal such as gold, platinum, palladium and iridium may be used. Among these, gold sensitization, palladium sensitization and a combination use thereof are preferred.

The selenium sensitizer which can be used in combination may be a selenium compound disclosed in conventionally known patents. The selenium sensitization is usually performed by adding a labile selenium compound and/or a non-labile selenium compound and stirring the emulsion at a high temperature, preferably 40° C. or more, for a predetermined time. Examples of the labile selenium compound which is preferably used include the compounds described in JP-B-44-15748, JP-B-43-13489, JP-A-4-25832 and JP-A-4-109240. The amount added of the selenium sensitizer for use in the present invention varies depending on the activity of selenium sensitizer used, the kind and size of silver halide, or the temperature and time of ripening but is preferably from $2\times10^{-6}$ to $5\times10^{-6}$ mol per mol of silver halide. In the case of using a selenium sensitizer, the chemical sensitization temperature is preferably 40° C. or more and at the same time, 80° C. or less. The pAg and the pH may be freely selected. For example, the effect of the present invention can be obtained over a wide pH range from 4 to 9. The gold sensitizer for the gold sensitization which can be used in combination may have a gold oxidation number of either +1 valence or +3 valence and gold compounds usually used as a gold sensitizer can be used. Representative examples thereof include chloroaurate, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The amount of the gold sensitizer added varies depending on various conditions but is, as a standard, preferably $1\times10^{-7}$ mol or more per mol of silver halide and at the same time, $5\times10^{-5}$ mol or less per mol of silver halide.

In the chemical sensitization of the present invention, sulfur sensitization is preferably used in combination. In the sulfur sensitization, a known sulfur sensitizer may be used and examples thereof include thiosulfate, allylthiocarbamidethiourea, allylisothiacyanate, cystine, p-toluenethiosulfonate and rhodanine. In addition, sulfur sensitizers described, for example, in U.S. Pat. Nos. 1,574, 944, 2,410,689, 2,278,947, 2,728,668, 3,501,313 and 3,656, 955, German Patent 1,422,869, JP-B-56-24937 and JP-A-55-45016 can also be used. The amount of the sulfur sensitizer added may be sufficient if it is large enough to effectively increase the sensitivity of emulsion. This amount varies over a wide range depending on various conditions such as pH, temperature and size of silver halide grain, but is preferably from $\times10^{-7}$ to $5\times10^{-5}$ mol per mol of silver halide.

The silver halide emulsion for use in the present invention may also be subjected to reduction sensitization during grain formation, after grain formation but before chemical sensitization, or during or after chemical sensitization.

For performing the reduction sensitization, a method of adding a reduction sensitizer to the silver halide emulsion, a method called silver ripening where the emulsion is grown or ripened in a low pAg atmosphere at a pAg of 1 to 7, or a method called high pH ripening where the emulsion is grown or ripened in a high pH atmosphere at a pH of 8 to 11 may be selected. Also, two or more of these methods may be used in combination.

The method of adding a reduction sensitizer is preferred because the reduction sensitization level can be delicately controlled. Known examples of the reduction sensitizer include stannous chloride, ascorbic acid and its derivatives, amine and polyamines, hydrazine derivatives, formamidinesulfinic acid, silane compounds and borane compounds. In the present invention, the reduction sensitization may be performed using a reduction sensitizer selected from these known reduction sensitizers, and two or more compounds may also be used in combination. Preferred compounds as the reduction sensitizer are stannous chloride, thiourea dioxide, dimethylamineboran, and ascorbic acid and its derivatives. The amount of the reduction sensitizer added depends on the conditions in the production of emulsion and therefore, must be selected but is suitably from $10^{-7}$ to $10^{-3}$ mol per mol of silver halide.

During the preparation of the emulsion for use in the present invention, an oxidizing agent for silver is preferably used. The term "oxidizing agent for silver" as used herein means a compound having a function of acting on metal silver to convert it into silver ion. In particular, a compound capable of converting very small silver grains by-produced during the formation and chemical sensitization of silver halide grains into silver ion is useful. The silver ion produced here may form a silver salt difficultly soluble in water, such as silver halide, silver sulfide and silver selenide, or may form a silver salt easily soluble in water, such as silver nitrate. The oxidizing agent for silver may be an inorganic material or an organic material. Examples of the inorganic oxidizing agent include ozone, hydrogen peroxide and adducts thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$) , peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), oxygen acid salts such as permanganate (e.g., $KMnO_4$) and chromate (e.g., $K_2Cr_2O_7$), halogens such as iodine and bromine, perhalogenates (e.g., potassium periodate), salts of metal having a high valency (e.g., potassium hexacyanoferrate), and thiosulfonates.

Examples of the organic oxidizing agent include quinones such as p-quinone, organic peroxides such as peracetic acid and perbenzoic acid, and compounds which release active halogen (for example, N-bromosuccinimide, Chloramine T, Chloramine B). Among these oxidizing agents, preferred in the present invention are inorganic oxidizing agents such as ozone, hydrogen peroxide and an adduct thereof, halogen element and thiosulfonate, and organic oxidizing agents such as quinones.

In a preferred embodiment, the above-described reduction sensitization is used in combination with the oxidizing agent for silver. A method of using the oxidizing agent and then performing the reduction sensitization, a method reversed thereto, and a method of allowing both to be present at the same time may be used. The method may be applied in the grain formation step or the chemical sensitization step.

The photographic emulsion for use in the present invention is preferably subjected to spectral sensitization by a methine dye or the like, whereby the effect of the present invention is exerted. The dye used here includes a cyanine dye, a merocyanine dye, a complex cyanine dye, a complex merocyanine dye, a holopolar cyanine dye, a hemicyanine dye, a styryl dye and a hemioxonol dye. Among these dyes, particularly useful are the dyes belonging to cyanine dye, merocyanine dye and complex merocyanine dye. These dye dyes may contain any nucleus usually used for cyanine dyes as a basic heterocyclic nucleus. Examples of the nucleus include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, a nucleus resulting from fusion of an alicyclic hydrocarbon ring to the above-described nucleus, and a nucleus resulting from fusion of an aromatic hydrocarbon ring to the above-described nucleus, such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. On the carbon atom of these nuclei, a substituent may be present.

The merocyanine dye or complex merocyanine dye may have a 5- or 6-membered heterocyclic nucleus having a ketomethylene structure, such as pyrazolin-5-one nucleus, thiohydantoin nucleus, 2-thiooxazolidine-2,4-dione nucleus, thiazolidine-2,4-dione nucleus, rhodanine nucleus and thiobarbituric acid nucleus.

These sensitizing dyes may be used either individually or in combination of two or more thereof. The combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

Together with the sensitizing dye, a dye which itself has no spectral sensitization effect or a substance which absorbs substantially no visible light, but which exhibits supersensitization may be contained in the emulsion.

The timing of adding a sensitizing dye to the emulsion may be at any stage during the preparation of the emulsion, which has been heretofore recognized as useful. Most commonly, the sensitizing dye is added after the completion of chemical sensitization and prior to the coating, but the sensitizing dye may be added at the same time with the chemical sensitizer to perform spectral sensitization and chemical sensitization simultaneously as described in U.S. Pat. Nos. 3,628,969 and 4,225,666, the sensitizing dye may be added in advance of the chemical sensitization as described in JP-A-58-113928, or the sensitizing dye may be added before the completion of formation by precipitation of the silver halide grains to initiate the spectral sensitization. Furthermore, the above-described sensitizing dye may be added in parts, more specifically, a part of the sensitizing dye may be added in advance of the chemical sensitization and the remaining may be added after the chemical sensitization as described in U.S. Pat. No. 4,225,666. Thus, the sensitizing dye may be added at any stage during the formation of silver halide grains as in the method described in U.S. Pat. No. 4,183,756.

The amount of sensitizing dye added may be from $4\times10^{-6}$ to $8\times10^{-3}$ mol per mol of silver halide but in the case of a silver halide grain having a grain size of 0.2 to 1.2 $\mu$m, which is more preferred in the present invention, it is effective to add the sensitizing dye in an amount of about $5\times10^{-5}$ to $2\times10^{-3}$ mol per mol of silver halide.

The silver halide emulsion for use in the present invention may be improved in the fogging with the passage of time by adding and dissolving a previously prepared silver iodobromide emulsion at the time of chemical sensitization. The timing of addition may be at any time during the chemical sensitization but it is preferred to first add and dissolve the silver iodobromide emulsion and subsequently add the sensitizing dye and the chemical sensitizer in this order. The silver iodobromide emulsion used has an iodide content lower than the surface iodide content of the host grain. The silver iodobromide emulsion is preferably a pure silver bromide emulsion. The size of this silver iodobromide emulsion is not limited insofar as the emulsion can be completely dissolved, however, the equivalent-sphere diameter thereof is preferably 0.1 $\mu$m or less, more preferably 0.05 $\mu$m or less. The amount of the silver iodobromide emulsion added varies depending on the host grain used but, fundamentally, the amount added is preferably from 0.005 to 5 mol %, more preferably from 0.1 to 1 mol %, per mol of silver.

In the light-sensitive material of the present invention, at least one red-sensitive layer, at least one green-sensitive layer and at least one blue-sensitive layer are provided on a support. Each color sensitive layer has a light-sensitive layer comprising a plurality of silver halide emulsion layers having substantially the same color sensitivity but different in the light sensitivity. In the silver halide color photographic light-sensitive material of the present invention, unit light-sensitive layers are generally arranged in the order of a red-sensitive layer, a green-sensitive layer and a blue-sensitive layer from the support side. However, depending upon the purpose, this arrangement order may be reversed or a layer having different light sensitivity may be interposed between the layers having the same color sensitivity. A light-insensitive layer may also be provided between the above-described silver halide light-sensitive layers or as an uppermost or lowermost layer. This light-insensitive layer may contain a coupler, a DIR compound, a color mixing inhibitor and the like which are described later. The plurality of silver halide emulsion layers constituting each unit light-sensitive layer preferably employ a two-layer structure consisting of high-speed emulsion layer and low-speed emulsion layer by arranging these emulsion layers such that the light sensitivity sequentially becomes lower toward the support as described in German Patent 1,121,470 and British Patent 923,045. It is also possible to provide a low-speed emulsion layer farther from the support and provide a high-speed emulsion layer closer to the support as described in JP-A-57-112751, JP-A-62-200350, JP-A-62-206541 and JP-A-62-206543.

Specific examples of the layer arrangement include, from the remotest side from the support, an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL and an order of BH/BL/GH/GL/RL/RH.

Also, as described in JP-B-55-34932, a layer arrangement of blue-sensitive layer/GH/RH/GL/RL in this order from the remotest side from the support may be employed. Furthermore, as described in JP-A-56-25738 and JP-A-62-63936, a layer arrangement of blue-sensitive layer/GL/RL/GH/RH in this order from the remotest side from the support may also be employed.

Other examples include an arrangement consisting of three layers different in the light sensitivity described in JP-B-49-15495, where a silver halide emulsion layer having highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so as to sequentially decrease the light sensitivity toward the support.

Even in this layer structure consisting of three layers different in the light sensitivity, the layers having the same color sensitivity may be provided in the order of medium-speed emulsion layer/high-speed emulsion layer/low-speed emulsion layer from the remote side from the support as described in JP-A-59-202464.

In addition, the layers may be provided in the order of high-speed emulsion layer/low-speed emulsion layer/medium-speed emulsion layer or low-speed emulsion layer/medium-speed emulsion layer/high-speed emulsion layer. The layer arrangement may be changed as described above also in the case of four or more layers.

In the case where the silver halide photographic light-sensitive material of the present invention is a silver halide color photographic light-sensitive material comprising a support having thereon at least one yellow coupler-containing blue-sensitive silver halide emulsion layer, at least one magenta coupler-containing green-sensitive silver halide emulsion layer, at least one cyan coupler-containing red-sensitive silver halide emulsion layer and at least one light-insensitive layer, and having a specific sensitivity of 640 or more, the spectral sensitivity SR(580) at 580 nm of the red-sensitive silver halide emulsion layer and the spectral sensitivity SR(max) at the highest sensitivity wavelength of the layer preferably satisfy the following relationship:

$$0.6 \leqq SR(\max) - SR(580) \leqq 0.9$$

It is also preferred that the centroidal sensitivity wavelength ($\lambda_{-R}$) in the spectral sensitivity distribution for the interlayer effect given to the red-sensitive silver halide emulsion layer (two or more emulsion layers as a whole) from other layer in the range from 500 to 600 nm is 500 nm$<\lambda_{-R} \leqq 560$ nm, the centroidal sensitivity wavelength ($\lambda_G$) in the spectral sensitivity distribution of the green-sensitive silver halide emulsion layer (two or more emulsion layers as a whole) is 520 nm$<\lambda_G \leqq 580$ nm, and at the same time, $\lambda_G - \lambda_{-R} \geqq 5$ nm.

As for the sensitizing dye and solid disperse dye used here, those described in JP-A-11-305396 may be used. The specific sensitivity and the centroidal sensitivity wavelength in the spectral sensitivity distribution for the interlayer effect given to the red-sensitive silver halide emulsion layer from other layer can be determined by the method described in JP-A-11-305396.

In the silver halide photographic light-sensitive material of the present invention, the spectral sensitivity SR(580) of the red-sensitive layer and the spectral sensitivity SG(580) of the green-sensitive layer preferably satisfy the following ranges at the same time. Here, SG(580) and SR(580) are defined by the logarithm of reciprocal of the exposure amount necessary for obtaining a density of minimum density+1.0 in the magenta color formation and the cyan color formation, respectively. The spectral sensitivity is preferably not changed from the under-exposure portion to the over-exposure portion.

$$0.6 \leqq SR(\max) - SR(580) \leqq 0.9$$

$$0.6 \leqq SG(\max) - SG(580) \leqq 1.1$$

The wavelength of giving highest sensitivity of the red-sensitive layer is in the range from 610 to 640 nm, preferably from 620 to 635 nm. Furthermore, the spectral sensitivity SR(650) at 650 nm of the red-sensitive layer preferably satisfies the following relationship:

$$SR(650) \leqq SR(\max) - 0.7$$

Here, the spectral sensitivity is the same as defined above.

The wavelength of giving highest sensitivity of the green-sensitive layer is in the range from 520 to 580 nm, preferably from 540 to 565 nm. The spectral sensitivity SG(525) at 525 nm of the green-sensitive layer preferably satisfies the following relationship:

$$0.1 \leqq SG(\max) - SG(525) \leqq 0.3$$

As means for improving the color reproducibility, a layer-to-layer inhibition effect is preferably used. Particularly, it is preferred that the centroidal sensitivity wavelength ($\lambda_g$) in the spectral sensitivity distribution of the green-sensitive silver halide emulsion layer is 20 nm $<\lambda_G \leqq 580$ nm, the centroidal wavelength ($\lambda_{-R}$) in the spectral sensitivity distribution for the size of interlayer effect given to the red-sensitive silver halide emulsion layer from other silver halide emulsion layer in the range from 500 to 600 nm is 500 nm$<\lambda_{-R}<560$ nm, and at the same time, $\lambda_G - \lambda_{-R}$ is 5 nm or more, preferably 10 nm or more.

In order to give the above-described interlayer effect to the red-sensitive layer in a specific wavelength region, an interlayer effect donor layer containing silver halide grains spectrally sensitized to a predetermined sensitivity is preferably provided separately. For realizing the spectral sensitivity of the present invention, the interimage sensitivity wavelength of the interlayer effect donor layer is set to 510 to 540 nm. The centroidal wavelength $\lambda_{-R}$ in the distribution of wavelength for the size of interlayer effect given to the red-sensitive silver halide emulsion layer from other silver halide emulsion layer in the range from 500 to 600 nm can be determined by the method described in JP-A-11-305396.

As for the material of giving the interlayer effect, a compound capable of reacting with an oxidation product of developing agent, which is obtained by the development, to release a development inhibitor or a precursor thereof is used. For example, a DIR (development inhibitor-releasing) coupler, DIR-hydroquinone or a coupler of releasing DIR-hydroquinone or a precursor thereof is used. In the case of a development inhibitor having high diffusibility, the development effect can be attained by disposing the donor layer at any position in the multilayer structure, however, the development inhibition effect occurs also in the unintended direction and for correcting this, the donor layer preferably undergoes color formation (formation of the same color as the layer subject to undesired effect of the development inhibitor). The donor layer of giving an interlayer effect preferably undergoes magenta color formation so that the light-sensitive material of the present invention can have desired spectral sensitivity.

The silver halide grain for use in the layer of giving an interlayer effect to the red-sensitive layer is not particularly limited on, for example, the size or shape, however, a so-called tabular grain having a high aspect ratio, a monodisperse emulsion being uniform in the grain size or a silver iodobromide grain having a layer structure of iodide is preferably used. Also, for broadening the exposure latitude, two or more emulsions different in the grain size are preferably mixed.

The donor layer of giving an interlayer effect to the red-sensitive layer may be provided at any position on the support but is preferably provided at the position closer to the support than the blue-sensitive layer and farther from the support than the red-sensitive layer, more preferably in the side closer to the support than the yellow filter layer.

The donor layer of giving an interlayer effect to the red-sensitive layer is still more preferably present in the side closer to the support than the green-sensitive layer and farther from the support than the red-sensitive layer, and most preferably positioned adjacent to the green-sensitive layer in the side closer to the support. In this case, the "adjacent to" means that an interlayer or the like is not interposed therebetween. The layer of giving an interlayer effect to the red-sensitive layer may consist of a plurality of layers and in this case, these layers may be adjacent to or separated from each other.

The emulsion for use in the light-sensitive material of the present invention may be a surface latent image-type emulsion of forming a latent image mainly on the surface of a grain, an internal latent image-type emulsion of forming a latent image inside a grain, or an emulsion of forming a latent image both on the surface and the inside of a grain, but the emulsion must be a negative type emulsion. The internal latent image-type emulsion may be a core/shell internal latent image-type emulsion described in JP-A-63-264740 and the preparation method of this emulsion is described in JP-A-59-133542. In this emulsion, the thickness of the shell varies depending on the development processing or the like, but it is preferably from 3 to 40 nm, more preferably from 5 to 20 nm.

The silver halide emulsion is usually subjected to physical ripening, chemical ripening and spectral sensitization before use. The additives used in these steps are described in RDNo. 17643, RDNo. 18716 and RDNo. 307105 and the pertinent portions thereof are summarized in the table set forth later.

The light-sensitive material of the present invention may use two or more emulsions different at least in one property of the light-sensitive silver halide emulsion, such as grain size, grain size distribution, halogen composition, grain shape or sensitivity, by mixing these emulsions in the same layer.

A silver halide grain having a fogged surface described in U.S. Pat. No. 4,082,553, a silver halide grain having a fogged inside described in U.S. Pat. No. 4,626,498 and JP-A-59-214852 or a colloidal silver is preferably applied to a light-sensitive silver halide emulsion layer and/or a substantially light-insensitive hydrophilic colloid layer. The term "silver halide grain having a fogged inside or surface" as used herein means a silver halide grain which can be uniformly (non-imagewise) developed irrespective of the unexposed area or the exposed area of the light-sensitive material. The preparation method of such a grain is described in U.S. Pat. No. 4,626,498 and JP-A-59-214852. The silver halide of forming the inner core of a core/shell type silver halide grain with the inside being fogged may have a different halogen composition.

The silver halide having a fogged inside or surface may be any of silver chloride, silver chlorobromide, silver iodobromide and silver chloroiodobromide. The fogged silver halide grain preferably has an average grain size of 0.01 to 0.75 $\mu$m, more preferably from 0.05 to 0.6 $\mu$m. Although the emulsion may have a regular shape or may be polydisperse, however, the emulsion preferably has monodispersity (an emulsion where at least 95% by mass or by number of silver halide grains have a grain size within the average grain size ±40%).

In the present invention, a light-insensitive fine grain silver halide is preferably used. The term "light-insensitive fine grain silver halide" as used herein means a silver halide fine grain which is not sensitive to light at the time of imagewise exposure for obtaining a dye image and is substantially not developed at the development process of the dye image. The light-insensitive fine grain silver halide is preferably not fogged previously. The fine grain silver halide has a silver bromide content of 0 to 100 mol % and, if desired, may contain silver chloride and/or silver iodide. The fine grain silver halide preferably contains from 0.5 to 10 mol % of silver iodide. Furthermore, the fine grain silver halide preferably has an average grain size (an average of equivalent-circle diameters of the projected areas) of 0.01 to 0.5 $\mu$m, more preferably from 0.02 to 0.2 $\mu$m.

The fine grain silver halide can be prepared by the same method as those for normal light-sensitive silver halide. The surface of the silver halide grain needs not be optically sensitized and also needs not be spectrally sensitized. However, a known stabilizer such as triazole-base compound, azaindene-base compound, benzothiazolium-base compound, mercapto-base compound or zinc compound is preferably added to the fine grain silver halide in advance of the addition to a coating solution. The layer containing fine grain silver halide grains may contain colloidal silver.

In the light-sensitive material of the present invention, various additives described above are used but various additives other than those may also be used according to the purpose.

These additives are more specifically described in *Research Disclosure*, Item 17643 (December, 1978), *ibid.*, Item 18716 (November, 1979) and *ibid.*, Item 308119 (December, 1989). The pertinent portions are shown together in the table below.

| Kinds of Additives | RD17643 | RD18716 | RD308119 |
|---|---|---|---|
| 1. Chemical sensitizer | p. 23 | p. 648, right col. | p. 996 |
| 2. Sensitivity increasing agent | | p. 648, right col. | |
| 3. Spectral sensitizer, supersensitizer | pp. 23–24 | p. 648, right col. to p. 649, right col. | p. 996, right to p. 998, right |
| 4. Brightening agent | p. 24 | | p. 998, right |
| 5. Antifoggant, stabilizer | pp. 24–25 | p. 649, right col. | p. 998, right to p. 1000, right |
| 6. Light absorbent, filter dye, UV absorbent | pp. 25–26 | p. 649, right col. to p. 650, left col. | p. 1003, left to right |
| 7. Stain inhibitor | p. 25, right col. | p. 650, left to right cols. | p. 1002, right |
| 8. Dye Image Stabilizer | p. 25 | | p. 1002, right |
| 9. Hardening agent | p. 26 | p. 651, left col. | p. 1004, right to p. 1005, left |
| 10. Binder | p. 26 | p. 651, left col. | p. 1003, right to p. 1004, right |
| 11. Plasticizer, lubricant | p. 27 | p. 650, right col. | p. 1006, left to right |
| 12. Coating aid, surfactant | pp. 26–27 | p. 650, right col. | p. 1005, left to p. 1006, left |
| 13. Antistatic agent | p. 27 | p. 650, right col. | p. 1006, right to p. 1007, left |
| 14. Matting agent | | | p. 1008, left to p. 1009, left |

The technique such as layer arrangement, which can be used for the photographic light-sensitive material of the present invention and for the emulsion usable in the light-sensitive material, the silver halide emulsion, the dye-forming coupler, the functional couplers such as DIR coupler, various additives and the development processing are described in EP-A-0565096 (published on Oct. 13, 1993) and patents cited therein. Respective items and the portions describing the items are enumerated below.

1. Layer structure: page 61, lines 23 to 35 and from page 61, line 41 to page 62, line 14; 2. interlayer: page 61, lines 36 to 40; 3. interlayer effect-imparting layer: page 62, lines 15 to 18; 4. silver halide halogen composition: page 62, lines 21 to 25; 5. silver halide grain crystal habit: page 62, lines 26 to 30; 6. silver halide grain size: page 62, lines 31 to 34; 7. emulsion preparation method: page 62, lines 35 to 40; 8. silver halide grain size distribution: page 62, lines 41 to 42; 9. tabular grain: page 62, lines 43 to 46; 10. grain inside structure: page 62, lines 47 to 53; 11. latent image formation type of emulsion: from page 62, line 54 to page 63, line 5; 12. physical ripening-chemical ripening of emulsion: page 63, lines 6 to 9; 13. mixing use of emulsion: page 63, lines 10 to 13; 14. fogged emulsion: page 63, lines 14 to 31; 15. light-insensitive emulsion: page 63, lines 32 to 43; 16. coated silver amount: page 63, lines 49 to 50; 17. formaldehyde scavenger: page 64, lines 54 to 57; 18. mercapto-base antifoggant: page 65, lines 1 and 2; 19. antifoggant or the like-releasing agent: page 65, lines 3 to 7; 20. dye: page 65, lines 7 to 10; 21. color couplers in general: page 65, lines 11 to 13; 22. yellow, magenta and cyan couplers: page 65, lines 14 to 25; 23. polymer coupler: page 65, lines 26 to 28; 24. diffusive dye-forming coupler: page 65, lines 29 to 31; 25. colored coupler: page 65, lines 32 to 38; 26. functional couplers in general: page 65, lines 39 to 44; 27. bleaching accelerator-releasing coupler: page 65, lines 45 to 48; 29. development accelerator-releasing coupler: page 65, lines 49 to 53; 29. other DIR couplers: from page 65, line 54 to page 66, line 4; 30. coupler dispersing method: page 66, lines 5 to 28; 31. antiseptic-antifungal: page 66, lines 29 to 33; 32. kind of light-sensitive material: page 66, lines 34 to 36; 33. thickness and swelling rate of light-sensitive layer: from page 66, line 40 to page 67, line 1; 34. back layer: page 67, lines 3 to 8; 35. development processing in general: page 67, lines 9 to 11; 36. developer and developing agent: page 67, lines 12 to 30; 37. developer additives: page 67, lines 31 to 44; 38. reversal processing: page 67, lines 45 to 56; 39. opening ratio of processing solution: from page 67, line 57 to page 68, line 12; 40. development time: page 68, lines 13 to 15; 41. bleach-fixing, bleaching and fixing: from page 68, line 16 to page 69, line 31; 42. automatic developing machine: page 69, lines 32 to 40; 43. water washing, rinsing and stabilization: from page 69, line 41 to page 70, line 18; 44. replenishment and re-use of processing solution: page 70, lines 19 to 23; 45. light-sensitive material self-containing developing agent: page 70, lines 24 to 33; 46. development processing temperature: page 70, lines 34 to 38; and 47. use for film with lens: page 70, lines 39 to 41.

A bleaching solution containing 2-pyridine carboxylic acid or 2,6-pyridine dicarboxylic acid, ferric salt such as ferric nitrate, and persulfate described in European Patent 602,600 can also be preferably used. In the case of using this bleaching solution, a stopping step and a water washing step are preferably interposed between the color developing step and the bleaching step and for the stopping solution, an organic acid such as acetic acid, succinic acid and maleic acid is preferably used. Furthermore, this bleaching solution preferably contains an organic acid such as acetic acid, succinic acid, maleic acid, glutaric acid and adipic acid, in the range from 0.1 to 2 mol/liter (hereinafter the liter is sometimes denoted as "L") for the purpose of pH adjustment or bleach fogging.

The magnetic recording layer which is preferably used in the present invention is descried below.

The magnetic recording layer which is preferably used in the present invention is provided by coating an aqueous or organic solvent-base coating solution obtained by dispersing magnetic particles in a binder on a support.

The magnetic particle which can be used in the present invention includes ferromagnetic iron oxide (e.g., $\gamma$-$Fe_2O_3$), Co-doped $\gamma$-$Fe_2O3$, Co-doped magnetite, Co-containing magnetite, ferromagnetic chromium dioxide, ferromagnetic metal, ferro-magnetic alloy, hexagonal Ba ferrite, Sr ferrite, Pb ferrite and Ca ferrite. Among these, Co-doped ferromagnetic iron oxide such as Co-doped $\gamma$-$Fe_2O_3$ is preferred. The shape of the magnetic particle may be any of acicular, ellipsoidal, spherical, cubic and tabular forms. The specific surface area as SBET is preferably 20 $m^2/g$ or more, more preferably 30 $m^2/g$ or more.

The saturation magnetization ($\sigma s$) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to a surface treatment with silica and/or alumina or with an organic material. Furthermore, the magnetic particle may be subjected to a surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder used for the magnetic particle may be a thermoplastic resin, a thermosetting resin, a radiation-curable resin, a reactive resin, an acid, alkali or biodegradable polymer, a natural polymer (e.g., cellulose derivative, sugar derivative) or a mixture thereof described in JP-A-4-219569. The above-described resin has a Tg of from −40° C. to 300° C. and a mass average molecular weight of from 2,000 to 1,000,000. Examples of the resin include cellulose derivatives such as cellulose diacetate, cellulose triacetate, cellulose acetate propionate, cellulose acetate butyrate and cellulose tripropionate, acrylic resins and polyvinyl acetal resins. Gelatin is also preferably used. Among these, cellulose di(tri)acetate is preferred. The binder may cured by adding thereto an epoxy-base, aziridine-base or isocyanate-base crosslinking agent. Examples of the isocyanate-base crosslinking agent include isocyanates such as tolylenediisocyanate, 4,4'-diphenylmethanediisocyanate, hexamethylenediisocyanate and xylylenediisocyanate, reaction products of an isocyanate described above with polyalcohol (e.g., a reaction product of 3 mol of tolylenediisocyanate with 1 mol of trimethylolpropane), and polyisocyanates obtained by the condensation of an isocyanate described above, and these are described, for example, in JP-A-6-59357.

The magnetic material is preferably dispersed in the binder by the method using a kneader, a pin-type mill or an annular-type mill described in JP-A-6-35092 and these may also be preferably used in combination. The dispersant described in JP-A-5-088283 and other known depressants may be used. The thickness of the magnetic recording layer is from 0.1 to 10 $\mu$m, preferably from 0.2 to 5 $\mu$m, more preferably from 0.3 to 3 $\mu$m. The mass ratio of the magnetic particle to the binder is preferably from 0.5:100 to 60:100, more preferably from 1:100 to 30:100. The coated amount of magnetic particles is from 0.005 to 3 g/m$^2$, preferably from 0.01 to 2 g/m$^2$, more preferably from 0.02 to 0.5 g/m$^2$. The transmission yellow density of the magnetic recording layer is preferably from 0.01 to 0.50, more preferably from 0.03 to 0.20, still more preferably from 0.04 to 0.15.

The magnetic recording layer may be provided by coating or printing throughout the back surface of a photographic support or like stripes. For coating the magnetic recording layer, air doctor, blade, air knife, squeeze, soakage, reverse roller, transfer roller, gravure, kiss, cast, spray, dip, bar, extrusion or the like may be used and the coating solution described in JP-A-5-341436 is preferably used.

The magnetic recording layer may be designed to have functions, for example, to improve lubricity, control curling, prevent electrostatic charge, prevent adhesion or abrade the head, or other functional layers may be provided to undertake these functions. At least one or more of particles is preferably an abrasive of an aspheric inorganic particle having a Moh's hardness of 5 or more. The composition of the aspheric inorganic particle is preferably an oxide such as aluminum oxide, chromium oxide, silicon dioxide, titanium dioxide and silicone carbide, a carbide such as silicon carbide and titanium carbide, or a fine particle of diamond or the like. The abrasive may be subjected to a surface treatment with a silane coupling agent or a titanium coupling agent. This particle may be added to the magnetic recording layer or may be overcoated on the magnetic recording layer (for example, as a protective layer or a lubricant layer). The binder used here may be selected from those described above and the same binder as in the magnetic recording layer is preferably used. The light-sensitive material having a magnetic recording layer is described in U.S. Pat. Nos. 5,336,589, 5,250,404, 5,229,259 and 5,215,874 and European Patent 466,130.

The polyester support which is preferably used in the present invention is described below, but the details thereon including the light-sensitive material, the processing, the cartridge and the experimental examples, which are referred to later, are described in *JIII Journal of Technical Disclosure* No. 94-6023 (Mar. 15, 1994). The polyester for use in the present invention essentially consists of a diol and an aromatic dicarboxylic acid. Examples of the aromatic dicarboxylic acid include 2,6-naphthalenedicarboxylic acid, 1,5-naphthalenedicarboxylic acid, 1,4-naphthalenedicarboxylic acid, 2,7-naphthalenedicarboxylic acid, terephthalic acid, isophthalic acid and phthalic acid, and examples of the diol include diethylene glycol, triethylene glycol, cyclohexanedimethanol, bisphenol A and biphenol. The polymer polymerized from these includes homopolymers such as polyethylene terephthalate, polyethylene naphthalate and polycyclohexanedimethanol terephthalate. Among these, preferred are polyesters containing from 50 to 100 mol % of 2,6-naphthalenedicarboxylic acid, and more preferred is polyethylene-2,6-naphthalate.

The average molecular weight is approximately from 5,000 to 200,000. The polyester for use in the present invention has a Tg of 50° C. or more, more preferably 90° C. or more.

The polyester support is then preferably heat-treated at a heat treatment temperature of from 40° C. to less than Tg, more preferably from (Tg−20° C.) to less than Tg, so as to refuse the curling habit. This heat treatment may be performed at a constant temperature within the above-described temperature range or may be performed while cooling. The heat treatment time is from 0.1 to 1,500 hours, more preferably from 0.5 to 200 hours. The support may be heat-treated in a roll form or as a web under conveyance. The surface may be made uneven (for example, by coating electrically conducting inorganic fine particles such as $SnO_2$ or $Sb_2O_5$)) to improve the surface state. Also, it is preferred to make some designs, for example, to knurl the edge part to slightly increase the height only of the edge and thereby prevent cut copy at the winding core portion. The heat treatment may be performed at any stage after the formation of the support film, after the surface treatment, after the coating of a back layer (e.g., antistatic agent, sliding agent) or after the coating of an undercoat layer. The preferred stage is after the coating of an antistatic agent.

Into the polyester, an ultraviolet absorbent may be kneaded in. Or, for preventing light piping, a commercially available paint or pigment for polyester, such as Diaresin produced by Mitsubishi Chemicals Industries, Ltd. or Kayaset produced by Nippon Kayaku K.K., may be kneaded in so as to attain the purpose.

In the present invention, in order to bond the support to constituent layers of the light-sensitive material, a surface treatment is preferably performed. Examples thereof include surface activation treatments such as chemical treatment, mechanical treatment, corona discharge treatment, flame treatment, ultraviolet light treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment.

The undercoating method is described below. The undercoat may comprise a single layer or two or more layers. Examples of the binder for the undercoat layer include copolymers starting from a monomer selected from vinyl chloride, vinylidene chloride, butadiene, methacrylic acid, acrylic acid, itaconic acid and maleic acid anhydride, polyethyleneimine, epoxy resin, grafted gelatin, nitrocellulose and gelatin. Examples of the compound which swells the support include resorcin and p-chlorophenol. Examples of the gelatin hardening agent for use in the undercoat layer include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resins and active vinyl sulfone compounds. Furthermore, the undercoat layer may contain a matting agent, for example, a fine particle of an inorganic material such as $SiO_2$ and $TiO_2$, or a polymethyl methacrylate copolymer fine particle (of 0.01 to 10 $\mu$m).

In the present invention, an antistatic agent is preferably used. Examples of the antistatic agent include polymers containing a carboxylic acid, a carboxylate or a sulfonate, cationic polymers, and ionic surfactant compounds.

Most preferred antistatic agents are a fine particle of at least one crystalline metal oxide having a volume resistivity of $10^7$ Ω·cm or less, more preferably $10^5$ Ω·cm or less, and a particle size of 0.001 to 1.0 $\mu$m selected from ZnO, $TiO_2$, $SnO_2$, $Al_2O_3$, $In_2O_3$, $SiO_2$, MgO, BaO, $MoO_3$ and $V_2O_5$, or a composite oxide thereof (Sb, P, B, In, S, Si, C, etc.), and a fine particle of a sol-like metal oxide or a composite oxide thereof.

The content of the antistatic agent in the light-sensitive material is preferably from 5 to 500 mg/m$^2$, more preferably from 10 to 350 mg/m$^2$. The ratio of the electrically conducting crystalline oxide or a composite oxide thereof to the binder is preferably from 1/300 to 100/1, more preferably from 1/100 to 100/5.

The light-sensitive material of the present invention preferably has slipperiness. The slipping agent-containing layer is preferably provided on both the light-sensitive layer surface and the back surface. The slipperiness in terms of a coefficient of dynamic friction is preferably from 0.01 to 0.25. This value is determined when the light-sensitive material is transported at a speed of 60 cm/min (25° C., 60% RH) against a stainless steel ball having a diameter of 5 mm. In this evaluation, even when the other part material is changed to the light-sensitive layer surface, a value almost on the same level is obtained.

The slipping agent which can be used in the present invention includes polyorganosiloxane, higher fatty acid amide, higher fatty acid metal salts and esters of a higher fatty acid with a higher alcohol. Examples of the polyorganosiloxane which can be used include polydimethylsiloxane, polydiethylsiloxane, polystyrylmethylsiloxane and polymethylphenylsiloxane. The layer to which the slipping agent is added is preferably an outermost layer of the emulsion layer or a back layer. In particular, polydimethylsiloxane and esters having a long chain alkyl group are preferred.

The light-sensitive material of the present invention preferably contains a matting agent. The matting agent may be present on either the emulsion surface or the back surface but is preferably added to the outermost layer in the emulsion layer side. The matting agent may or may not be soluble in the processing solution and preferably, these two types of matting agents both are used in combination. Preferred examples thereof include polymethyl methacrylate, poly (methyl methacrylate/methacrylic acid=9/1 or 5/5 (by mol)) and particulate polystyrene. The particle size is preferably from 0.8 to 10 $\mu$m, the particle size distribution is preferably narrower, and 90% by number or more of all particles preferably have a size between 0.9 and 1.1 times the average particle size. In order to increase the matting property, fine particles of 0.8 $\mu$m or less are preferably added at the same time and examples thereof include polymethyl methacrylate (0.2 $\mu$m), poly(methyl methacrylate/methacrylic acid=9/1 (by mol), 0.3 $\mu$m), particulate polystyrene (0.25 $\mu$m) and colloidal silica (0.03 $\mu$m).

The film patrone for use in the present invention is described below. The patrone for use in the present invention may be mainly made of a metal or a synthetic plastic. Preferred plastic materials are polystyrene, polyethylene, polypropylene and polyphenyl ether. The patrone for use in the present invention may further contain various antistatic agents and preferred examples thereof include carbon black, particulate metal oxides, nonionic, anionic, cationic and betaine surfactants, and polymers. The patrone imparted with the antistatic property using these is described in JP-A-1-312537 and JP-A-1-312538. In particular, the resistance at 25° C. and 25% RH is preferably $10^{12}$ Ω or less. Usually, the plastic patrone is manufactured using a plastic having kneaded therein carbon black or a pigment so as to give light-shielding property. The patrone may have a currently used 135 size but it is also effective for achieving miniaturization of a camera to reduce the cartridge size from 25 mm in the current 135 size to 22 mm or less. The volume of the patrone case is preferably 30 cm$^3$ or less, more preferably 25 cm$^3$ or less. The mass of plastic used in the patrone and the patrone case is preferably from 5 to 15 g.

A patrone which delivers the film by rotating a spool may also be used in the present invention. Furthermore, the patrone may have such a structure that a film leading end is housed in the patrone body and the film leading end is delivered from the port part of the patrone towards the outside by rotating the spool shaft in the film delivery direction. These are disclosed in U.S. Pat. Nos. 4,834,306 and 5,226,613. The photographic film for use in the present invention may be a so-called green film before development or a developed photographic film. Also, a green film and a developed photographic film may be housed in the same new patrone or in different patrones.

The color photographic light-sensitive material of the present invention is suitable also as a negative film for the advanced photo system (hereinafter referred to as AP system) and examples thereof include NEXIA A, NEXIA F and NEXA H (ISO 200, 100 and 400 in this order) (all manufactured by Fuji Photo Film Co., Ltd., hereinafter referred to as Fuji Film) prepared by processing a film into an AP system format and housing it in a cartridge exclusive to the system. The above-described cartridge film for AP system is loaded into a camera for AP system such as Epion Series (e.g., Epion 300Z) manufactured by Fuji Film. The color photographic light-sensitive material of the present invention is also suitable for the film with lens such as Fuji Color "Utsurundesu" Super Slim manufactured by Fuji Film.

The film photographed is printed through the following steps in the case of a mini-lab system: (1) receipt (receipt of an exposed cartridge film from users), (2) detaching (the film is transferred from the cartridge to an intermediate cartridge for development processing), (3) development of film, (4) reattaching (return the developed negative film into the original cartridge), (5) printing (C/H/P3-type print and index print are continuously automatically printed on a color paper [preferably on Super FA8 produced by Fuji Film]), and (6) check and forwarding (cartridge and index print are checked by the ID number and forwarded together with the print).

Preferred examples of this system include Fuji Film Mini-Lab Champion Super FA-298/F-278/FA-258/FA-238 and Fuji Film Digital Lab System Frontier. Examples of the film processor for the Mini-Lab Champion include FP922AL/FP562B/FP562B,AL/FP362B/FP362B,AL, and Fuji Color Just It CN-16L and CN-16Q are recommendable processing chemicals therefor. Examples of the printer processor include PP3008AR/PP3008A/PP1828AR/PP1828A/PP1258AR/PP1258A/PP728AR/PP728A, and Fuji Color Just It CP-47L and CP-40FAII are recommendable processing chemicals therefor.

In the Frontier system, a scanner & image processor SP-1000 and a laser printer & paper processor LP-1000P or a laser printer LP-1000W are used. The detacher for use in the detaching step and the reattacher for use in the reattaching step are preferably DT200/DT100 and AT200/AT100, respectively, manufactured by Fuji Film.

The AP system can also be enjoyed in the photo joy system including the digital image work station Aladdin 1000 manufactured by Fuji Film. For example, a developed AP system cartridge film is directly loaded into Aladdin 1000 or the image information on negative film, positive film or print is input using a 35-mm film scanner FE-550 or a flat head scanner PE-550 and the obtained digital image data can be easily worked and edited. The data can be output as a print by a light fixing type heat-sensitive color print system digital color printer NC-550AL, a laser exposure heat development transfer system Pictrography 3000, or an existing lab instrument through a film recorder. Furthermore, Aladdin 1000 can output the digital information directly into a floppy disk or a zip disk, or into a CD-R through a CD writer.

On the other hand, at the home, the photograph can be enjoyed on TV merely by loading the developed AP system cartridge film into Photo Player AP-1 manufactured by Fuji Film. When loaded into Photo Scanner AS-1 manufactured by Fuji Film, the image information can be continuously taken in at a high rate into a personal computer. For inputting a film, a print or a stereoscopic material into a personal computer, Photo Vision FV-10/FV-5 manufactured by Fuji Film can be used. The image information recorded on a floppy disk, a zip disk, a CD-R or a hard disk can be variously worked and enjoyed on a personal computer using an application soft Photo Factory produced by Fuji Film. For outputting a high- quality image print from the personal computer, a digital color printer NC-2/NC-2D of light fixing type heat-sensitive color print system, manufactured by Fuji Film, is suitably used.

For housing a developed AP system cartridge film, Fuji Color Pocket Album AP-5 Pop L, AP-1 Pop L, AP-1 Pop KG or Cartridge File 16 is preferably used.

EXAMPLE

The present invention will be described in greater detail below with reference to Examples but the present invention should not be construed as being limited to these Examples.

Example 1

Judgement of Gold-Chalcogen Anion Species-Releasing Compound

In 20 ml of methanol, 426 mg of Compound 1-48 (peracetylselenoglucose gold(I) salt) of the present invention was dissolved and thereto 10 ml of water was added. To this solution, a solution obtained by dissolving 1.19 g of silver nitrate in 200 ml of water was added and stirred under heating at 60° C. for 1 hours. After allowing to cool to room temperature, the produced black brown precipitate was collected by filtration. This precipitate was subjected to powder X-ray diffraction analysis, as a result, the diffraction pattern thereof was agreed with the pattern of AgAuSe described in the publication (Nekrasov, I. Ya.; Lunin, S. E.; Egorova, L. N. Dal'nevost. Geol. Inst., Vladivostok, USSR. Dock. Akad. Nauk SSSR (1990), 311(4), 943–6). Yield by volume: 262 mg, yield in percentage: 97%.

Elementary Analysis as AgAuSe=383.79:

Calculated: Ag, 28.1, Au, 51.3, Se, 20.6 (%);

Found: Ag, 28.0, Au, 52.0, Se, 19.0 (%).

From these results, Compound 1-48 was found to be a compound which releases a gold-chalcogen(selenium) anion species.

Example 2

Preparation of Emulsion A for Use in Blue-Sensitive Emulsion Layer

A 1:1 mixture (molar ratio as silver) of Large-Size Emulsion A1 having an average grain size of 0.70 μm and Small-Size Emulsion A2 of 0.50 μm, which were cubic, was prepared and designated as Emulsion A.

Emulsion A1 and Emulsion A2 had a coefficient of variation in the grain size distribution of 0.09 and 0.11, respectively. In each size emulsion, 0.5 mol % of silver bromide was incorporated locally on a part of the grain surface comprising a silver chloride substrate. In the portion corresponding to 10% by volume from the outermost surface layer of the grain, iodide ion was allowed to be present in an amount of 0.1 mol % based on all halides and $1\times10^{-6}$ mol of $K_4Ru(CN)_6$, $1.0\times10^{-7}$ mol of yellow prussiate of potash and $1\times10^{-8}$ mol of $K_2IrCl_5(H_2O)$, each per mol of silver halide, were allowed to be present.

This emulsion was subjected to spectral sensitization by adding the following Blue-Sensitive Sensitizing Dyes A and B each in an amount of $3.2\times100^{-4}$ mol/mol-Ag for Emulsion A1 and each in an amount of $4.4\times10^{-4}$ mol/mol-Ag for Emulsion A2.

Sensitizing Dye A:

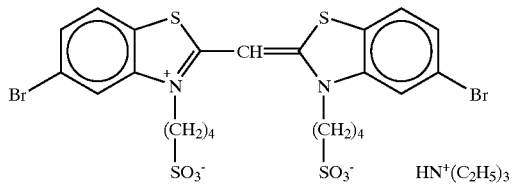

Sensitizing Dye B:

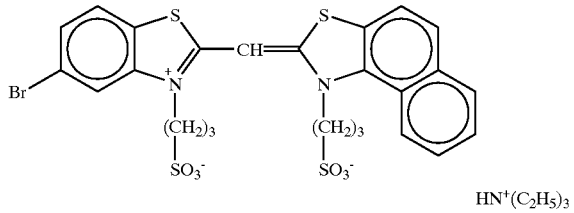

Preparation of Emulsions Cl-B and I-B for Use in Green-Sensitive Emulsion Layer Emulsion C1-B having an average grain size of 0.40 μm and having no silver iodochloride phase in the shell part, which was cubic, was prepared. The coefficient of variation in the grain size distribution was 0.09. On the grain surface, 0.6 mol % of silver bromide was allowed to be locally present. In the emulsion grain, $K_4Ru(CN)_6$, yellow prussiate of potash and $K_2IrCl_5(H_20)$ were allowed to be present similarly to Emulsion A. Thus, Emulsion C1-B was prepared.

Emulsion I-B having a silver iodochloride phase in the shell part was prepared in the same manner as Emulsion C1-B except for incorporating 0.1 mol % of silver iodide into the vicinity of the grain surface.

Thereto, $3.3\times10^{-4}$ mol of Sensitizing Dye D, $5\times10^{-5}$ mol of Sensitizing Dye E and $2.3\times10^{-4}$ mol of Sensitizing Dye F, each per mol of silver halide, were added.

Sensitizing Dye D:

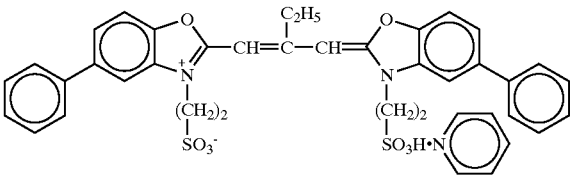

Sensitizing Dye E:

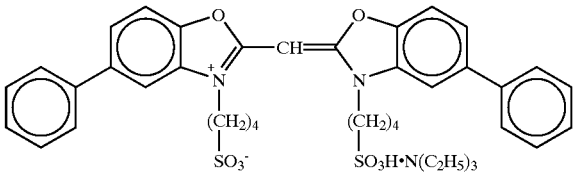

Sensitizing Dye F:

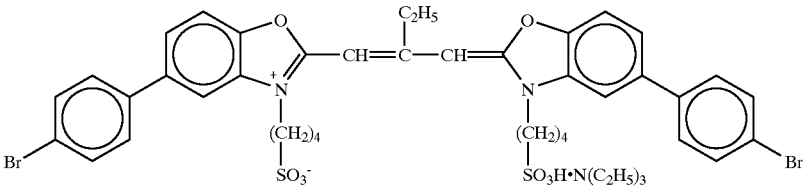

Preparation of Emulsion C for Use in Red-Sensitive Emulsion Layer

A 1:1 mixture (molar ratio as silver) of Large-Size Emulsion C1 having an average grain size of 0.40 $\mu$m and Small-Size Emulsion C2 of 0.30 $\mu$m, which were cubic, was prepared. These emulsions had a coefficient of variation in the grain size distribution of 0.09 and 0.11, respectively. In each size emulsion, 0.1 mol % of silver iodide was incorporated into the vicinity of the grain surface and 0.8 mol % of silver bromide was incorporated and allowed to be locally present on the grain surface. In the emulsion grain, $K_4Ru(CN)_6$, yellow prussiate of potash and $K_2IrCl_5(H_2O)$ were allowed to be present similarly to Emulsion A.

Thereto, Sensitizing Dyes G and H were added each in an amount of $8.0\times10^{-5}$ mol per mol of silver halide for the large-size emulsion and each in an amount of $10.7\times10^{-5}$ mol per mol of silver halide for the small-size emulsion. Furthermore, Compound I shown below was added to the red-sensitive emulsion layer in an amount of $3.0\times10^{-3}$ mol per mol of silver halide.

Sensitizing Dye G:

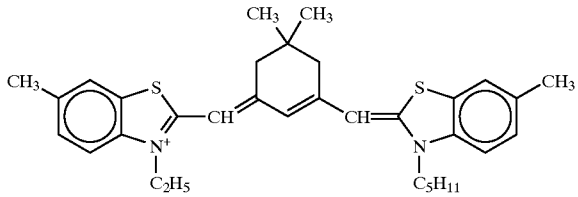

Sensitizing Dye H:

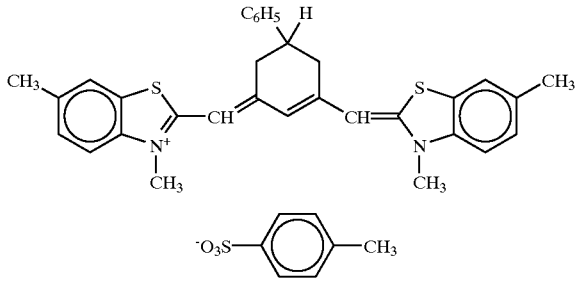

(Compound 1)

-continued

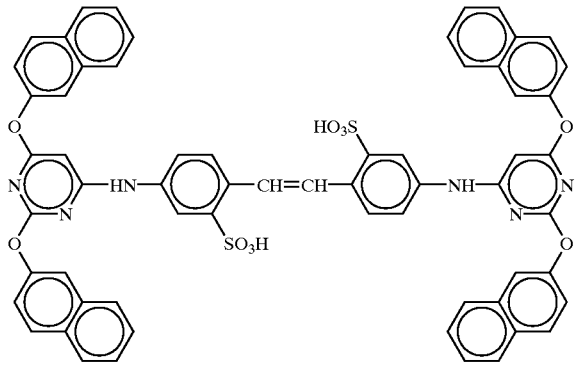

Color Photographic Light-Sensitive Material, Preparation of Coated Sample

The surface of a support obtained by coating polyethylene resin on both surfaces of paper was subjected to a corona discharge treatment and thereon, a gelatin undercoat layer containing sodium dodecylbenzenesulfonate was provided. On this undercoat layer, first to seventh photographic constituent layers were coated in sequence to manufacture a silver halide color photographic light-sensitive material Sample (101) having the layer structure shown below. The coating solution for each photographic constituent layer was prepared as follows.

Preparation of Coating Solution for First Layer:

In 21 g of Solvent (Solv-1) and 80 ml of ethyl acetate, 57 g of Yellow Coupler (ExY), 7 g of Dye Image Stabilizer (Cpd-1), 4 g of Dye Image Stabilizer (Cpd-2), 7 g of Dye Image Stabilizer (Cpd-3) and 2 g of Dye Image Stabilizer (Cpd-8) were dissolved. The resulting solution was emulsification-dispersed in 220 g of an aqueous 23.5 mass % (i.e., weight %) gelatin solution containing 4 g of sodium dodecylbenzenesulfonate by a high-speed stirring emulsifier (dissolver) and thereto, water was added to prepare 900 g of Emulsified Dispersion A.

Emulsified Dispersion A and Emulsion A were mixed and dissolved to prepare a coating solution for the first layer to have a composition shown later. The amount of emulsion coated is a coated amount in terms of silver amount.

The coating solutions for the second to seventh layers were prepared in the same manner as the coating solution for the first layer. In each layer, (H-1) (sodium (2,4-dichloro- 6-oxide-1,3,5-triazine)), (H-2) and (H-3) were used as the gelatin hardening agent. Furthermore, in each layer, Ab-1, Ab-2, Ab-3 and Ab-4 were added each to give a total coverage of 15.0 mg/m$^2$, 60.0 mg/m$^2$, 5.0 mg/m$^2$ and 10.0 mg/m$^2$, respectively Hardening Agent (H-1)

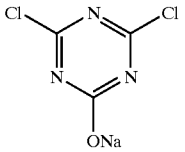

(1.4 mass % per gelatin)

Hardening Agent (H-2)

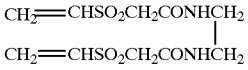

Hardening Agent (H-3)

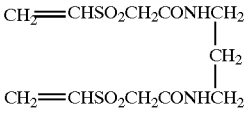

Antiseptic (Ab-1)

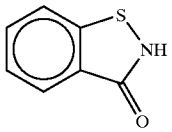

Antiseptic (Ab-2)

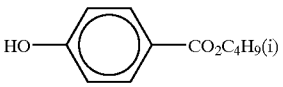

Antiseptic (Ab-3)

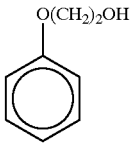

Antiseptic (Ab-4)

A 1:1:1:1 (by mol) mixture of a, b, c and d.

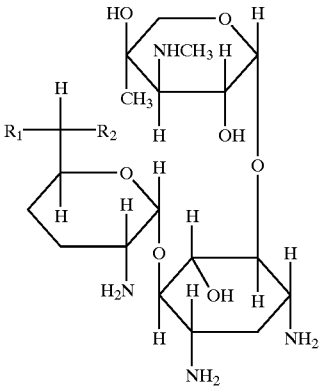

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

The chemical sensitization step is described below. Each emulsion obtained above was heated to 40° C. and chloroauric acid and an optimal amount of sodium thiosulfate pentahydrate were added. The resulting emulsion was heated at 60° C. to 80° C. (which are changed by the kinds of emulsions and chemical sensitizers) and thereto, sensitizing dyes shown above were added. After cooling to 40° C., 1-(3-methylureidophenyl)-5-mercaptotetrazole was added in an amount of $3.3\times10^{-4}$ mol, $1.0\times10^{-3}$ mol and $5.9\times10^{-4}$ mol, respectively, per mol of silver halide.

Various emulsions of this Example shown in Table 1 later were prepared by varying the chemical sensitizer in the chemical sensitization step.

The 1-(3-methylureidophenyl)-5-mercaptotetrazole was added also to the second layer, the fourth layer, the sixth layer and the seventh layer to give a coverage of 0.2 mg/m$^2$, 0.2 mg/M$^2$, 0.6 mg/M$^2$ and 0.1 mg/M$^2$, respectively.

Furthermore, 4-hydroxy-6-methyl-1,3,3a,7-tetrazaindene was added to the blue-sensitive emulsion layer and the green-sensitive emulsion layer in an amount of $1\times10^{-4}$ mol and $2\times10^{-4}$ mol, respectively, per mol of silver halide.

In the red-sensitive emulsion layer, 0.05 g/m$^2$ of a copolymer latex of methacrylic acid and butyl acrylate (mass ratio (weight ratio): 1:1, average molecular weight: 200,000 to 400,000) was added.

Also, disodium catechol-3,5-disulfonate was added to the second layer, the fourth layer and the sixth layer to give a coverage of 6 mg/m$^2$, 6 mg/m$^2$ and 18 mg/m$^2$, respectively.

For the purpose of preventing irradiation, the dyes shown below (in the parenthesis, the amount coated is shown) were added.

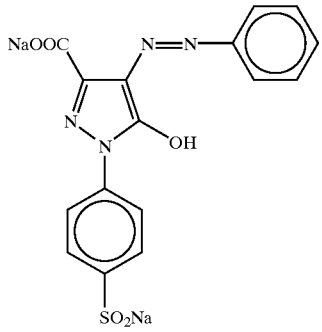

(2 mg/m$^2$)

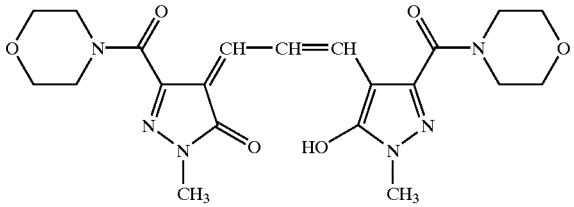

(2 mg/m$^2$)

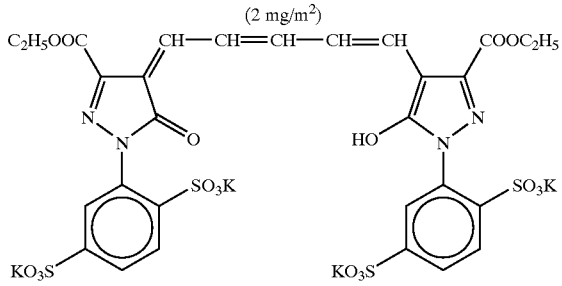

(3 mg/m$^2$)

-continued

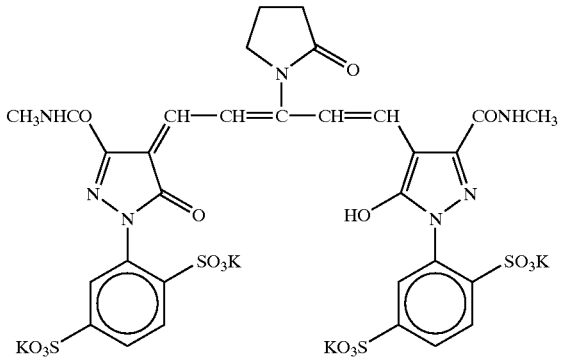

(7 mg/m$^2$)

Layer Structure

Each layer had a construction shown below. The numeral shows the amount coated (g/m$^2$). In the case of silver halide emulsion, an amount coated in terms of silver is shown.

Support

Polyethylene Resin-laminated Paper

[The polyethylene resin in the first layer side contained white pigments ($TiO_2$ (content): 16 mass %, ZnO (content): 4 mass %), a fluorescent brightening agent (4,4'-bis(5-methylbenzoxazolyl)stilbene, content: 0.03 mass %) and a bluish dye (ultramarine).]

First Layer (Blue-sensitive Emulsion Layer):

| | |
|---|---|
| Emulsion A | 0.24 |
| Gelatin | 1.25 |
| Yellow Coupler (ExY) | 0.57 |
| Dye Image Stabilizer (Cpd-1) | 0.07 |
| Dye Image Stabilizer (Cpd-2) | 0.04 |
| Dye Image Stabilizer (Cpd-3) | 0.07 |
| Dye Image Stabilizer (Cpd-8) | 0.02 |
| Solvent (Solv-1) | 0.21 |

Second Layer (Color Mixing Inhibiting Layer):

| | |
|---|---|
| Gelatin | 0.99 |
| Color Mixing Inhibitor (Cpd-4) | 0.09 |
| Dye Image Stabilizer (Cpd-5) | 0.018 |
| Dye Image Stabilizer (Cpd-6) | 0.13 |
| Dye Image Stabilizer (Cpd-7) | 0.01 |
| Solvent (Solv-1) | 0.06 |
| Solvent (Solv-2) | 0.22 |

Third Layer (Green-sensitive Emulsion Layer):

| | |
|---|---|
| Emulsion Cl—B | 0.14 |
| Gelatin | 1.36 |
| Magenta Coupler (ExM) | 0.15 |
| Ultraviolet Absorbent (UV-A) | 0.14 |
| Dye Image Stabilizer (Cpd-2) | 0.02 |
| Dye Image Stabilizer (Cpd-4) | 0.002 |
| Dye Image Stabilizer (Cpd-6) | 0.09 |
| Dye Image Stabilizer (Cpd-8) | 0.02 |
| Dye Image Stabilizer (Cpd-9) | 0.03 |
| Dye Image Stabilizer (Cpd-10) | 0.01 |
| Dye Image Stabilizer (Cpd-11) | 0.0001 |
| Solvent (Solv-3) | 0.11 |

-continued

| | |
|---|---|
| Solvent (Solv-4) | 0.22 |
| Solvent (Solv-5) | 0.20 |

Fourth Layer (Color Mixing Inhibiting Layer):

| | |
|---|---|
| Gelatin | 0.71 |
| Color Mixing Inhibitor (Cpd-4) | 0.06 |
| Dye Image Stabilizer (Cpd-5) | 0.013 |
| Dye Image Stabilizer (Cpd-6) | 0.10 |
| Dye Image Stabilizer (Cpd-7) | 0.007 |
| Solvent (Solv-1) | 0.04 |
| Solvent (Solv-2) | 0.16 |

Fifth Layer (Red-sensitive Emulsion Layer):

| | |
|---|---|
| Emulsion C | 0.12 |
| Gelatin | 1.11 |
| Cyan Coupler (ExC-2) | 0.13 |
| Cyan Coupler (ExC-3) | 0.03 |
| Dye Image Stabilizer (Cpd-1) | 0.05 |
| Dye Image Stabilizer (Cpd-6) | 0.06 |
| Dye Image Stabilizer (Cpd-7) | 0.02 |
| Dye Image Stabilizer (Cpd-9) | 0.04 |
| Dye Image Stabilizer (Cpd-10) | 0.01 |
| Dye Image Stabilizer (Cpd-14) | 0.01 |
| Dye Image Stabilizer (Cpd-15) | 0.12 |
| Dye Image Stabilizer (Cpd-16) | 0.03 |
| Dye Image Stabilizer (Cpd-17) | 0.09 |
| Dye Image Stabilizer (Cpd-18) | 0.07 |
| Solvent (Solv-5) | 0.15 |
| Solvent (Solv-8) | 0.05 |

Sixth Layer (Ultraviolet Absorbing Layer):

| | |
|---|---|
| Gelatin | 0.46 |
| Ultraviolet Absorbent (UV-B) | 0.45 |
| Compound (S1-4) | 0.0015 |
| Solvent (Solv-7) | 0.25 |

Seventh Layer (Protective Layer):

| | |
|---|---|
| Gelatin | 1.00 |
| Acryl-modified copolymer of polyvinyl alcohol (modification degree: 17%) | 0.04 |
| Liquid paraffin | 0.02 |
| Surfactant (Cpd-13) | 0.01 |

Yellow Coupler (ExY):

A 70:30 (by mol) mixture of

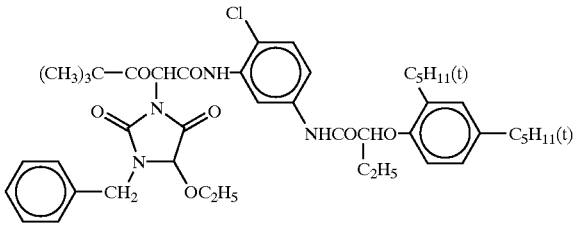

and

-continued
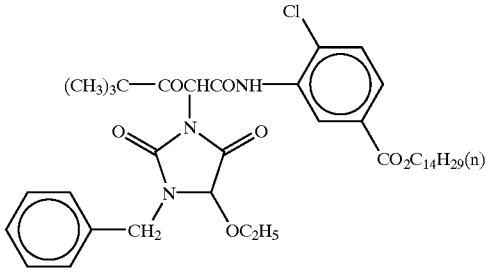
Magenta Coupler (ExM):
A 40:40:20 (by mol) mixture of
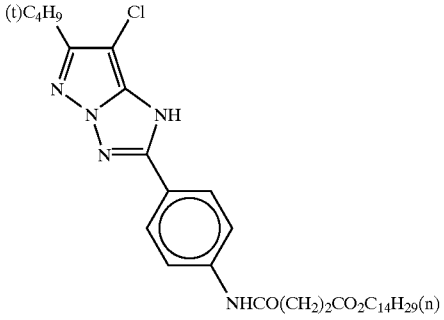
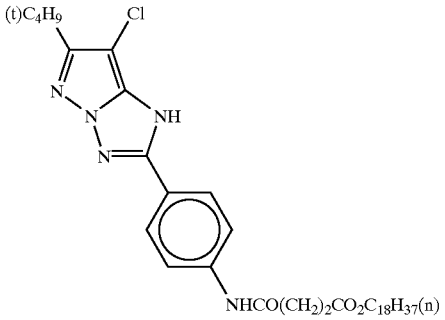
and
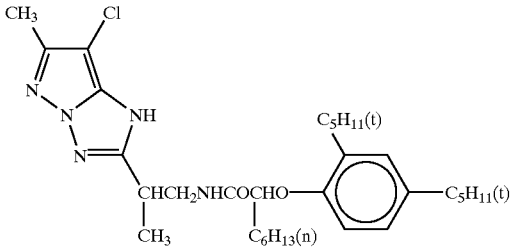
Cyan Coupler (ExC-2):
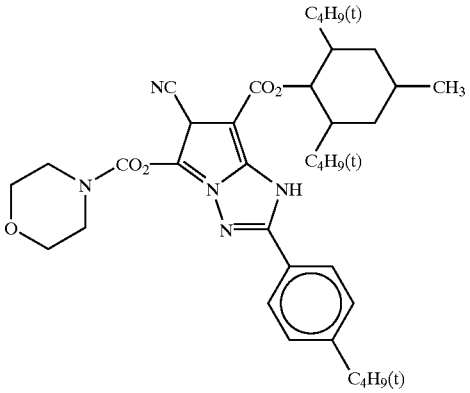
Cyan Coupler (ExC-3):
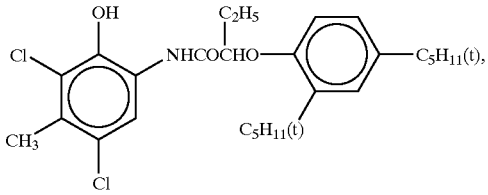
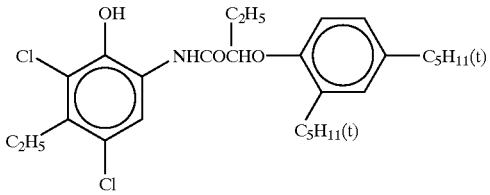
and
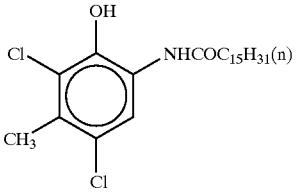
Dye Image Stabilizer (Cpd-1):
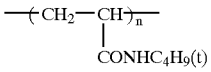
Dye Image Stabilizer (Cpd-2):
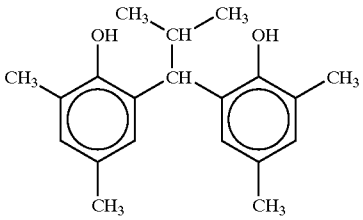

Dye Image Stabilizer (Cpd-3):
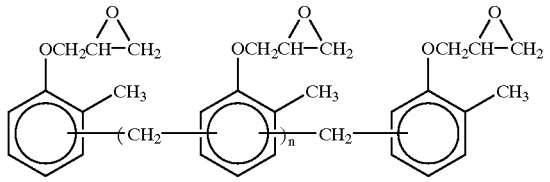
n: 7 to 8 (average)
Color Mixing Inhibitor (Cpd-4):
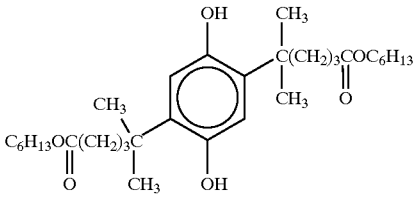
Dye Image Stabilizer (Cpd-5):
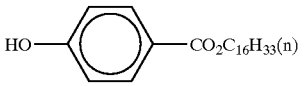
Dye Image Stabilizer (Cpd-6):
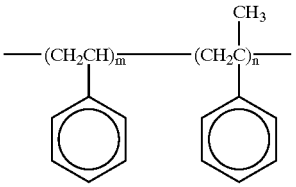
Number average molecular weight: 600
m/n = 10/90
Dye Image Stabilizer (Cpd-7):
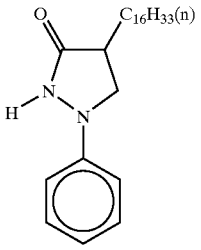
Dye Image Stabilizer (Cpd-8):
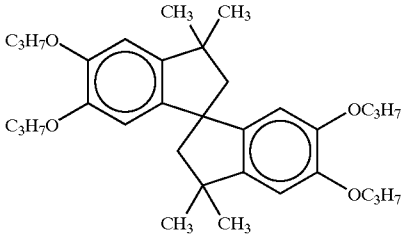
Dye Image Stabilizer (Cpd-9):
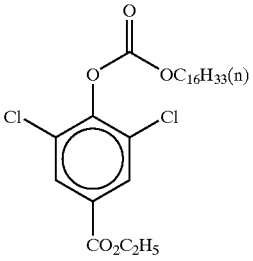
Dye Image Stabilizer (Cpd-10):
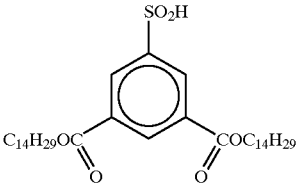
(Cpd-11)
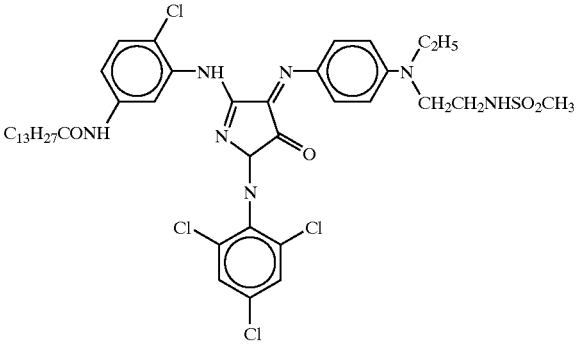
Surfactant (Cpd-13):
A 7:3 (by mol) mixture of
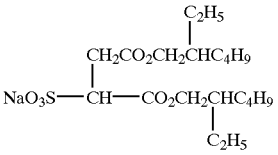
and -continued
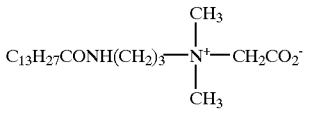
(Cpd-14): (Cpd-15):
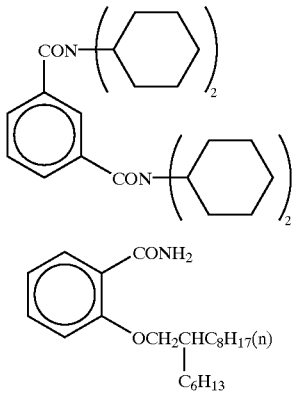
(Cpd-16): (Cpd-17):
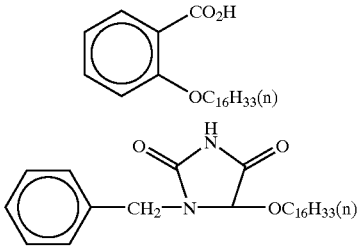
(Cpd-18):
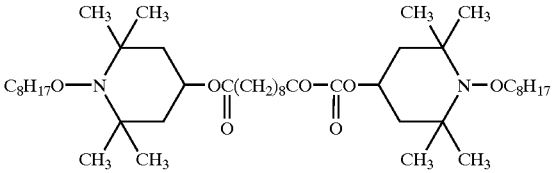
Color Mixing Inhibitor (Cpd-19):
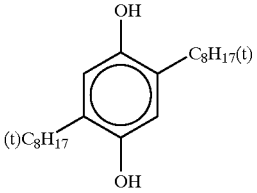
Ultraviolet Absorbent (UV-1):
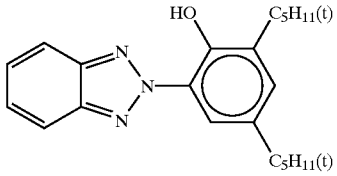
Ultraviolet Absorbent (UV-2):
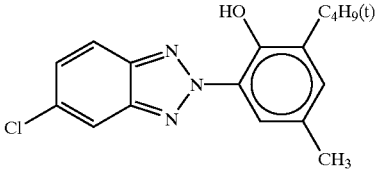
Ultraviolet Absorbent (UV-3):
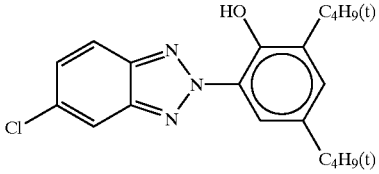
Ultraviolet Absorbent (UV-4):
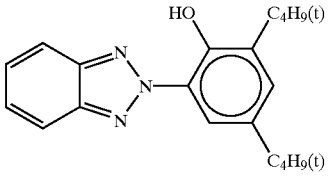
Ultraviolet Absorbent (UV-5):
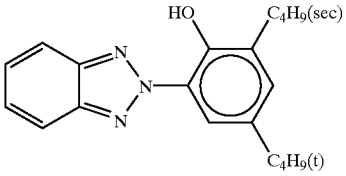
Ultraviolet Absorbent (UV-6):
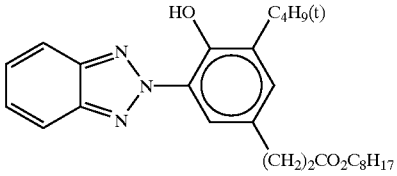

Ultraviolet Absorbent (UV-7):

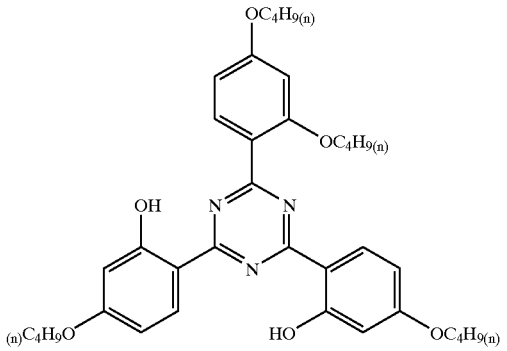

UV-A:

A 4/2/2/3 (by mass) mixture of UV-1/UV-2/UV-3/UV-4

UV-B:

A 9/3/3/4/5/3 (by mass) mixture of UV-1/UV-2/UV-3/UV-4/UV-5/UV-6

UV-C:

A 1/1/1/2 (by mass) mixture of UV-2/UV-3/UV-6/UV-7

(Solv-1)

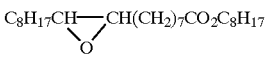

(Solv-2)

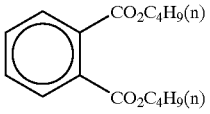

(Solv-3)

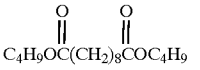

(Solv-4)

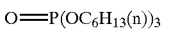

(Solv-5)

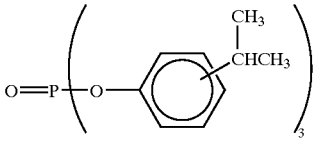

(Solv-7)

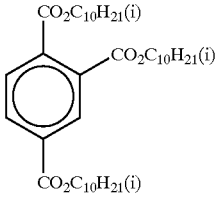

(Solv-8)

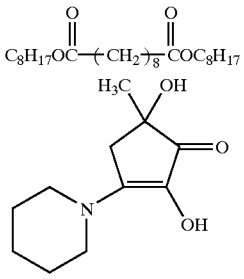

The remaining samples were prepared in the same manner as Sample (101) except for using the emulsion shown in Table 1 in the third layer of Sample (101) and changing only the chemical sensitizer used in the chemical sensitization step as shown in Table 1.

For examining the photographic properties of these samples, the following tests were performed.

Test 1: Sensitometry (low Intensity and High Intensity)

Each coated sample was subjected to gradation exposure for sensitometry using a sensitometer (Model FWH, manufactured by Fuji Photo Film Co., Ltd.). The exposure was performed through SP-2 filter in an exposure amount of 200 lx·sec (lux·second) with low intensity for 10 seconds.

Also, each coated sample was subjected to gradation exposure for sensitometry using a sensitometer for high intensity exposure (Model HIE, manufactured by Yamashita Denso). The exposure was performed through SP-2 Filter with low intensity for $10^{-4}$ seconds.

After the exposure, each sample was subjected to Color Development Processing A which is described later.

After the processing, the magenta color density of each sample was measured to determine the 10-second exposure low-intensity sensitivity and the $10^{-4}$-second exposure high intensity sensitivity. The sensitivity was prescribed by the reciprocal of an exposure amount necessary for giving a color density 1.5 higher than the minimum color density and the relative value to the sensitivity of Sample (112), which was taken as 100, was used as the relative sensitivity. Furthermore, the gradation was determined from the gradient of a straight lint between the sensitivity measured and the sensitivity at a density of 1.5.

Test 2: Dependency of Sensitivity on Exposure Humidity

The relative humidity on exposing each sample was set to 55% and 80%. After the 1/10-second exposure above, Processing A was performed and the magenta color density of each sample was measured. The sensitivity was prescribed by the reciprocal of an exposure amount necessary for giving a color density 0.5 higher than the minimum color density and the relative value to the sensitivity of Sample (112), which was taken as 100, was used as the relative sensitivity. The difference in sensitivity (hereinafter shown as "dS(H)") was determined by subtracting the relative sensitivity on exposure at a humidity of 80% from the relative sensitivity on exposure at a humidity of 55%.

Test 3: Dependency on Exposure Temperature

The temperature at the exposure of each sample was set to 10° C. and 35° C. After exposure for 1/10 second, each sample was developed and then measured on the magenta color density. The sensitivity was prescribed by the reciprocal of an exposure amount necessary for giving a color density 1.5 higher than the minimum color density. The difference (hereinafter referred to as dS(T)) was determined by subtracting the relative sensitivity on exposure at 35° C. from the relative sensitivity on exposure at 10° C.

It is revealed that when the dS(T) is a negative value, low sensitivity results on exposure at a low temperature. Therefore, a technique of approximating the dS(T) to 0 (zero) is demanded.

The results in Tests 1, 2 and 3 are shown together in Table 1 below.

TABLE 1

| Sample No. | Name of Emulsion | Silver Iodide Content (mol %) | Gold Sensitizer (μmol (Au)/ molAg) | Sensitivity (10 sec) | Sensitivity ($10^{-4}$ sec) | dS(H) | dS(T) | Remarks |
|---|---|---|---|---|---|---|---|---|
| 101 | C1-B | 0 | chloroauric acid (17) | 90 | 82 | 11 | 16 | Comparison |
| 102 | " | " | Comparative Compound A (17) | 97 | 87 | 7 | 12 | " |
| 103 | " | " | Comparative Compound D (17) | 92 | 84 | 11 | 14 | " |
| 104 | " | " | Comparative Compound E (17) | 94 | 82 | 11 | 12 | " |
| 105 | " | " | 1-1 (17) | 100 | 95 | 5 | 9 | Invention |
| 106 | " | " | 1-5 (17) | 100 | 98 | 5 | 9 | " |
| 107 | " | " | 1-7 (17) | 102 | 100 | 5 | 9 | " |
| 108 | " | " | 2-1 (17) | 99 | 96 | 6 | 7 | " |
| 109 | " | " | 3-2 (17) | 99 | 98 | 6 | 4 | " |
| 110 | " | " | 4-1 (17) | 101 | 100 | 6 | 9 | " |
| 111 | " | " | 4-10 (17) | 98 | 97 | 6 | 9 | " |
| 112 | I-B | 0.1 | Chloroauric acid (17) | 100 | 100 | 13 | 15 | Comparison |
| 113 | " | " | Comparative Compound A (17) | 112 | 118 | 6 | 12 | " |
| 114 | " | " | Comparative Compound B (17) | 113 | 123 | 5 | 14 | " |
| 115 | " | " | Comparative Compound C (17) | 103 | 102 | 13 | 13 | " |
| 116 | " | " | Comparative Compound D (17) | 102 | 104 | 13 | 13 | " |
| 117 | " | " | Comparative Compound E (17) | 104 | 102 | 13 | 11 | " |
| 118 | " | " | Comparative Compound F (17) | 101 | 100 | 9 | 15 | " |
| 119 | " | " | 1-5(a) (17) | 115 | 122 | 4 | 9 | Invention |
| 120 | " | " | 1-1 (17) | 119 | 128 | 3 | 7 | " |
| 121 | " | " | 1-5(b) (17) | 119 | 129 | 3 | 7 | " |
| 122 | " | " | 1-7 (17) | 120 | 131 | 3 | 7 | " |
| 123 | " | " | 2-1 (17) | 117 | 126 | 4 | 7 | " |
| 124 | " | " | 3-2 (17) | 117 | 124 | 4 | 4 | " |
| 125 | " | " | 4-1 (17) | 118 | 128 | 4 | 9 | " |
| 126 | " | " | 4-10 (17) | 117 | 126 | 4 | 9 | " |
| 127 | " | " | 1-98 (17) | 128 | 120 | 3 | 5 | " |
| 128 | " | " | 1-48 (17) | 130 | 133 | 3 | 6 | " |

Comparative Compound A gold(I) thioglucose (compound described in JP-B-45-29274) Mercaptoglucoside gold (I) (gold (I) thioglucose) synthesized according to JP-B-45-29274, α type:β type = 3:7 (presence proportion of α type: 30%)
Comparative Compound B gold(I) thiomalate (compound described in JP-A-8-69075) Au(I) β-L-thioglucose triethylphosphine complex (Compound 28 described in JP-8-69074)
Comparative Compound C $AuSCH_2CH_2OCH_3$ (Compound (6) described in JP-A-8-69075)
Comparative Compound D Au(I) thiomalate (Compound described in JP-A-8-69075)
Comparative Compound E $\{AuS_2CN(C_2H_5)_2\}_2$ (Compound described in U.S. Pat. No. 5,759,761)
Comparative Compound F (D) β-mercaptoglucoside gold (A) (gold(I) β-thioglucose) (described in Cellection Czechoslov. Chem. Commun., Vol. 26, page 2084 (1961)

From Table 1, the followings are seen.

From Table 1, the followings are seen.

The emulsions using the compound of the present invention exhibit high sensitivity on exposure for 10 seconds as compared with the emulsions using Comparative Compound (A), (B), (C), (D), (E) or (F). The sensitivity is particularly high at the exposure for $10^{-4}$ second (high (intensity) illuminance exposure) and this reveals excellent reciprocity law property. Conventionally, the sensitivity is readily changed due to fluctuation in humidity at exposure, however, in the present invention, the fluctuation of sensitivity is advantageously very small.

In the case of using Comparative Compound (A) or (B), the resistance against fluctuation in humidity at the exposure is fairly close to that of emulsions using the compound of the present invention, however, the sensitivity is somewhat low and in particular, the resistance against fluctuation in temperature at the exposure has a problem.

These differences according to the sensitization method are more outstanding when the silver halide emulsion grain contains silver iodide than when the silver halide emulsion grain does not contain silver iodide.

The processing steps are described below.

[Processing A]

Light-Sensitive Material 101 obtained above was worked into a 127 mm-width roll and after imagewise exposure using Mini-Lab Printer Processor PP1258AR manufactured by Fuji Photo Film Co., Ltd., subjected to a continuous processing (running test) through the following processing steps until the replenishing amount of color developer reached 2 times the volume of the color development tank. This processing using a running solution was designated as Processing A.

| Processing Step | Temperature (° C.) | Time (sec) | Replenishing Amount* (ml) |
|---|---|---|---|
| Color development | 38.5 | 45 | 45 |
| Bleach-fixing | 38.0 | 45 | 35 |
| Rinsing (1) | 38.0 | 20 | — |
| Rinsing (2) | 38.0 | 20 | — |
| Rinsing (3)** | 38.0 | 20 | — |
| Rinsing (4)** | 38.0 | 30 | 121 |

*Replenishing amount per 1 $m^2$ of the light-sensitive material.
**Rinse Cleaning System RC50D manufactured by Fuji Photo Film Co., Ltd. was installed to Rinsing (3) and the rinsing solution was taken out from Rinsing (3) and transferred by a pump to a reverse osmosis membrane module (RC50D). The permeated water obtained in the tank was fed to Rinsing (4) and the concentrated water was returned to Rinsing (3). The pump pressure was adjusted such that the amount of water permeated to the reverse osmosis module was kept to 50 to 300 ml/min. The rinsing solution was circulated under control of temperature for 10 hours per day. (The rinsing was performed in a countercurrent system in tanks from (1) to (4).)

Each processing solution had the following composition.

| | Tank Solution | Replenisher |
|---|---|---|
| Color Developer: | | |
| Water | 800 ml | 800 ml |
| Dimethylpolysiloxane-base surfactant (Silicone KF351A, produced by Shin-Etsu Chemical Co., Ltd.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxy-benzene-1,3-disulfonate | 0.5 g | 0.5 g |
| Potassium chloride | 10.0 g | — |
| Potassium bromide | 0.040 g | 0.010 g |
| Triazinylaminostilbene-base fluorescent brightening agent (Hakkol FWA-SF, produced by Showa Kagaku K.K.) | 2.5 g | 5.0 g |
| Sodium sulfite | 0.1 g | 0.1 g |
| Disodium N,N-bis(sulfonato-ethyl) hydroxylamine | 8.5 g | 11.1 g |
| N-Ethyl-N-(β-methanesulfon-amidoethyl)-3-methyl-4-amino-4-aminoaniline 3/2-sulfate monohydrate | 5.0 g | 15.7 g |
| Potassium carbonate | 26.3 g | 26.3 g |
| Water to make | 1,000 ml | 1,000 ml |
| pH (at 25° C., adjusted by potassium hydroxide and sulfuric acid) | 10.15 | 12.50 |
| Bleach-Fixing Solution | | |
| Water | 700 ml | 600 ml |
| Ammonium ethylenediamine-tetraacetato ferrate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |

-continued

| | Tank Solution | Replenisher |
|---|---|---|
| Water to make | 1,000 ml | 1,000 ml |
| pH (at 25° C., adjusted by acetic acid and ammonia) | 6.0 | 6.0 |
| Rinsing Solution | | |
| Chlorinated sodium isocyanurate | 0.02 g | 0.02 g |
| Deionized water (electrical conductivity: 5 μS/cm or less) | 1,000 ml | 1,000 ml |
| PH | 6.5 | 6.5 |

Example 3

Using the emulsions prepared in Example 2, a sample reduced in the layer thickness was prepared by changing the layer structure as follows from Sample (101). Furthermore, samples where the emulsion in the third layer was changed in the same manner as in Example 2 were prepared. These samples were subjected to Tests 1 and 2 of Example 2.

The layer structure is shown by Sample (201).

The results are the same as the results in Example 2 and the effect of the present invention is verified also in the ultrahigh speed processing of samples reduced in the layer thickness.

Manufacture of Sample 201

First Layer (Blue-sensitive Emulsion Layer):

| | |
|---|---|
| Emulsion A | 0.24 |
| Gelatin | 1.25 |
| Yellow Coupler (ExY) | 0.57 |
| Dye Image Stabilizer (Cpd-1) | 0.07 |
| Dye Image Stabilizer (Cpd-2) | 0.04 |
| Dye Image Stabilizer (Cpd-3) | 0.07 |
| Dye Image Stabilizer (Cpd-8) | 0.02 |
| Solvent (Solv-1) | 0.21 |

Second Layer (Color Mixing Inhibiting Layer):

| | |
|---|---|
| Gelatin | 0.60 |
| Color Mixing Inhibitor (Cpd-19) | 0.09 |
| Dye Image Stabilizer (Cpd-5) | 0.007 |
| Dye Image Stabilizer (Cpd-7) | 0.007 |
| Ultraviolet Absorbent (UV-C) | 0.05 |
| Solvent (Solv-5) | 0.11 |

Third Layer (Green-sensitive Emulsion Layer):

| | |
|---|---|
| Emulsion Cl—B | 0.14 |
| Gelatin | 0.73 |
| Magenta Coupler (ExM) | 0.15 |
| Ultraviolet Absorbent (UV-A) | 0.05 |
| Dye Image Stabilizer (Cpd-2) | 0.02 |
| Dye Image Stabilizer (Cpd-7) | 0.008 |
| Dye Image Stabilizer (Cpd-8) | 0.07 |
| Dye Image Stabilizer (Cpd-9) | 0.03 |
| Dye Image Stabilizer (Cpd-10) | 0.009 |
| Dye Image Stabilizer (Cpd-11) | 0.0001 |
| Solvent (Solv-3) | 0.06 |

-continued

| | |
|---|---|
| Solvent (Solv-4) | 0.11 |
| Solvent (Solv-5) | 0.06 |

Fourth Layer (Color Mixing Inhibiting Layer):

| | |
|---|---|
| Gelatin | 0.48 |
| Color Mixing Inhibitor (Cpd-4) | 0.07 |
| Dye Image Stabilizer (Cpd-5) | 0.006 |
| Dye Image Stabilizer (Cpd-7) | 0.006 |
| Ultraviolet Absorbent (UV-C) | 0.04 |
| Solvent (Solv-5) | 0.09 |

Fifth Layer (Red-sensitive Emulsion Layer):

| | |
|---|---|
| Emulsion C | 0.12 |
| Gelatin | 0.59 |
| Cyan Coupler (ExC-2) | 0.13 |
| Cyan Coupler (ExC-3) | 0.03 |
| Dye Image Stabilizer (Cpd-7) | 0.01 |
| Dye Image Stabilizer (Cpd-9) | 0.04 |
| Dye Image Stabilizer (Cpd-15) | 0.19 |
| Dye Image Stabilizer (Cpd-18) | 0.04 |
| Ultraviolet Absorbent (UV-7) | 0.02 |
| Solvent (Solv-5) | 0.09 |

Sixth Layer (Ultraviolet Absorbing Layer):

| | |
|---|---|
| Gelatin | 0.32 |
| Ultraviolet Absorbent (UV-C) | 0.42 |
| Solvent (Solv-7) | 0.08 |

Seventh Layer (Protective Layer):

| | |
|---|---|
| Gelatin | 0.70 |
| Acryl-modified copolymer of polyvinyl alcohol (modification degree: 17%) | 0.04 |
| Liquid paraffin | 0.01 |
| Surfactant (Cpd-13) | 0.01 |
| Polydimethylsiloxane | 0.01 |
| Silicon dioxide | 0.003 |

The manufactured samples each was exposed in the same manner as in Tests 1 and 2 of Example 2 and subjected to color development. The color development was ultrahigh speed processing according to Development Processing B shown below.

[Processing B]

The light-sensitive material prepared above was worked into a 127 mm-width roll and using a test processing apparatus obtained by modifying Mini-Lab Printer Processor PP350 manufactured by Fuji Photo Film Co., Ltd. so that the processing time and the processing temperature could be changed, the light-sensitive sample was imagewise exposed from a negative film having an average density and then subjected to a continuous processing (running test) through the following processing steps until the amount of replenisher used for color developer reached 0.5 times the volume of the color development tank.

| Processing Step | Temperature (° C.) | Time (sec) | Replenishing Amount* (ml) |
|---|---|---|---|
| Color development | 45.0 | 15 | 45 |
| Bleach-fixing | 40.0 | 15 | 35 |
| Rinsing 1 | 40.0 | 8 | — |
| Rinsing 2 | 40.0 | 8 | — |
| Rinsing 3** | 40.0 | 8 | — |
| Rinsing 4** | 38.0 | 8 | 121 |
| Drying | 80 | 15 | |

(Note)

*Replenishing amount per 1 $m^2$ of the light-sensitive material.

**Rinse Cleaning System RC50D manufactured by Fuji Photo Film Co., Ltd. was installed to Rinsing (3) and the rinsing solution was taken out from Rinsing (3) and transferred by a pump to a reverse osmosis membrane module (RC50D). The permeated water obtained in the tank was fed to Rinsing (4) and the concentrated water was returned to Rinsing (3). The pump pressure was adjusted such that the amount of water permeated to the reverse osmosis module was kept to 50 to 300 ml/min. The rinsing solution was circulated under control of temperature for 10 hours per day. The rinsing was performed in a four-tank countercurrent system from (1) to (4).

Each processing solution had the following composition.

| | Tank Solution | Replenisher |
|---|---|---|
| Color Developer: | | |
| Water | 800 ml | 600 ml |
| Fluorescent brightening agent (FL-1) | 5.0 g | 8.5 g |
| Triisopropanolamine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium N,N-bis(sulfonato-ethyl)hydroxylamine | 8.5 g | 14.5 g |
| 4-Amino-3-methyl-N-ethyl-N-(β-methanesulfonamidoethyl) aniline 3/2-sulfate monohydrate | 10.0 g | 22.0 g |
| Potassium carbonate | 26.3 g | 26.3 g |
| Water to make in total | 1,000 ml | 1,000 ml |
| pH (at 25° C., adjusted by sulfuric acid and KOH) | 10.35 | 12.6 |
| Bleach-Fixing Solution | | |
| Water | 800 ml | 800 ml |
| Ammonium thiosulfate (750 g/ml) | 107 ml | 214 ml |
| Succinic acid | 29.5 g | 59.0 g |
| Ammonium ethylenediamine-tetraacetato ferrate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make in total | 1,000 ml | 1,000 ml |
| pH (at 25° C., adjusted by nitric acid and aqueous ammonia) | 6.00 | 6.00 |
| Rinsing Solution | | |
| Chlorinated sodium isocyanurate | 0.02 g | 0.02 g |

-continued

| | Tank Solution | Replenisher |
|---|---|---|
| Deionized water (electrical conductivity: 5 μS/cm or less) | 1,000 ml | 1,000 ml |
| pH (25° C.) | 6.5 | 6.5 |

35 ml of an aqueous solution containing 1.82 g of KBr and 1.0 g of a low molecular weight gelatin having a molecular weight of 15,000 were added by a double jet method over 30 seconds to perform nucleation. Immediately after the completion of addition, 5.4 g of KBr was added and the temperature was elevated to 75° C. to perform ripening. After the completion of ripening, 35 g of gelatin obtained by chemically modifying an alkali-treated gelatin having a mass average molecular weight of 100,000 with succinic acid anhydride was added and then the pH was adjusted to

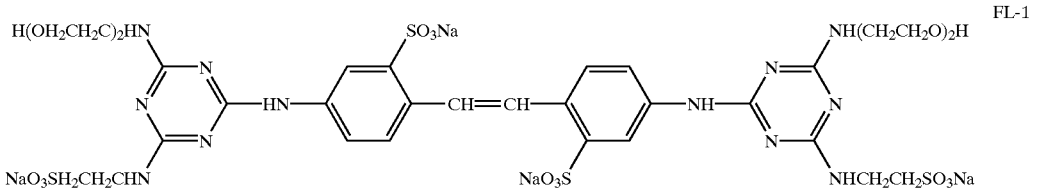

Example 4

Using the samples prepared in Example 3, image formation was performed by laser scanning exposure.

The laser light sources used were a YAG solid laser (oscillation wavelength: 946 nm) with an excitation light source of semiconductor GaALAs (oscillation wavelength: 808.5 nm), which was taken out as 473 nm by the wavelength conversion through an SHG crystal of $LiNbO_3$ having an inversion domain structure, a $YVO_4$ solid laser (oscillation wavelength: 1,064 nm) with an excitation light source of semiconductor laser GaAlAs (oscillation wavelength: 808.7 nm), which was taken out as 532 nm by the wavelength conversion through an SHG crystal of $LiNbO_3$ having an inversion domain structure, and AlGaInP (oscillation wavelength: about 680 nm, Type No. LN9R20 manufactured by Matsushita Electric Industrial Co., Ltd.). Respective laser rays of three colors were moved using a polygon mirror in the perpendicular direction to the scanning direction so that the sample could be sequentially scan-exposed. The fluctuation in the intensity of light due to temperature of semiconductor lasers was suppressed by keeping constant the temperature using a Peltier element. The effective beam diameter was 80 μm, the scanning pitch was 42.3 μm (600 dpi), and the average exposure time per one picture element was $1.7\times10^{-7}$ seconds.

After the exposure, the samples were processed by Color Development Processing B. As a result, the same results as in the high-intensity exposure of Examples 2 and 3 were obtained and it is verified that the present invention is suitable also for the image formation using laser scanning exposure.

Example 5

Silver halide emulsions and silver halide color photographic light-sensitive materials were produced by the following production methods.

Preparation of Em-K:

Preparation of Seed Emulsion 1,200 ml of an aqueous solution containing 1.0 g of an oxidation-treated low molecular weight gelatin having a mass average molecular weight of 15,000 and 0.9 g of KBr was vigorously stirred while keeping at 35° C. Thereto, 40 ml of an aqueous solution containing 1.85 g of $AgNO_3$ and 5.5. Thereto, 250 ml of an aqueous solution containing 36 g of $AgNO_3$ and 282 ml of an aqueous solution containing 21.2 g of KBr and 2.81 g of KI were added by a double jet method over 25 minutes while keeping the silver potential at −5 mV. Thereafter, 650 ml of an aqueous solution containing 200 g of $AgNO_3$ and 900 ml of an aqueous solution containing 134.1 g of KBr and 13.9 g of KI were added by a double jet method over 100 minutes while accelerating the flow rate such that the final flow rate became 1.4 times the initial flow rate. At this time, the silver potential was kept at +5 mV to the saturated calomel electrode. The emulsion obtained was washed with water and then gelatin was added to adjust such that the pH was 5.7, the pAg was 8.8, the mass as silver per kg of emulsion was 139.0 g and the mass of gelatin was 56 g. This emulsion was used as the seed emulsion.

Separately, 1,200 ml of an aqueous solution containing 33 g of lime-treated gelatin having a calcium concentration of 1 ppm and 3.4 g of KBr was vigorously stirred while keeping at 75° C. Thereto, 89 g of the seed emulsion prepared above was added and then 0.3 g of modified silicone oil (L7602, a product of Nippon Unicar) was added. After adjusting the pH to 5.8 by adding $H_2SO_4$, 2 mg of sodium benzenethiosulfonate and 2 mg of thiourea dioxide were added and then, 600 ml of an aqueous solution containing 51.0 g of $AgNO_3$ and 600 ml of an aqueous solution containing 36.2 g of KBr and 3.49 g of KI were added by a double jet method over 85 minutes while accelerating the flow rate such that the final flow rate became 1.1 times the initial flow rate. At this time, the silver potential was kept at −35 mV to the saturated calomel electrode. Furthermore, 300 ml of an aqueous solution containing 44.7 g of $AgNO_3$ and 300 ml of an aqueous solution containing 30.6 g of KBr and 3.06 g of KI were added by a double jet method over 56 minutes while accelerating the flow rate such that the final flow rate became 1.1 times the initial flow rate. At this time, the silver potential was kept at −35 mV to the saturated calomel electrode.

Then, 180 ml of an aqueous solution containing 36.9 g of $AgNO_3$ and an aqueous KBr solution were added by a double jet method over 40 minutes. At this time, the silver potential was kept at +10 mV to the saturated calomel electrode. After adjusting the silver potential to -70 mV by adding KBr, an AgI fine grain emulsion having a grain size of 0.037 μm was added in an amount of 1.38 g in terms of the mass of KI. Immediately after the completion of addition, 100 ml of an aqueous solution containing 17.4 g of $AgNO_3$ was added over 15 minutes. The obtained emulsion was washed with water washing and then gelatin was added to adjust the pH to 5.8 and the pAg to 8.7. After elevating the temperature to 60° C., Compound 2 and Sensitizing Dyes ExS-10 and ExS-13 were added. Thereafter, samples different in the compound added were prepared and compared.

The emulsion of which chemical sensitization was optimally performed by adding potassium thiocyanate, chloroauric acid, sodium thiosulfate, pentafluorophenyldiphenylphosphine selenide, Compound (F-11) and Compound 3 was designated as Sample 1.

The emulsion of which chemical sensitization was optimally performed by adding potassium thiocyanate, Compound 1-48, sodium thiosulfate, Compound (F-11) and Compound 3 was designated as Sample 2.

The emulsion of which chemical sensitization was optimally performed by adding potassium thiocyanate, Compound 1-49, sodium thiosulfate, Compound (F-11) and Compound 3 was designated as Sample 3.

The emulsion of which chemical sensitization was optimally performed by adding potassium thiocyanate, Compound 1-51, sodium thiosulfate, Compound (F-11) and Compound 3 was designated as Sample 4.

The emulsion of which chemical sensitization was optimally performed by adding potassium thiocyanate, Compound 2-23, sodium thiosulfate, Compound (F-11) and Compound 3 was designated as Sample 5.

The emulsion of which chemical sensitization was optimally performed by adding potassium thiocyanate, Compound 3-31, sodium thiosulfate, Compound (F-11) and Compound 3 was designated as Sample 6.

The emulsion of which chemical sensitization was optimally performed by adding potassium thiocyanate, Compound 3-50, sodium thiosulfate, Compound (F-11) and Compound 3 was designated as Sample 7.

The emulsion of which chemical sensitization was optimally performed by adding potassium thiocyanate, Compound 4-30, sodium thiosulfate, Compound (F-11) and Compound 3 was designated as Sample 8.

The emulsion of which chemical sensitization was optimally performed by adding potassium thiocyanate, Compound 4-49, sodium thiosulfate, Compound (F-11) and Compound 3 was designated as Sample 9.

The emulsion of which chemical sensitization was optimally performed by adding potassium thiocyanate, Compound HK-1, sodium thiosulfate, Compound (F-11) and Compound 3 was designated as Sample 10.

The emulsion of which chemical sensitization was optimally performed by adding potassium thiocyanate, Compound HK-2, sodium thiosulfate, Compound (F-11) and Compound 3 was designated as Sample 11.

The emulsion of which chemical sensitization was optimally performed by adding potassium thiocyanate, Compound HK-3, sodium thiosulfate, Compound (F-11) and Compound 3 was designated as Sample 12.

The emulsion of which chemical sensitization was optimally performed by adding potassium thiocyanate, Compound HK-4, sodium thiosulfate, Compound (F-11) and Compound 3 was designated as Sample 13.

The emulsion of which chemical sensitization was optimally performed by adding potassium thiocyanate, Compound HK-5, sodium thiosulfate, Compound (F-11) and Compound 3 was designated as Sample 14.

To all samples, Compound (F-3) shown below was added at the completion of chemical sensitization.

The emulsion was a tabular grain emulsion having an average equivalent-sphere diameter of 1.65 $\mu$m, an average equivalent-circle diameter of 3.10 $\mu$m, a coefficient of variation in the equivalent-circle diameter, of 20%, and an aspect ratio of 10.0. The ratio of grains having an aspect ratio of 5 or more occupying in the projected area of all grains was 90%. The twin plane distance measured as above was 0.015 $\mu$m.

The grains obtained were observed by a transmission-type electron microscope while cooling with liquid nitrogen, as a result, grains not having a dislocation line within 80% of the projected area from the center part of grain occupied about 98% of all grains. In the grain peripheral part corresponding to 20% of the projected area from the outer circumference of grain, 10 or more dislocation lines on average were observed per one grain.

Emulsions Em-A/E 1,300 ml of an aqueous solution containing 1.6 g of an oxidation-treated low molecular weight gelatin having a mass average molecular weight of 15,000 and 1.0 g of KBr was kept at 58° C., adjusted to a pH of 9 and vigorously stirred.

Thereto, an aqueous solution containing 1.3 g of $AgNO_3$ and an aqueous solution containing 1.1 g of KBr and 0.7 g of an oxidation-treated low molecular weight gelatin having a mass average molecular weight of 15,000 were added by a double jet method over 30 seconds to perform nucleation. Then, 6.6 g of KBr was added and the temperature was elevated to 78° C. to perform ripening. After the completion of ripening, 15.0 g of gelatin obtained by chemically modifying an alkali-treated gelatin having a mass average molecular weight of 100,000 with succinic acid anhydride was added and then the pH was adjusted to 5.5. Thereto, 230 ml of an aqueous solution containing 29.3 g of $AgNO_3$ and an aqueous solution containing 15.8 g of KBr and 1.92 g of KI were added by a double jet method over 30 minutes. At this time, the silver potential was kept at −20 mV to the saturated calomel electrode. Furthermore, an aqueous solution containing 64.5 g of $AgNO_3$ and 233 ml of an aqueous solution containing 42.3 g of KBr and 5.14 g of KI were added by a double jet method over 37 minutes while accelerating the flow rate such that the final flow rate became 1.33 times the initial flow rate. During the addition, the silver potential was kept at −20 mV. Thereafter, an aqueous solution containing 70.8 g of $AgNO_3$ and an aqueous KBr solution were added by a double jet method over 35 minutes while keeping the silver potential at −10 mV.

After elevating the temperature to 40° C., 4.9 g of Compound 1 was added and then, 32 ml of an aqueous solution of 0.8 M sodium sulfite was added. Thereafter, the pH was adjusted to 9.0 by using an aqueous NaOH solution and the resulting solution was kept for 5 minutes. The temperature was elevated to 55° C. and then the pH was adjusted to 5.5 by $H_2SO_4$. Thereto, 1 mg of sodium benzenethiosulfonate was added and then 13 g of a lime-treated gelatin having a calcium concentration of 1 ppm was added. After the completion of addition, 250 ml of an aqueous solution containing 71.0 g of $AgNO_3$ and an aqueous KBr solution were added over 20 minutes while keeping the silver potential at +75 mV. At this time, yellow prussiate of potash was added in an amount of $1.0\times10^{-5}$ mol per mol of silver and $K_2KrCl_6$ was added in an amount of $\times10^{-8}$ mol per mol of silver. The emulsion obtained was washed with water and then gelatin was added to adjust the pH and the pAg at 40° C. to 6.5 and 8.8, respectively.

This emulsion was a tabular grain emulsion having an average equivalent-sphere diameter of 1.33 μm, an average equivalent-circle diameter of 2.63 μm and an aspect ratio of 11.4. The ratio of grains having an aspect ratio of 5 or more occupying in the projected area of all grains was 95% and the twin plane distance was 0.012 μm.

The grains obtained were observed by a transmission-type electron microscope while cooling with liquid nitrogen, as a result, grains not having a dislocation line within 80% of the projected area from the center part of grain occupied about 90% of all grains. In the grain peripheral part corresponding to 20% of the projected area from the outer circumference of grain, 10 or more dislocation lines on average were observed per one grain.

Preparation of Emulsions Em-A

After elevating the temperature to 56° C., Compound 2 and Sensitizing Dyes ExS-1, ExS-2 and ExS-3 were added and then, chemical sensitization of the emulsion was optimally performed by adding potassium thiocyanate, chloroauric acid, sodium thiosulfate, hexafluorophenyldiphenylphosphine selenide, Compound (F-11) and Compound 3. At the completion of chemical sensitization, Compound (F-2) shown below was added.

Preparation of Emulsions Em-E

Emulsion Em-E was prepared by performing the chemical sensitization in the same manner as in the preparation of Emulsion A except for changing the sensitizing dyes to ExS-7, ExS-8 and ExS-9.

Production Process of Emulsions Em-N 1,250 ml of an aqueous solution containing 48 g of deionized gelatin and 0.75 g of KBr was vigorously stirred while keeping at 70° C.

To this solution, 276 ml of an aqueous solution containing 12.0 g of $AgNO_3$ and an aqueous KBr solution having an equimolar concentration were added by a double jet method over 7 minutes while keeping the pAg at 7.26. Thereafter, 600 ml of an aqueous solution containing 108.0 g of $AgNO_3$ and a KBr and KI mixed aqueous solution (2.0 mol % of KI) having an equimolar concentration were added by a double jet method over 18 minutes and 30 seconds while keeping the pAg at 7.30. 5 Minutes before the completion of addition, 18.0 ml of an aqueous 0.1 mass % thiosulfonic acid solution was added. After re-dispersion by performing desalting and water washing according to a normal flocculation method, the pH and the pAg were adjusted to 6.2 and 7.6, respectively, at 40° C. The temperature was controlled to 40° C. and then Compound 2 and Sensitizing dyes ExS-10 and ExS-12 were added. Thereafter, potassium thiocyanate, chloroauric acid, Compound (F-11 and Compound 3 were added and then the temperature was elevated to 68° C. to optimally perform the chemical sensitization. At the completion of chemical sensitization, Compound (F-2) was added.

This emulsion was a cubic grain emulsion having an equivalent-sphere diameter of 0.19 μm and a coefficient of variation in the equivalent-sphere diameter, of 14%.

Emulsions Em-B to Em-D, Em-F to Em-J and Em-L to Em-R were prepared by appropriately changing the temperature, pH, silver potential, amount of silver nitrate, amount of KI, amount of compound, kind of sensitizing dye and amount of seed emulsion in the preparation above of Emulsions Em-A, Em-E and Em-K.

The thus-prepared emulsions are shown in Table 2.

TABLE 2

| | Equivalent-Circle Diameter (μm ) | Aspect Ratio | Equivalent-Sphere Diameter (μm) | Shape of Grain | Dislocation Line (lines/grain) | Twin Plane Distance (μm) |
|---|---|---|---|---|---|---|
| Em-A | 2.63 | 11.4 | 1.33 | tabular | 10 or more | 0.012 |
| Em-B | 1.50 | 6.0 | 0.80 | " | 10 or more | 0.012 |
| Em-C | 0.85 | 7.1 | 0.51 | " | 10 or more | 0.012 |
| Em-D | 0.40 | 2.7 | 0.35 | " | 10 or more | 0.011 |
| Em-E | 2.63 | 11.4 | 1.33 | " | 10 or more | 0.012 |
| Em-F | 2.00 | 3.0 | 0.92 | " | 10 or more | 0.013 |
| Em-G | 1.60 | 7.0 | 0.79 | " | 10 or more | 0.012 |
| Em-H | 0.85 | 7.1 | 0.51 | " | 10 or more | 0.012 |
| Em-I | 0.58 | 3.2 | 0.45 | " | 10 or more | 0.010 |
| Em-J | 2.00 | 7.0 | 0.92 | " | 10 or more | 0.012 |
| Em-K | 3.10 | 10.0 | 1.65 | " | 10 or more | 0.015 |
| Em-L | 1.25 | 4.3 | 0.89 | " | 10 or more | 0.011 |
| Em-M | 0.55 | 4.6 | 0.37 | " | 10 or more | 0.010 |
| Em-N | — | — | 0.19 | cubic | — | — |
| Em-O | 1.76 | 9.5 | 0.95 | tabular | 10 or more | 0.012 |
| Em-P | 2.20 | 6.9 | 1.33 | " | 10 or more | 0.013 |
| Em-Q | 1.50 | 6.0 | 0.80 | " | 10 or more | 0.012 |
| Em-R | 0.85 | 7.1 | 0.51 | " | 10 or more | 0.012 |

Layers each having the following composition were coated one on another on an undercoated cellulose triacetate film support to manufacture multilayer color light-sensitive material Samples 1 to 14.

Composition of Light-Sensitive Layer

Main materials used for each layer are classified as follows.

ExC: cyan coupler

UV: Ultraviolet absorbent

ExM: magenta coupler

ExY: yellow coupler

ExS: Sensitizing dye

HBS: high boiling point organic solvent

H: gelatin hardener (In the following, specific compounds each is shown by affixing a number after the symbol and chemical formulae thereof are shown later.)

The numerals corresponding to respective components show coated amounts expressed by the unit of $g/m^2$. In the case of silver halide, a coated amount calculated in terms of silver is shown. Furthermore, the coated amount of sensitizing dye is shown by mol per mol of silver halide in the same layer.

First Layer (First Antihalation Layer)

| | |
|---|---|
| First Layer (first antihalation layer) | |
| Black Colloidal Silver | as silver 0.070 |
| Gelatin | 0.660 |
| ExM-1 | 0.048 |
| Cpd-2 | 0.001 |
| F-8 | 0.001 |
| HBS-1 | 0.090 |
| HBS-2 | 0.010 |
| Second Layer (second antihalation layer) | |
| Black Colloidal Silver | as silver 0.090 |
| Gelatin | 0.830 |
| ExM-1 | 0.057 |
| ExF-1 | 0.002 |
| F-8 | 0.001 |
| HBS-1 | 0.090 |
| HBS-2 | 0.010 |
| Third Layer (interlayer) | |
| ExC-2 | 0.010 |
| Cpd-1 | 0.086 |
| UV-2 | 0.029 |
| UV-3 | 0.052 |
| UV-4 | 0.011 |
| HBS-1 | 0.100 |
| Gelatin | 0.580 |
| Fourth Layer (low-speed red-sensitive emulsion layer) | |
| Em-D | as silver 0.47 |
| Em-C | as silver 0.57 |
| ExC-1 | 0.311 |
| ExC-2 | 0.010 |
| ExC-3 | 0.072 |
| ExC-4 | 0.101 |
| ExC-5 | 0.005 |
| ExC-6 | 0.008 |
| ExC-8 | 0.071 |
| ExC-9 | 0.010 |
| ExS-1 | $1.4 \times 10^{-3}$ |
| ExS-2 | $6.0 \times 10^{-4}$ |
| ExS-3 | $2.0 \times 10^{-5}$ |
| UV-2 | 0.036 |
| UV-3 | 0.067 |
| UV-4 | 0.014 |
| Cpd-2 | 0.010 |
| Cpd-4 | 0.012 |
| HBS-1 | 0.240 |
| HBS-5 | 0.010 |
| Gelatin | 1.630 |
| Fifth Layer (medium-speed red-sensitive emulsion layer) | |
| Em-B | as silver 0.63 |
| ExC-1 | 0.111 |
| ExC-2 | 0.039 |
| ExC-3 | 0.018 |
| ExC-4 | 0.074 |
| ExC-5 | 0.019 |
| ExC-6 | 0.024 |
| ExC-8 | 0.010 |
| ExC-9 | 0.005 |
| ExS-1 | $6.3 \times 10^{-4}$ |
| ExS-2 | $2.6 \times 10^{-4}$ |
| ExS-3 | $8.7 \times 10^{-6}$ |
| Cpd-2 | 0.020 |
| Cpd-4 | 0.021 |
| HBS-1 | 0.129 |
| Gelatin | 0.900 |
| Sixth Layer (high-speed red-sensitive emulsion layer) | |
| Em-A | as silver 1.27 |
| ExC-1 | 0.122 |
| ExC-6 | 0.032 |
| ExC-8 | 0.110 |
| ExC-9 | 0.005 |
| ExC-10 | 0.159 |
| ExS-1 | $3.2 \times 10^{-4}$ |

-continued

| | |
|---|---|
| ExS-2 | $2.6 \times 10^{-4}$ |
| ExS-3 | $8.8 \times 10^{-6}$ |
| Cpd-2 | 0.068 |
| Cpd-4 | 0.015 |
| HBS-1 | 0.440 |
| Gelatin | 1.610 |
| Seventh Layer (interlayer) | |
| Cpd-1 | 0.081 |
| Cpd-6 | 0.002 |
| Solid Disperse Dye ExF-4 | 0.015 |
| HBS-1 | 0.049 |
| Polyethyl acrylate latex | 0.88 |
| Gelatin | 0.759 |
| Eighth Layer (layer of giving interlayer effect to red-sensitive layer): | |
| Em-J | as silver 0.40 |
| Cpd-4 | 0.010 |
| ExM-2 | 0.082 |
| ExM-3 | 0.006 |
| ExM-4 | 0.026 |
| ExY-1 | 0.010 |
| ExY-4 | 0.040 |
| ExC-7 | 0.007 |
| ExS-4 | $7.0 \times 10^{-4}$ |
| ExS-5 | $2.5 \times 10^{-4}$ |
| HBS-1 | 0.203 |
| HBS-3 | 0.003 |
| HBS-5 | 0.010 |
| Gelatin | 0.570 |
| Ninth Layer (low-speed green-sensitive emulsion layer): | |
| Em-H | as silver 0.23 |
| Em-G | as silver 0.15 |
| Em-I | as silver 0.26 |
| ExM-2 | 0.388 |
| ExM-3 | 0.040 |
| ExY-1 | 0.003 |
| ExY-3 | 0.002 |
| ExC-7 | 0.009 |
| ExS-5 | $3.0 \times 10^{-4}$ |
| ExS-6 | $8.4 \times 10^{-5}$ |
| ExS-7 | $1.1 \times 10^{-4}$ |
| ExS-8 | $4.5 \times 10^{-4}$ |
| ExS-9 | $1.3 \times 10^{-4}$ |
| HBS-1 | 0.337 |
| HBS-3 | 0.018 |
| HBS-4 | 0.260 |
| HBS-5 | 0.110 |
| Cpd-5 | 0.010 |
| Gelatin | 1.470 |
| Tenth Layer (medium-speed green-sensitive emulsion layer): | |
| Em-F | as silver 0.42 |
| ExM-2 | 0.084 |
| ExM-3 | 0.012 |
| ExM-4 | 0.005 |
| ExY-3 | 0.002 |
| ExC-6 | 0.003 |
| ExC-7 | 0.007 |
| ExC-8 | 0.008 |
| ExS-7 | $1.0 \times 10^{-4}$ |
| ExS-8 | $7.1 \times 10^{-4}$ |
| ExS-9 | $2.0 \times 10^{-4}$ |
| HBS-1 | 0.096 |
| HBS-3 | 0.002 |
| HBS-5 | 0.002 |
| Cpd-5 | 0.004 |
| Gelatin | 0.382 |
| Eleventh Layer (high-speed green-sensitive emulsion layer): | |
| Em-E | as silver 0.95 |
| ExC-6 | 0.002 |
| ExC-8 | 0.010 |
| ExM-1 | 0.014 |
| ExM-2 | 0.023 |

-continued

| | |
|---|---|
| ExM-3 | 0.023 |
| ExM-4 | 0.005 |
| ExM-5 | 0.040 |
| ExY-3 | 0.003 |
| ExS-7 | $8.4 \times 10^{-4}$ |
| ExS-8 | $5.9 \times 10^{-4}$ |
| ExS-9 | $1.7 \times 10^{-4}$ |
| Cpd-3 | 0.004 |
| Cpd-4 | 0.007 |
| Cpd-5 | 0.010 |
| HBS-1 | 0.259 |
| HBS-5 | 0.020 |
| Polyethyl acrylate latex | 0.099 |
| Gelatin | 0.781 |
| Twelfth Layer (yellow filter layer) | |
| Cpd-1 | 0.088 |
| Solid Disperse Dye ExF-2 | 0.051 |
| Solid Disperse Dye ExF-8 | 0.010 |
| HBS-1 | 0.049 |
| Gelatin | 0.593 |
| Thirteenth Layer (low-speed blue-sensitive emulsion layer): | |
| Em-N | as silver 0.12 |
| Em-M | as silver 0.09 |
| Em-L | as silver 0.50 |
| ExC-1 | 0.024 |
| ExC-7 | 0.011 |
| ExY-1 | 0.002 |
| ExY-2 | 0.956 |
| ExY-4 | 0.091 |
| ExS-10 | $8.5 \times 10^{-5}$ |
| ExS-11 | $6.4 \times 10^{-4}$ |
| ExS-12 | $8.5 \times 10^{-5}$ |
| ExS-13 | $5.0 \times 10^{-4}$ |
| Cpd-2 | 0.037 |
| Cpd-3 | 0.004 |
| HBS-1 | 0.372 |
| HBS-5 | 0.047 |
| Gelatin | 2.201 |
| Fourteenth Layer (high-speed blue-sensitive emulsion layer): | |
| Em-K | as silver 1.22 |
| ExY-2 | 0.235 |
| ExY-4 | 0.018 |
| ExS-10 | $1.5 \times 10^{-4}$ |
| ExS-13 | $2.0 \times 10^{-4}$ |
| Cpd-2 | 0.075 |
| Cpd-3 | 0.001 |
| HBS-1 | 0.087 |
| Gelatin | 1.156 |
| Fifteenth Layer (first protective layer) | |
| Silver iodobromide emulsion of 0.07 μm | as silver 0.28 |
| UV-1 | 0.358 |
| UV-2 | 0.179 |
| UV-3 | 0.254 |

-continued

| | |
|---|---|
| UV-4 | 0.025 |
| F-11 | 0.0081 |
| SA-1 | 0.078 |
| ExF-5 | 0.0024 |
| ExF-6 | 0.0012 |
| ExF-7 | 0.0010 |
| HBS-1 | 0.175 |
| HBS-4 | 0.050 |
| Gelatin | 2.231 |
| Sixteenth Layer (second protective layer) | |
| H-1 | 0.400 |
| B-1 (Diameter: 1.7 μm) | 0.050 |
| B-2 (Diameter: 1.7 μm) | 0.150 |
| B-3 | 0.050 |
| SA-1 | 0.200 |
| Gelatin | 0.711 |

Furthermore, in each layer, W-1 to W-6, B-4 to B-6, F-1 to F-17, lead salt, platinum salt, iridium salt and rhodium salt were appropriately added so as to improve storability, processability, pressure resistance, antifungal/bactericidal property, antistatic property and coatability.

Preparation of Dispersion of Organic Solid Disperse Dye

ExF-2 i n the twelfth layer was dispersed by the following method.

| | |
|---|---|
| Wet cake of ExF-2 (containing 17.6 mass % of water) | 2.800 kg |
| Sodium octylphenyldiethoxymethanesulfonate (31 mass % aqueous solution) | 0.376 kg |
| F-15 (7% aqueous solution) | 0.011 kg |
| Water | 4.020 kg |
| Total | 7.210 kg |

(pH adjusted to 7.2 by NaOH)

A slurry having the composition above was stirred and coarsely dispersed in a dissolver and thereafter, dispersed using an agitator mill KMK-4 at a peripheral speed of 10 m/s and a discharge of 0.6 kg/min with zirconia beads having a diameter of 0.3 mm filled to 80% until the absorbance ratio of the dispersion solution became 0.29, thereby obtaining a solid fine particle dispersion. The average particle size of dye fine particles was 0.29 μm.

Solid dispersions of ExF-4 and ExF-8 were obtained in the same manner, where the average particle size of the dye fine particles was 0.28 μm and 0.49 μm, respectively.

The compounds used for the preparation of emulsion the compound used for each layer in the manufacture of coated sample are shown below.

ExS-1

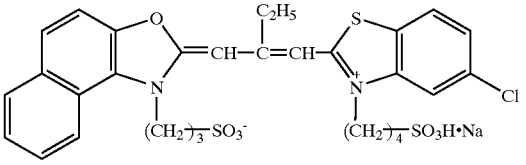

ExS-2

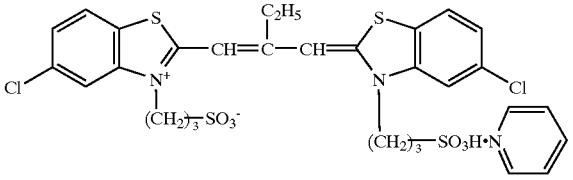

-continued
ExS-3
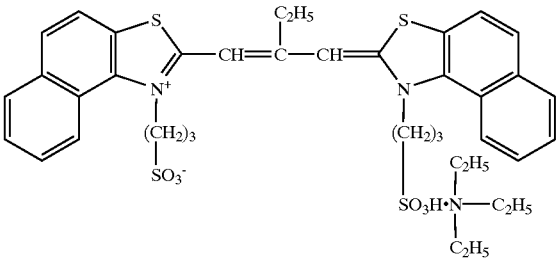
ExS-4
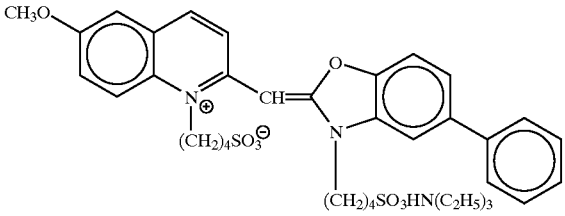
Compound 1
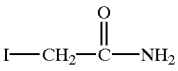
Compound 2
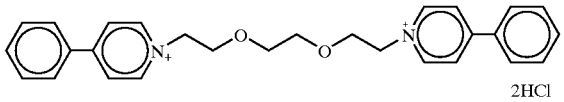
Compound 3
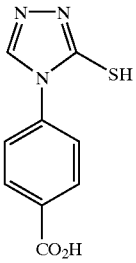
Compound 5
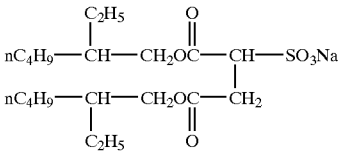
ExS-5
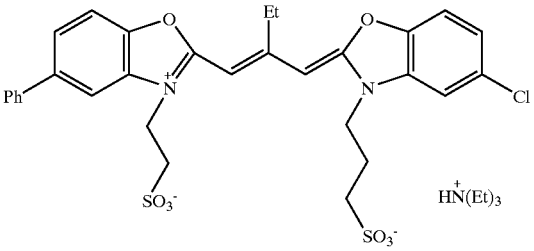
ExS-6
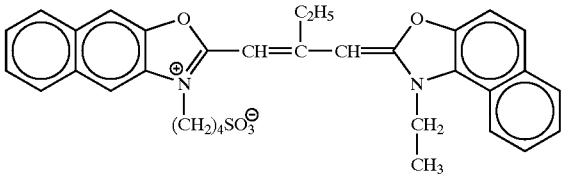
ExS-7
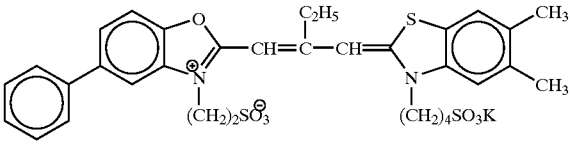
ExS-8
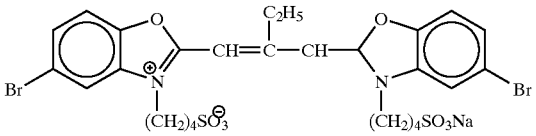
ExS-9
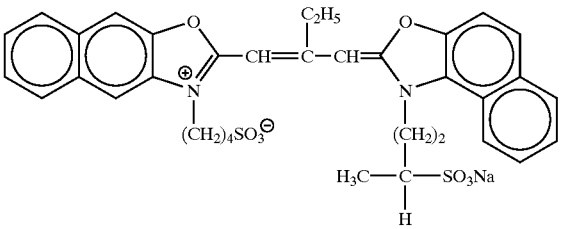
ExS-10
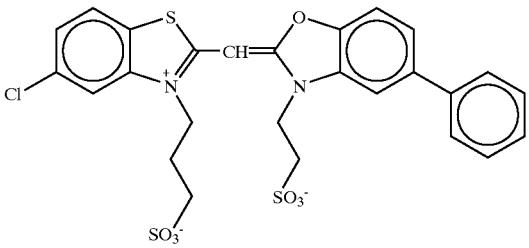
ExS-11
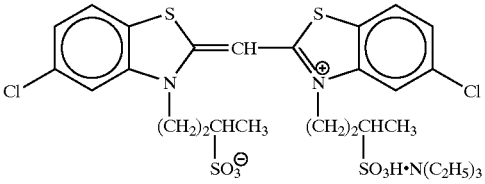
ExS-12
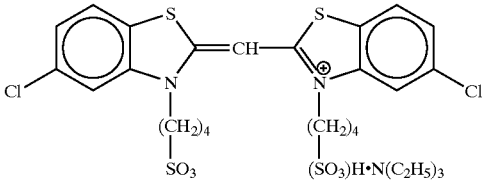

-continued
ExS-13
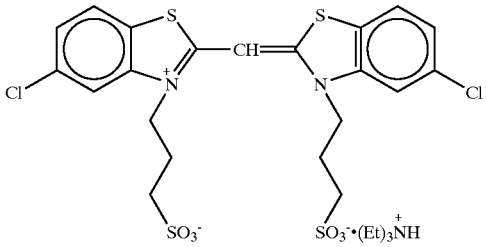
ExC-1
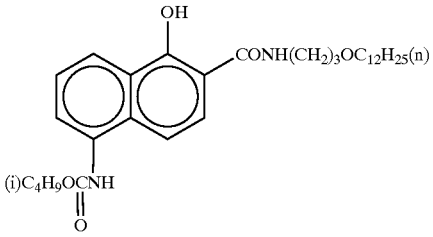
ExC-2
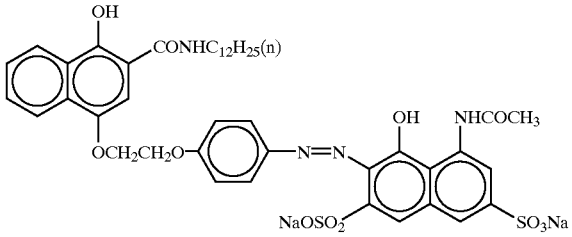
ExC-3
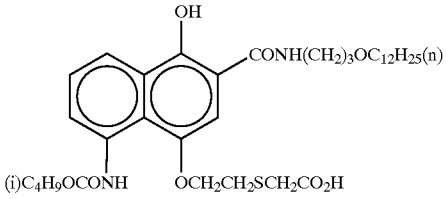
ExC-4
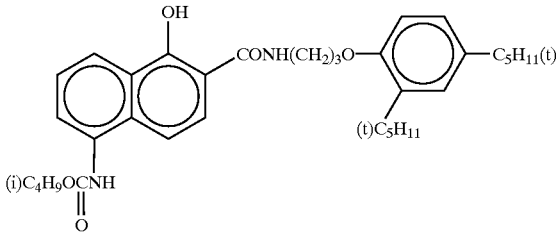
ExC-5
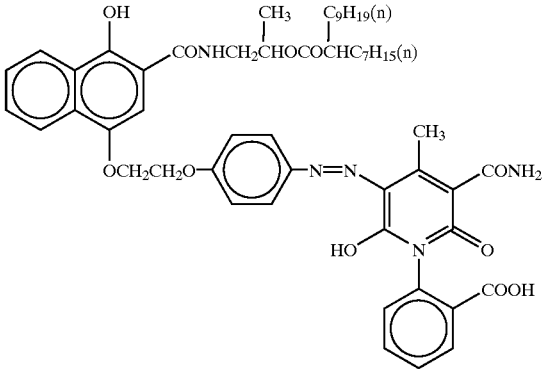
ExC-6
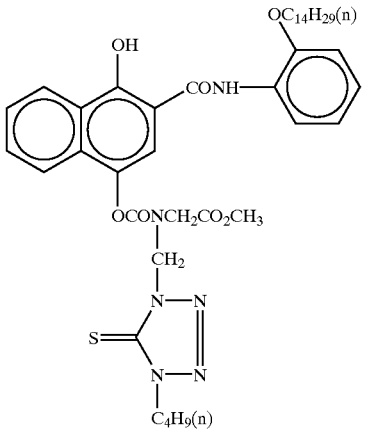

-continued
ExM-1
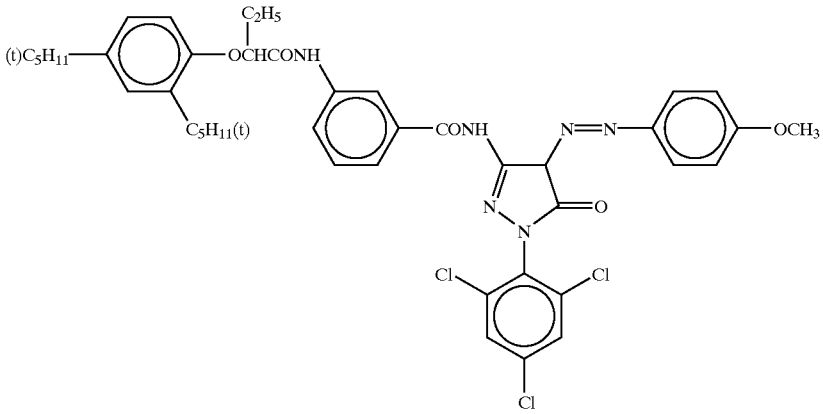
ExM-2
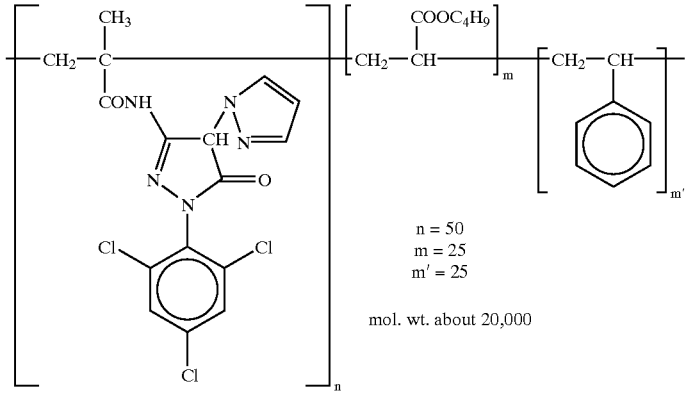
ExM-3
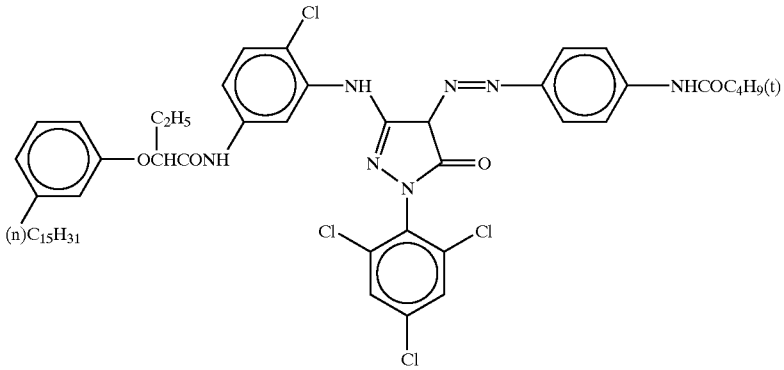

-continued
ExM-4
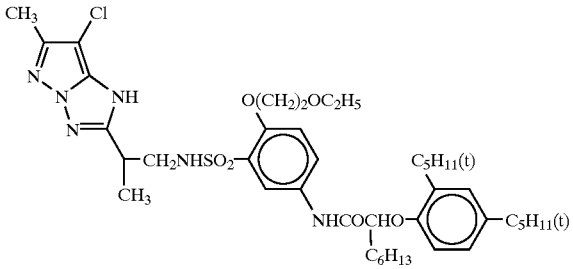
ExM-5
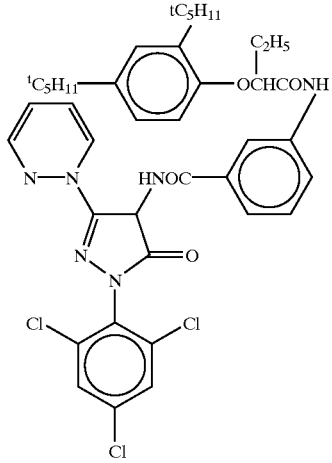
ExY-1
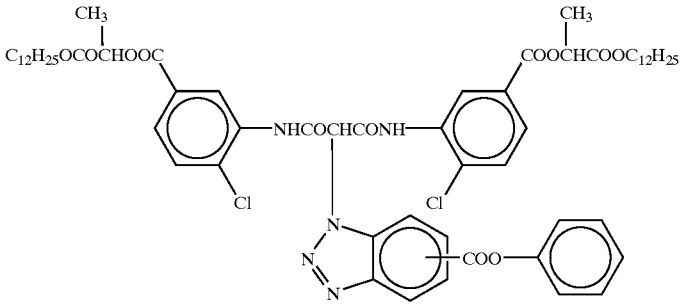
ExY-2
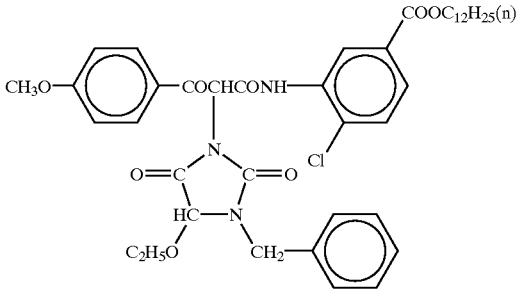
ExY-3
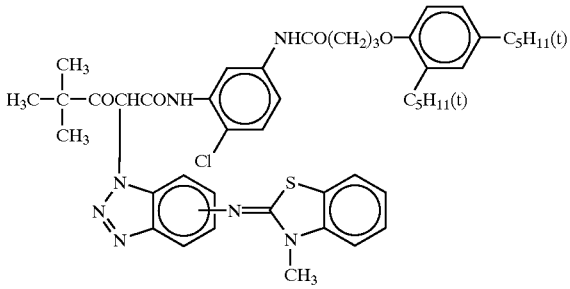
ExY-4
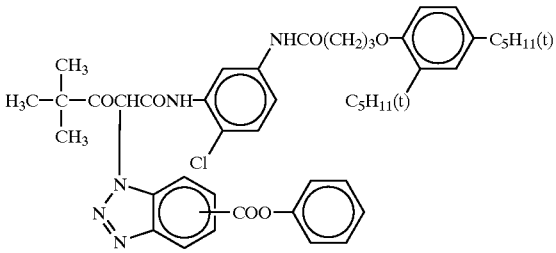
Cpd-1
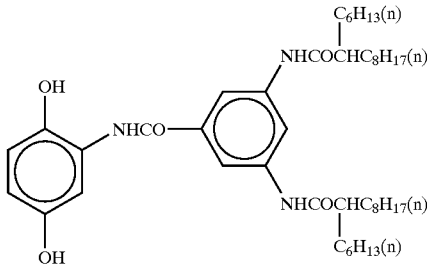
Cpd-2
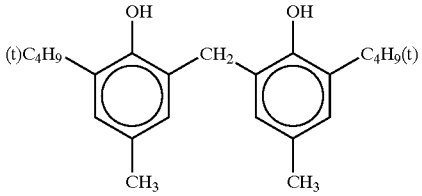
Cpd-3
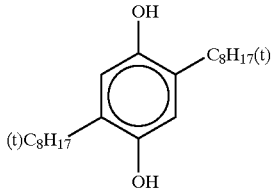

$nC_{14}H_{29}OCOCH_2CH_2CONOH$
|
$CH_3$
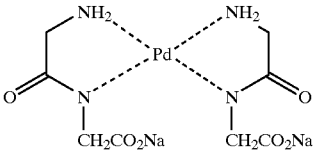
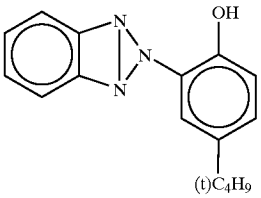
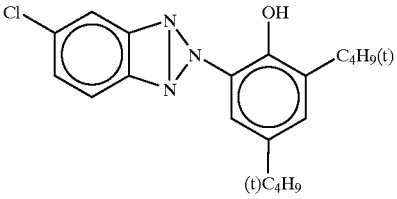
B-1
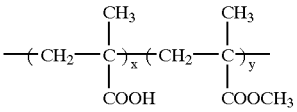
x/y=10/90 (by mass) average molecular weight: about 35,000
B-2
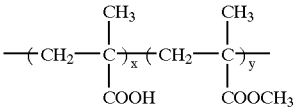
x/y=40/60 (by mass) average molecular weight: about 20,000
B-3
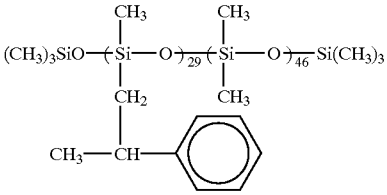
-continued
Cpd-4
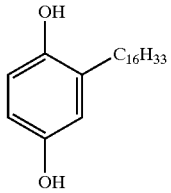
Cpd-5
Cpd-6
UV-1
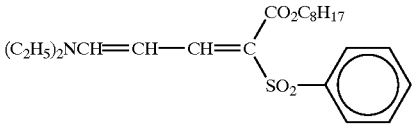
UV-2
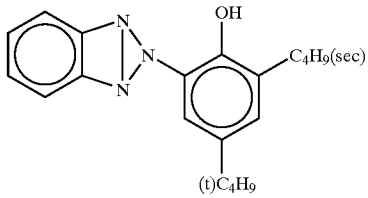
UV-3
UV-4
(by mol) average molecular weight: about 8,000
B-4
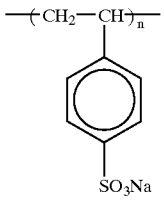
average molecular weight: about 750,000
B-5
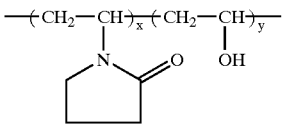
x/y=70/30 (by mass) average molecular weight: about 17,000
B-6
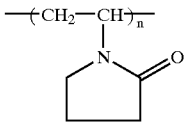

average molecular weight: about 10,000
H-1
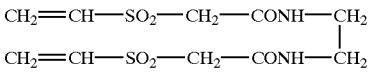
SA-1
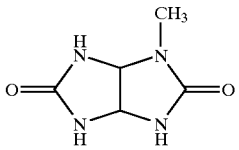
HBS-1 Tricresyl phosphate
HBS-2 Di-n-Butyl phthalate
HBS-3
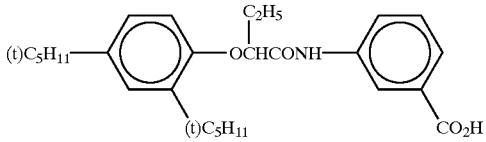
HBS-4 Tri(2-ethylhexyl)phosphate
HBS-5
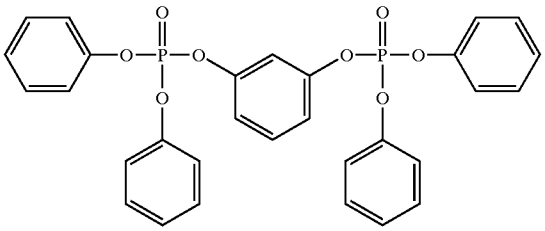
F-1
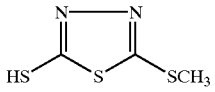
F-2
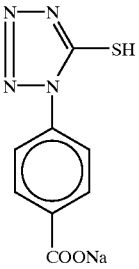
F-3
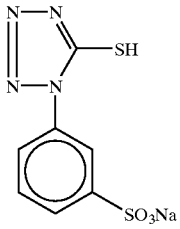
F-4
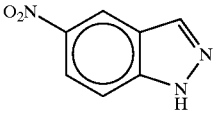
F-5
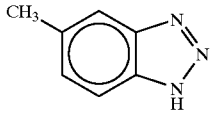
F-6
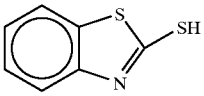
F-7
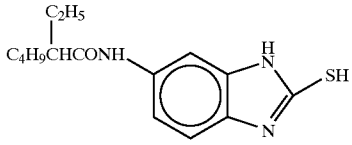
F-8
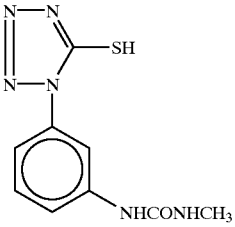
F-9
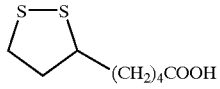
F-10
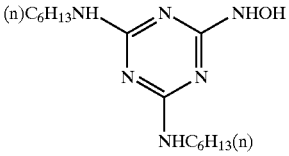
F-11
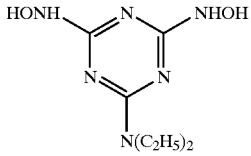

-continued
F-12
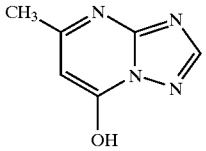
F-13
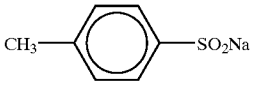
F-14
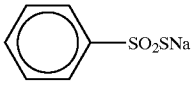
F-15
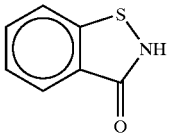
F-16
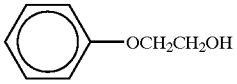
F-17
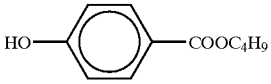
W-1
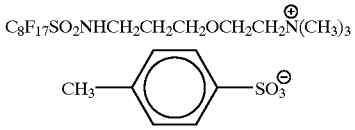
W-2
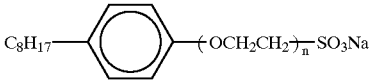
n = 2 ~ 4
W-3
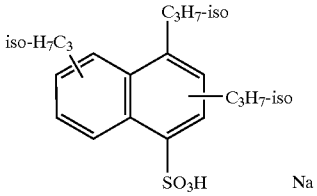
W-4
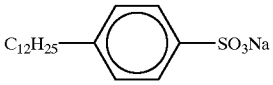
W-5
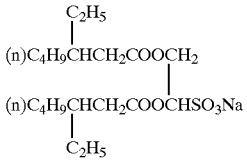
W-6
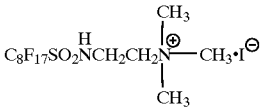
ExC-7
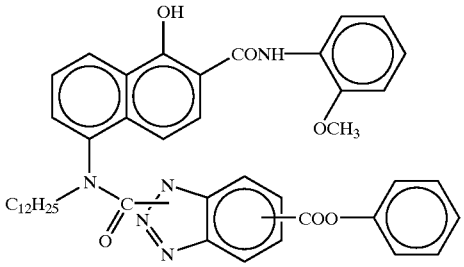
ExC-8
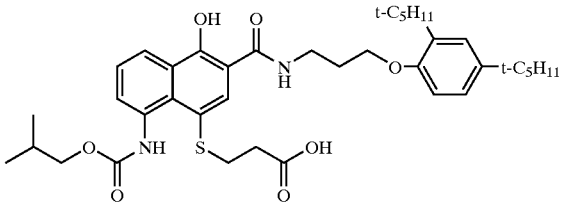
ExC-9
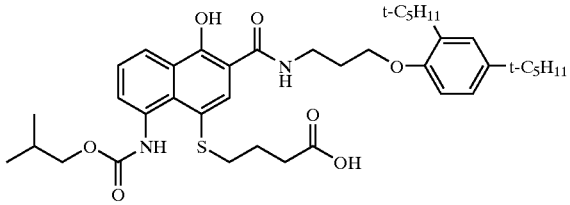
ExC-10
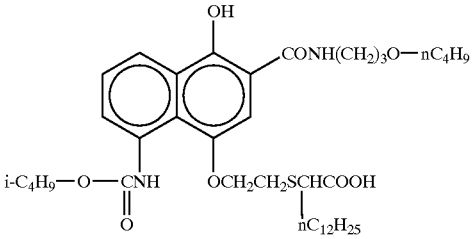

-continued
ExF-1
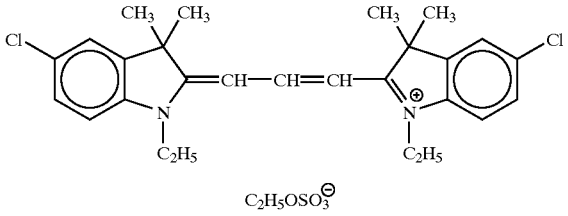
ExF-2
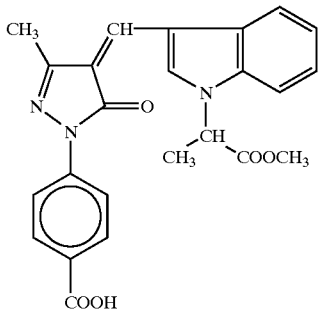
ExF-4
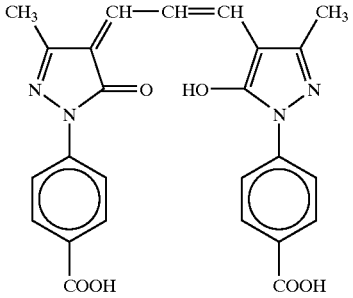
ExF-5
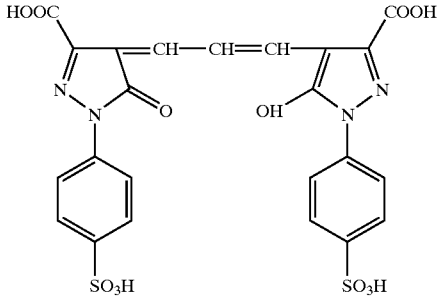
ExF-6
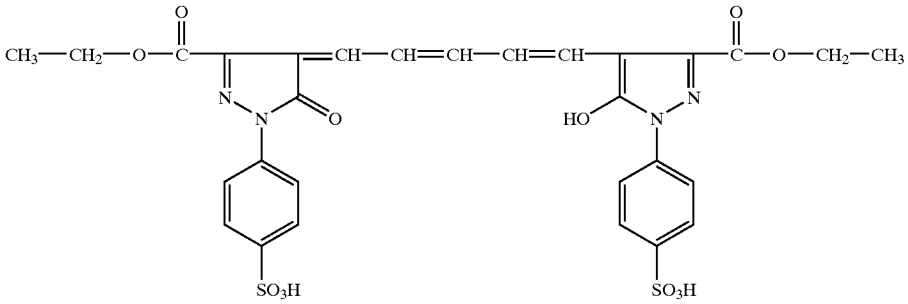
ExF-7
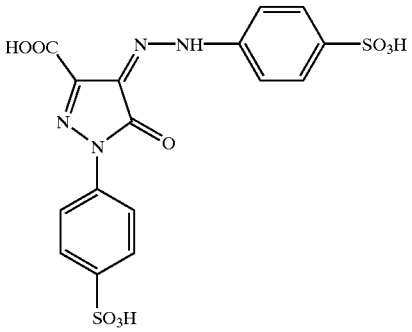
ExF-8
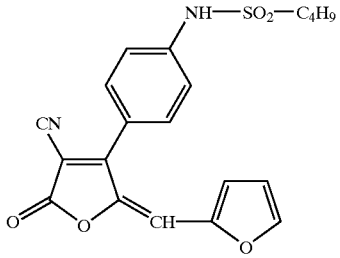

Comparative Compounds

HK-1

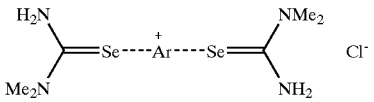

(Compound Described in JP-A-2001-75215)

HK-2

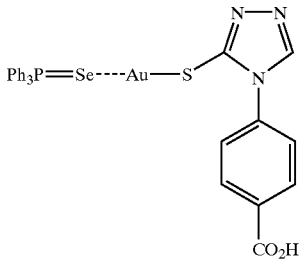

(Compound Described in JP-A-2001-75216)

HK-3

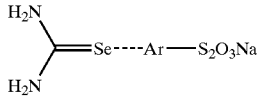

(Compound Described in JP-A-2001-75217)

HK-4

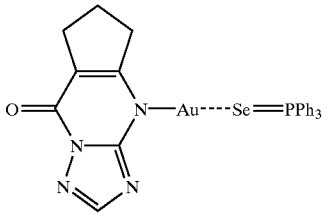

(Compound described in JP-A-2001-75218)

HK-5

$[Ph_3P{=}Se{-}AuCl]^{2+}$ (Compound Described in JP-A-9-269554)

Each sample was exposed for 1/100 second through Gelatin Filter SC-39 produced by Fuji Photo Film Co., Ltd. and a continuous wedge.

For examining the storage fogging in aging, samples left standing for 3 days in an atmosphere at a temperature of 50° C. and a humidity of 80% were also tested.

The development was performed as follows by using an automatic developing machine FP-360B manufactured by Fuji Photo Film Co., Ltd., which was modified not to flow the overflow solution of the bleaching bath to the post bath but to discharge all to the waste solution tank. In this FP-360B, evaporation correcting means described in *JIII Journal of Technical Disclosure*, No. 94-4992 was mounted.

The processing steps and the composition of each processing solution are shown below.

(Processing Step)

| Step | Processing Time | Processing Temperature (° C.) | Replenishing Amount* (ml) | Tank Volume (liter) |
|---|---|---|---|---|
| Color development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Water washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60.0 | | |

*Replenishing amount was per 1.1 m of the 35 mm-width light-sensitive material (corresponding to 1 roll of 24 Ex.).

The stabilizing solution and the fixing solution each was in a countercurrent system from (2) to (1) and the overflow solution of washing water was all introduced into the fixing bath (2). The amount of developer carried over into the bleaching step, the amount of bleaching solution carried over into the fixing step and the amount of fixing solution carried over into the water washing step were 2.5 ml, 2.0 ml and 2.0 ml, respectively, per 1.1 m of the 35 mm-width light-sensitive material. The cross-over time was 6 seconds in each interval and this time is included in the processing time of the previous step.

The open area of the above-described processing machine was 100 $cm^2$ for the color developer, 120 $cm^2$ for the bleaching solution and about 100 $cm^2$ for other processing solutions.

The composition of each processing solution is shown below.

| | Tank Solution (g) | Replenisher (g) |
|---|---|---|
| (Color Developer) | | |
| Diethylenetriaminepentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium N,N-bis(2-sulfonato-ethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxy-ethyl)amino]aniline sulfate | 4.5 | 6.5 |
| Water to make | 1.0 L | 1.0 L |
| pH (adjusted by potassium hydroxide and sulfuric acid) | 10.05 | 10.18 |
| (Bleaching Solution) | | |
| Ammonium 1,3-diaminopropane-tetraacetato ferrate monohydrate | 113 | 170 |
| Ammonium bromide | 70 | 105 |
| Ammonium nitrate | 14 | 21 |
| Succinic acid | 34 | 51 |

-continued

| | Tank Solution (g) | Replenisher (g) |
|---|---|---|
| Maleic acid | 28 | 42 |
| Water to make | 1.0 L | 1.0 L |
| pH [adjusted by aqueous ammonia] | 4.6 | 4.0 |

Fixing Solution (1): Tank Solution

A 5:95 (by volume) mixed solution of the bleaching tank solution above and the fixing tank solution shown below (pH: 6.8).

(Fixing Solution (2)

| | Tank Solution (g) | Replenisher (g) |
|---|---|---|
| Aqueous ammonium thiosulfate solution (750 g/L) | 240 ml | 720 ml |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 L | 1.0 L |
| pH [adjusted by aqueous ammonia and acetic acid] | 7.4 | 7.45 |

(Washing Water)

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/L or less and then thereto 20 mg/L of sodium isocyanurate dichloride and 150 mg/L of sodium sulfate were added. The resulting solution had a pH of 6.5 to 7.5.

Stabilizing Solution

The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Sodium 1,2-benzoisothiazolin-3-one | 0.10 |
| Disodium ethylenediaminetetra-acetate | 0.05 |
| 1,2,4-Triazole | 1.3 |
| 1,4-Bis(1,2,4-triazol-1-yl-methyl)piperazine | 0.75 |
| Water to make | 1.0 L |
| pH | 8.5 |

The samples after the development was measured on the density through a blue filter, thereby performing the test of photographic properties.

The relative sensitivity and fog after the coating of sample and the storage fogging after standing for 3 days in an atmosphere of 50° C. and 80% relative humidity are shown in Table 3.

TABLE 3

| Sample No. | Compound No. | Relative Sensitivity | Fog | Storage Fogging | Remarks |
|---|---|---|---|---|---|
| 1 | chloroauric acid | 100 | 0.025 | 0.35 | Comparison |
| 2 | 1-48 | 125 | 0.020 | 0.20 | Invention |
| 3 | 1-51 | 120 | 0.020 | 0.25 | Invention |
| 4 | 2-23 | 125 | 0.020 | 0.23 | Invention |
| 5 | 3-31 | 122 | 0.020 | 0.25 | Invention |
| 6 | 3-50 | 105 | 0.025 | 0.30 | Invention |
| 7 | 4-30 | 112 | 0.020 | 0.30 | Invention |
| 8 | 4-49 | 107 | 0.025 | 0.35 | Invention |
| 9 | HK-1 | 80 | 0.030 | 0.45 | Comparison |
| 10 | HK-2 | 85 | 0.020 | 0.30 | Comparison |
| 11 | HK-3 | 70 | 0.025 | 0.30 | Comparison |
| 12 | HK-4 | 80 | 0.025 | 0.35 | Comparison |
| 13 | HK-5 | 70 | 0.020 | 0.35 | Comparison |

When sensitized with Compound 1-48, 1-51, 2-23 or 3-31, good results were obtained in sensitivity, fog and storage fogging. Also, with use of Compound 4-30, 3-50 and 4-49, good results were obtained.

Furthermore, with use of the compound of the present invention where the chalcogen is tellurium or sulfur, the same results can be obtained.

Example 6

Optimized emulsions were prepared by excluding chloroauric acid and pentafluorophenyldiphenylphosphine selenide at the chemical sensitization of Emulsion Em-E in Example 5 and adding Compound 1-48, 1-51, 2-23, 3-31, 3-50, 4-30 or 4-49. A multilayer color light-sensitive material Sample 102 was prepared by coating layers one on another using Sample 1 described in Example 5 for Emulsion Em-K and the emulsion prepared here for Emulsion Em-E.

The photographic capabilities were examined by performing exposure, development and measurement of density thoroughly under the same conditions as in Example 5 except that the exposure was performed newly through SC-50 filter and a green filter was used at the measurement of density. The results obtained are shown in Table 4.

TABLE 4

| Sample No. | Compound No. | Relative Sensitivity | Fog | Storage Fogging | Remarks |
|---|---|---|---|---|---|
| 1 | chloroauric acid | 100 | 0.020 | 0.40 | Comparison |
| 2 | 1-48 | 130 | 0.015 | 0.30 | Invention |
| 3 | 1-51 | 120 | 0.015 | 0.25 | Invention |
| 4 | 2-23 | 125 | 0.017 | 0.25 | Invention |
| 5 | 3-31 | 125 | 0.020 | 0.20 | Invention |
| 6 | 3-50 | 100 | 0.020 | 0.35 | Invention |
| 7 | 4-30 | 110 | 0.020 | 0.35 | Invention |
| 8 | 4-49 | 115 | 0.025 | 0.35 | Invention |
| 9 | HK-1 | 85 | 0.035 | 0.50 | Comparison |
| 10 | HK-2 | 95 | 0.030 | 0.35 | Comparison |
| 11 | HK-3 | 90 | 0.030 | 0.40 | Comparison |
| 12 | HK-4 | 70 | 0.020 | 0.35 | Comparison |
| 13 | HK-5 | 75 | 0.025 | 0.45 | Comparison |

Similarly to Example 5, when sensitized with Compound 1-48, 1-51, 2-23 or 3-31, good results were obtained in sensitivity, fog and storage fogging. Also, with use of Compound 4-30, 3-50 or 4-49, next good results were obtained.

Example 7

Optimized emulsions were prepared by excluding chloroauric acid and pentafluorophenyldiphenylphosphine selenide at the chemical sensitization of Emulsion Em-A in Example 5 and adding Compound 1-48, 1-51, 2-23, 3-31, 3-50, 4-30 or 4-49. A multilayer color light-sensitive material Sample 103 was prepared by coating layers one on another using Sample 1 described in Example 5 for Emulsion Em-K and the emulsion prepared here for Emulsion Em-A.

The photographic capabilities were examined by performing exposure, development and measurement of density thoroughly under the same conditions as in Example 5 except that the exposure was performed newly through SC-50 filter and a red filter was used at the measurement of density.

Similarly to Examples 5 and 6, when sensitized with Compound 1-48, 1-51, 2-23 or 3-31, good results were obtained in sensitivity, fog and storage fogging. Also, with use of Compound 4-30, 3-50 or 4-49, next good results were obtained.

According to the present invention, a silver halide emulsion ensuring high-speed, high contrast, small fluctuation of sensitivity due to difference in the condition at exposure and excellent reciprocity law property at high intensity can be obtained. The silver halide photographic light-sensitive material using the emulsion can be elevated in sensitivity, reduced in fog and improved in storability, particularly prevented from increase of fog during storage.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide emulsion chemically sensitized by at least one compound having a bond of anionic chalcogenide to gold(I) cation and capable of releasing a gold-chalcogen anion species.

2. A method for chemically sensitizing a silver halide emulsion, comprising adding at least one compound having a bond of anionic chalcogenide to gold(I) cation and capable of releasing a gold-chalcogen anion species.

3. The silver halide emulsion as claimed in claim 1, wherein said compound capable of releasing a gold-chalcogen anion species is a compound represented by the following formula (1):

(1)

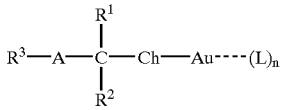

wherein Ch represents S, Se or Te, A represents O, S or $NR^4$, $R^1$ to $R^4$ each represents a hydrogen atom or a substituent, $R^3$ may form a 5-, 6- or 7-membered ring structure together with $R^1$ or $R^2$, L represents a compound capable of coordinating to gold through a nitrogen atom, a sulfur atom, a selenium atom or a tellurium atom, and n represents 0 or 1.

4. The silver halide emulsion as claimed in claim 3, wherein in formula (1), $R^3$ does not form a ring structure with either $R^1$ or $R^2$.

5. The silver halide emulsion as claimed in claim 3, wherein in formula (1), $R^3$ forms a 5-, 6- or 7-membered ring structure together with $R^1$ or $R^2$.

6. The silver halide emulsion as claimed in claim 5, wherein in formula (1) , the ring structure formed by $R^3$ together with $R^1$ or $R^2$ is a ring structure except for a monosaccharide structure.

7. The silver halide emulsion as claimed in claim 3, wherein in formula (1), $R^1$ and $R^2$ each is a group selected from a hydrogen atom, an alkyl group, an aryl group, a heterocyclic group, an alkoxy group, an aryloxy group, a heterocyclic oxy group, an alkylthio group, an arylthio group and a heterocyclic thio group.

8. The silver halide emulsion as claimed in claim 5, wherein in formula (1), the ring structure formed by $R^3$ together with $R^1$ or $R^2$ is a ring structure except for a monosaccharide structure.

9. The silver halide emulsion as claimed in claim 5, wherein in formula (1), Ch represents Se or Te and the ring structure formed by $R^3$ together with $R^1$ or $R^2$ is a monosaccharide structure.

10. The silver halide emulsion as claimed in claim 5, wherein in formula (1), Ch represents S and the ring structure formed by $R^3$ together with $R^1$ or $R^2$ is a monosaccharide structure.

11. The silver halide emulsion as claimed in claim 10, wherein in formula (1), n is 0 and the ring structure formed by $R^3$ together with $R^1$ or $R^2$ is a ring selected from the group consisting of mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine, glucuronic acid, and derivatives thereof.

12. The silver halide emulsion as claimed in claim 1, wherein said compound capable of releasing a gold-chalcogen anion species is a compound represented by the following formula (2):

(2)

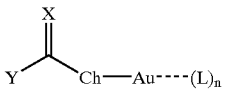

wherein Ch represents S, Se or Te, X represents O, S, Se or $NR^5$, Y represents H, an alkyl group, an alkenyl group, an alkynyl group, an aryl group, a heterocyclic group, $OR^6$, $SR^7$ or $N(R^8)R^9$, $R^5$ to $R^9$ each independently represents a hydrogen atom, an alkyl group, an alkenyl group, an alkynyl group, an aryl group or a heterocyclic group, X and Y may combine with each other to form a ring structure, L represents a compound capable of coordinating to gold through a nitrogen atom, a sulfur atom, a selenium atom or a tellurium atom, and n represents 0 or 1.

13. The silver halide emulsion as claimed in claim 12, wherein in formula (2), Ch is Se or Te.

14. The silver halide emulsion as claimed in claim 12, wherein in formula (2), Ch is S and n is 1.

15. The silver halide emulsion as claimed in claim 12, wherein in formula (2), Ch is S, n is 0 and X is O or $NR^5$.

16. The silver halide emulsion as claimed in claim 1, wherein said compound capable of releasing a gold-chalcogen anion species is a compound represented by the following formula (3):

(3)

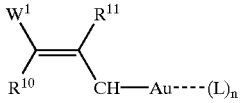

wherein Ch represents S, Se or Te, $W^1$ represents an electron-withdrawing group, $R^{10}$ and $R^{11}$ each independently represents a hydrogen atom or a substituent, $W^1$ and $R^{10}$, $W^1$ and $R^{11}$, or $R^{10}$ and $R^{11}$ may combine with each other to form a ring structure, L represents a compound capable of coordinating to gold through a nitrogen atom, a sulfur atom, a selenium atom or a tellurium atom, and n represents 0 or 1.

17. The silver halide emulsion as claimed in claim 16, wherein in formula (3), $R^{10}$ represents an electron-withdrawing group.

18. The silver halide emulsion as claimed in claim 1, wherein said compound capable of releasing a gold-chalcogen anion species is a compound represented by the following formula (4):

(4)

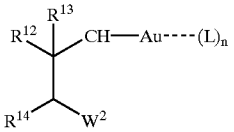

wherein Ch represents S, Se or Te, $W^2$ represents an electron-withdrawing group, $R^{12}$ to $R^{14}$ each independently represents a hydrogen atom or a substituent, L represents a compound capable of coordinating to gold through a nitrogen atom, a sulfur atom, a selenium atom or a tellurium atom, n represents 0 or 1, $W^2$ and $R^{12}$ may combine with each other to form a ring structure, and when Ch represents S, at least one of the following conditions (a), (b) and (c) is satisfied:

(a) at least one of $R^{13}$ and $R^{14}$ is an aryl group (b) $W^2$ and $R^{12}$ are bonded each other to form a 5-, 6-, or 7-membered ring.

(c) the sum of Hammett's substituent constant $\sigma_p$ values of $W^2$, $R^{12}$ to $R^{14}$ is 0.6 or more.

19. The silver halide emulsion as claimed in claim 18, wherein in formula (4), Ch is Se or Te.

20. The silver halide emulsion as claimed in claim 18, wherein in formula (4), Ch is S and n is 1.

21. The silver halide emulsion as claimed in claim 18, wherein in formula (4), Ch is S, n is 0, and $R^{12}$ and $R^{13}$ each is a group selected from the group consisting of a hydrogen atom, an alkyl group, an alkenyl group, an alkynyl group, an aryl group, a heterocyclic group, an alkoxy group, an aryloxy group, a heterocyclic oxy group, an acyloxy group, an acylamino group, an alkylthio group, an arylthio group, a heterocyclic thio group, an alkylsulfonyl group, an arylsulfonyl group, an acyl group, an aryloxycarbonyl group, an alkoxycarbonyl group and a carbamoyl group.

22. The silver halide emulsion as claimed in claim 3, wherein in formula (1), L is an anionic chalcogenide.

23. The silver halide emulsion as claimed in claim 12, wherein in formula (2), L is an anionic chalcogenide.

24. The silver halide emulsion as claimed in claim 16, wherein in formula (3), L is an anionic chalcogenide.

25. The silver halide emulsion as claimed in claim 18, wherein in formula (4), L is an anionic chalcogenide.

26. A silver halide photographic light-sensitive material comprising a support having thereon at least one silver halide emulsion layer, wherein at least one silver halide emulsion layer contains a silver halide emulsion subjected to chemical sensitization by at least one compound having a bond of anionic chalcogenide to gold(I) cation and capable of releasing a gold-chalcogen anion species.

* * * * *